US009058716B2

(12) United States Patent
Rajaraman et al.

(10) Patent No.: US 9,058,716 B2
(45) Date of Patent: Jun. 16, 2015

(54) REMOTE GAME PLAY IN A WIRELESS GAMING ENVIRONMENT

(75) Inventors: Arun Rajaraman, Reno, NV (US); Sathish Kumar Anantharaman, Kennesaw, GA (US); William Lewis, Auburn, CA (US)

(73) Assignee: Bally Gaming, Inc., Las Vegas, NV (US)

( * ) Notice: Subject to any disclaimer, the term of this patent is extended or adjusted under 35 U.S.C. 154(b) by 56 days.

(21) Appl. No.: 13/370,159

(22) Filed: Feb. 9, 2012
(Under 37 CFR 1.47)

(65) Prior Publication Data

US 2012/0309524 A1 Dec. 6, 2012

Related U.S. Application Data

(60) Provisional application No. 61/493,891, filed on Jun. 6, 2011.

(51) Int. Cl.
*A63F 9/00* (2006.01)
*G07F 17/32* (2006.01)

(52) U.S. Cl.
CPC ..... *G07F 17/3206* (2013.01); *G07F 17/3223* (2013.01); *G07F 17/3227* (2013.01); *G07F 17/3272* (2013.01)

(58) Field of Classification Search
None
See application file for complete search history.

(56) References Cited

U.S. PATENT DOCUMENTS 2,595,845 A 5/1952 Hagwell
4,339,798 A 7/1982 Hedges et al.
4,467,424 A 8/1984 Hedges et al.
4,802,218 A 1/1989 Wright et al.
5,007,649 A 4/1991 Richardson
5,083,800 A 1/1992 Lockton (Continued)

FOREIGN PATENT DOCUMENTS

DE 19940954 A1 3/2001
EP 1 074 955 A2 2/2001

(Continued)

OTHER PUBLICATIONS

Bally Technologies, Inc., iVIEW, http://ballytech.com/systems/product.cfm?id=9, download date Nov. 6, 2007, 2 pages.

(Continued)

*Primary Examiner* — Seng H Lim
(74) *Attorney, Agent, or Firm* — Frank Abramonte; Marvin A. Hein; Philip J. Anderson

(57) ABSTRACT

A system employs a server computing system with an integrated database and wireless communications devices. The wireless communications devices permits players to take a position on a potential outcome of a game and includes remote game play and remote backline playing (taking a position on a potential outcome of a position on game outcome taken by a primary player occupying a player position at a gaming table) and other types of positions not involving money. In response to the electronic indication that the primary player is no longer occupying the player position at the gaming table the system automatically initiates a period locking out players taking positions on the potential outcome of the game such as a position on game outcome lock out period for such proposed backline positions on game outcome and modifies the user interface on a wireless device of the dealer accordingly.

17 Claims, 31 Drawing Sheets

(56) References Cited

U.S. PATENT DOCUMENTS 5,179,517 A 1/1993 Sarbin et al.
5,265,874 A 11/1993 Dickinson et al.
5,275,400 A 1/1994 Weingardt et al.
5,321,241 A 6/1994 Craine
5,324,035 A 6/1994 Morris et al.
5,326,104 A 7/1994 Pease et al.
5,361,885 A 11/1994 Modler
5,397,133 A 3/1995 Penzias
5,398,932 A 3/1995 Eberhardt et al.
5,472,194 A 12/1995 Breeding et al.
5,493,613 A 2/1996 Denno et al.
5,505,449 A 4/1996 Eberhardt et al.
5,505,461 A 4/1996 Bell et al.
5,513,851 A 5/1996 Harris
5,559,312 A 9/1996 Lucero
5,562,284 A 10/1996 Stevens
5,575,474 A 11/1996 Rossides
5,605,334 A 2/1997 McCrea, Jr.
5,605,506 A 2/1997 Hoorn et al.
5,613,912 A 3/1997 Slater
5,643,086 A 7/1997 Alcorn et al.
5,643,088 A 7/1997 Vaughn et al.
5,651,548 A 7/1997 French et al.
5,655,961 A 8/1997 Acres et al.
5,679,077 A 10/1997 Pocock et al.
5,707,287 A 1/1998 McCrea, Jr.
5,735,742 A 4/1998 French
5,741,183 A 4/1998 Acres et al.
5,745,110 A 4/1998 Ertemalp
5,759,102 A 6/1998 Pease et al.
5,770,533 A 6/1998 Franchi
5,779,545 A 7/1998 Berg et al.
5,800,268 A 9/1998 Molnick
5,813,912 A 9/1998 Shultz
5,816,918 A 10/1998 Kelly et al.
5,823,534 A 10/1998 Banyai
5,823,879 A 10/1998 Goldberg et al.
5,830,067 A 11/1998 Graves et al.
5,830,068 A 11/1998 Brenner et al.
5,851,149 A 12/1998 Xidos et al.
5,871,213 A 2/1999 Chadband et al.
5,890,963 A 4/1999 Yen
5,895,451 A 4/1999 Yamade et al.
5,902,983 A 5/1999 Crevelt et al.
5,905,847 A 5/1999 Kobayashi et al.
5,911,626 A 6/1999 McCrea, Jr.
5,919,090 A 7/1999 Mothwurf
5,919,091 A 7/1999 Bell et al.
5,924,926 A 7/1999 Brown
5,936,527 A 8/1999 Isaacman et al.
5,941,769 A 8/1999 Order
5,957,776 A 9/1999 Hoehne
5,971,851 A 10/1999 Pascal et al.
5,974,135 A 10/1999 Breneman et al.
5,999,808 A 12/1999 LaDue
6,001,016 A 12/1999 Walker et al.
6,004,207 A 12/1999 Wilson, Jr. et al.
6,041,722 A 3/2000 Baker
6,047,322 A 4/2000 Vaid et al.
6,048,269 A 4/2000 Burns et al.
6,062,565 A 5/2000 Chadband et al.
6,068,553 A 5/2000 Parker
6,077,161 A 6/2000 Wisler
6,080,063 A 6/2000 Khosla
6,083,105 A 7/2000 Ronin et al.
6,089,980 A 7/2000 Gauselmann
6,093,103 A 7/2000 McCrea, Jr.
6,102,799 A 8/2000 Stupak
6,104,815 A 8/2000 Alcorn et al.
6,105,964 A 8/2000 Maahs
6,110,041 A 8/2000 Walker et al.
6,110,043 A 8/2000 Olsen
6,113,493 A 9/2000 Walker et al.
6,117,012 A 9/2000 McCrea, Jr.
6,135,453 A 10/2000 Srichayaporn
6,135,887 A 10/2000 Pease et al.
6,146,273 A 11/2000 Olsen
6,149,522 A 11/2000 Alcorn et al.
6,152,824 A 11/2000 Rothschild et al.
6,168,523 B1 1/2001 Piechowiak et al.
6,183,366 B1 2/2001 Goldberg et al.
6,185,184 B1 2/2001 Mattaway et al.
6,186,892 B1 2/2001 Frank et al.
6,190,256 B1 2/2001 Walker et al.
6,210,277 B1 4/2001 Stefan
6,217,447 B1 4/2001 Lofink et al.
6,219,836 B1 4/2001 Wells et al.
6,227,972 B1 5/2001 Walker et al.
6,234,898 B1 5/2001 Belamant et al.
6,244,958 B1 6/2001 Acres
6,251,014 B1 6/2001 Stockdale et al.
6,254,483 B1 7/2001 Acres
6,254,484 B1 * 7/2001 McCrea, Jr. ..... 463/27
6,256,651 B1 7/2001 Tuli
6,264,109 B1 7/2001 Chapet et al.
6,264,561 B1 7/2001 Saffari et al.
6,282,522 B1 8/2001 Davis et al.
6,287,202 B1 9/2001 Pascal et al.
6,302,793 B1 10/2001 Fertitta, III et al.
6,312,332 B1 11/2001 Walker et al.
6,319,125 B1 11/2001 Acres
6,346,044 B1 2/2002 McCrea, Jr.
6,347,738 B1 2/2002 Crevelt et al.
6,361,437 B1 3/2002 Walker et al.
6,362,836 B1 3/2002 Shaw et al.
6,380,953 B1 4/2002 Mizuno
6,383,076 B1 5/2002 Tiedeken
6,389,126 B1 5/2002 Bjornberg et al.
6,394,900 B1 5/2002 McGlone et al.
6,394,907 B1 5/2002 Rowe
6,400,272 B1 6/2002 Holtzman et al.
6,401,099 B1 6/2002 Koppolu et al.
6,409,602 B1 6/2002 Wiltshire et al.
6,443,839 B2 9/2002 Stockdale et al.
6,459,882 B1 10/2002 Palermo
6,460,848 B1 10/2002 Soltys et al.
6,464,584 B2 10/2002 Oliver
6,468,155 B1 10/2002 Zucker et al.
6,490,285 B2 12/2002 Lee et al.
6,503,147 B1 1/2003 Stockdale et al.
6,505,772 B1 1/2003 Mollett et al.
6,508,709 B1 1/2003 Karmarkar
6,508,710 B1 1/2003 Paravia et al.
6,516,350 B1 2/2003 Lumelsky et al.
6,527,638 B1 3/2003 Walker et al.
6,547,131 B1 4/2003 Foodman et al.
6,575,829 B2 6/2003 Coleman et al.
6,575,834 B1 6/2003 Lindo
6,579,179 B2 6/2003 Poole et al.
6,585,598 B2 7/2003 Nguyen et al.
6,607,441 B1 8/2003 Acres
6,609,978 B1 8/2003 Paulsen
6,612,928 B1 9/2003 Bradford et al.
6,628,939 B2 9/2003 Paulsen
6,629,184 B1 9/2003 Berg et al.
6,629,591 B1 10/2003 Griswold et al.
6,629,889 B2 10/2003 Mothwurf
6,638,169 B2 10/2003 Wilder et al.
6,638,170 B1 10/2003 Crumby
6,645,077 B2 11/2003 Rowe
6,652,378 B2 11/2003 Cannon et al.
6,652,379 B2 11/2003 Soltys et al.
6,656,048 B2 12/2003 Olsen
6,675,152 B1 1/2004 Prasad et al.
6,676,522 B2 1/2004 Rowe et al.
6,682,421 B1 1/2004 Rowe et al.
6,682,423 B2 1/2004 Brosnan et al.
6,685,564 B2 2/2004 Oliver
6,685,567 B2 2/2004 Cockerille et al.
6,685,568 B2 2/2004 Soltys et al.
6,690,156 B1 2/2004 Weiner et al.
6,699,128 B1 3/2004 Beadell et al.
6,702,291 B2 3/2004 Grebler et al.
6,702,672 B1 3/2004 Angell et al.

(56) References Cited

U.S. PATENT DOCUMENTS 6,712,695 B2 3/2004 Mothwurf et al.
6,718,361 B1 4/2004 Basani et al.
6,722,985 B2 4/2004 Criss-Puszkiewicz et al.
6,726,099 B2 4/2004 Becker et al.
6,739,975 B2 5/2004 Nguyen et al.
6,743,102 B1 6/2004 Fiechter et al.
6,746,330 B2 6/2004 Cannon
6,752,312 B1 6/2004 Chamberlain et al.
6,755,741 B1 6/2004 Rafaeli
6,800,029 B2 10/2004 Rowe et al.
6,811,488 B2 11/2004 Paravia et al.
6,817,948 B2 11/2004 Pascal et al.
6,823,419 B2 11/2004 Berg et al.
6,837,789 B2 1/2005 Garahi et al.
6,846,238 B2 1/2005 Wells
6,848,994 B1 2/2005 Knust et al.
6,854,085 B1 2/2005 Morse
6,866,581 B2 3/2005 Martinek et al.
6,866,586 B2 3/2005 Oberberger et al.
6,884,170 B2 4/2005 Rowe
6,884,173 B2 4/2005 Gauselmann
6,884,174 B2 4/2005 Lundy et al.
6,896,618 B2 5/2005 Benoy et al.
6,899,627 B2 5/2005 Lam et al.
6,901,440 B1 5/2005 Bimm et al.
6,905,411 B2 6/2005 Nguyen et al.
6,908,387 B2 6/2005 Hedrick et al.
6,969,319 B2 11/2005 Rowe et al.
6,971,956 B2 12/2005 Rowe et al.
6,972,682 B2 12/2005 Lareau et al.
6,991,540 B2 1/2006 Marlow
6,991,544 B2 1/2006 Soltys et al.
6,993,587 B1 1/2006 Basani et al.
6,997,803 B2 2/2006 LeMay et al.
7,005,985 B1 2/2006 Steeves
7,013,469 B2 3/2006 Smith et al.
7,025,674 B2 4/2006 Adams et al.
7,027,996 B2 4/2006 Levinson
7,035,626 B1 4/2006 Luciano, Jr.
7,050,056 B2 5/2006 Meyringer
7,051,101 B1 5/2006 Dubrovsky et al.
7,062,470 B2 6/2006 Prasad et al.
7,063,617 B2 6/2006 Brosnan et al.
7,086,947 B2 8/2006 Walker et al.
7,099,035 B2 8/2006 Brooks et al.
7,100,184 B1 8/2006 Kahn
7,112,138 B2 9/2006 Hedrick et al.
7,120,879 B2 10/2006 Gutberlet et al.
7,147,558 B2 12/2006 Giobbi
7,168,089 B2 1/2007 Nguyen et al.
7,186,181 B2 3/2007 Rowe
RE39,644 E 5/2007 Alcorn et al.
7,222,852 B2 5/2007 Soltys et al.
7,234,698 B2 6/2007 Grauzer et al.
7,260,834 B1 8/2007 Carlson
7,271,727 B2 9/2007 Steeves
7,291,068 B2 11/2007 Bryant et al.
7,297,062 B2 11/2007 Gatto et al.
7,300,352 B2 11/2007 Rowe
7,303,475 B2 12/2007 Britt et al.
7,309,065 B2 12/2007 Yoseloff et al.
7,311,598 B2 12/2007 Kaminkow et al.
7,311,605 B2 12/2007 Moser
7,329,185 B2 2/2008 Conover et al.
7,330,822 B1 2/2008 Robson et al.
7,331,520 B2 2/2008 Silva et al.
7,337,330 B2 2/2008 Gatto et al.
7,346,682 B2 3/2008 Basani et al.
7,349,920 B1 3/2008 Feinberg et al.
7,351,147 B2 4/2008 Stockdale et al.
7,353,183 B1 4/2008 Musso
7,356,770 B1 4/2008 Jackson
7,363,342 B1 4/2008 Wang et al.
7,364,510 B2 4/2008 Walker et al.
7,370,282 B2 5/2008 Cary
7,384,339 B2 6/2008 LeMay et al.
7,390,256 B2 6/2008 Soltys et al.
7,398,327 B2 7/2008 Lee
7,410,422 B2 8/2008 Fine
7,419,428 B2 9/2008 Rowe
7,427,233 B2 9/2008 Walker et al.
7,427,234 B2 9/2008 Soltys et al.
7,427,236 B2 9/2008 Kaminkow et al.
7,434,805 B2 10/2008 Grauzer et al.
7,435,179 B1 10/2008 Ford
7,438,643 B2 10/2008 Brosnan et al.
7,455,591 B2 11/2008 Nguyen
7,460,863 B2 12/2008 Steelberg et al.
7,465,231 B2 12/2008 Lewin et al.
7,473,178 B2 1/2009 Boyd et al.
7,483,394 B2 1/2009 Chang et al.
7,484,207 B2 1/2009 Sato
7,510,474 B2 3/2009 Carter, Sr.
7,515,718 B2 4/2009 Nguyen et al.
7,534,169 B2 5/2009 Amaitis et al.
7,540,806 B2 6/2009 Tastad
7,549,576 B2 6/2009 Alderucci et al.
7,566,274 B2 7/2009 Johnson et al.
7,575,234 B2 8/2009 Soltys et al.
7,577,847 B2 8/2009 Nguyen et al.
7,578,739 B2 8/2009 Gauselmann
7,581,256 B2 8/2009 Cockerille et al.
7,585,217 B2 9/2009 Lutnick et al.
7,594,030 B2 9/2009 Teodosiu et al.
7,607,976 B2 10/2009 Baerlocher et al.
7,607,977 B2 10/2009 Baerlocher et al.
7,610,549 B2 10/2009 Vignet
7,611,407 B1 11/2009 Itkis et al.
7,611,409 B2 11/2009 Muir et al.
7,617,151 B2 11/2009 Rowe
7,618,317 B2 11/2009 Jackson
7,621,809 B2 11/2009 Baerlocher et al.
7,629,886 B2 12/2009 Steeves
7,634,550 B2 12/2009 Wolber et al.
7,637,810 B2 12/2009 Amaitis et al.
7,644,861 B2 1/2010 Alderucci et al.
7,648,414 B2 1/2010 McNutt et al.
7,666,081 B2 2/2010 Baerlocher et al.
7,674,179 B2 3/2010 Baerlocher et al.
7,682,249 B2 3/2010 Winans et al.
7,684,874 B2 3/2010 Schlottmann et al.
7,684,882 B2 3/2010 Baerlocher et al.
7,685,516 B2 3/2010 Fischer
7,685,593 B2 3/2010 Solomon et al.
7,686,688 B2 3/2010 Friedman et al.
7,688,322 B2 3/2010 Kapler et al.
7,689,302 B2 3/2010 Schlottmann et al.
7,690,995 B2 4/2010 Frankulin et al.
7,699,697 B2 4/2010 Darrah et al.
7,699,703 B2 4/2010 Muir et al.
7,702,719 B1 4/2010 Betz et al.
7,706,895 B2 4/2010 Callaghan
7,712,050 B2 5/2010 Gutberlet et al.
7,722,453 B2 5/2010 Lark et al.
7,730,198 B2 6/2010 Ruppert et al.
7,736,221 B2 6/2010 Black et al.
7,744,462 B2 6/2010 Grav et al.
7,747,741 B2 6/2010 Basani et al.
7,749,078 B2 7/2010 Vlazny et al.
7,753,789 B2 7/2010 Walker et al.
7,753,790 B2 7/2010 Nguyen et al.
7,762,888 B2 7/2010 Rowe
7,769,877 B2 8/2010 McBride et al.
7,778,635 B2 8/2010 Crookham et al.
7,780,525 B2 8/2010 Walker et al.
7,780,526 B2 8/2010 Nguyen et al.
7,780,529 B2 8/2010 Rowe et al.
7,783,881 B2 8/2010 Morrow et al.
7,785,193 B2 8/2010 Paulsen et al.
7,785,204 B2 8/2010 Wells et al.
7,787,972 B2 8/2010 Schlottmann et al.
7,788,503 B2 8/2010 Gatto et al.
7,805,719 B2 9/2010 O'Neill
7,819,742 B2 10/2010 Chamberlain et al.

(56) References Cited

U.S. PATENT DOCUMENTS 7,824,267 B2 11/2010 Cannon et al.
7,828,649 B2 11/2010 Cuddy et al.
7,828,661 B1 11/2010 Fish et al.
7,841,946 B2 11/2010 Walker et al.
7,844,944 B2 11/2010 Gutberlet et al.
7,846,020 B2 12/2010 Walker et al.
7,850,528 B2 12/2010 Wells
7,857,702 B2 12/2010 Hilbert
7,862,425 B2 1/2011 Cavagna
7,867,081 B2 1/2011 Schneider et al.
7,874,920 B2 1/2011 Hornik et al.
7,874,921 B2 1/2011 Baszucki et al.
7,886,288 B2 2/2011 Breckner et al.
7,892,093 B2 2/2011 Kniesteadt et al.
7,898,679 B2 3/2011 Brack et al.
7,901,294 B2 3/2011 Walker et al.
7,905,780 B2 3/2011 Morrow et al.
7,905,784 B2 3/2011 Soltys et al.
7,908,486 B2 3/2011 Gatto et al.
7,918,738 B2 4/2011 Paulsen
7,921,026 B2 4/2011 O'Cull et al.
7,921,405 B2 4/2011 Gupta et al.
7,931,533 B2 4/2011 LeMay et al.
7,937,464 B2 5/2011 Ruppert et al.
7,963,847 B2 6/2011 Baerlocher
7,993,199 B2 8/2011 Iddings et al.
8,025,569 B2 * 9/2011 Nguyen et al. ..... 463/30
8,025,574 B2 9/2011 Hilbert
8,028,046 B2 9/2011 Elliott et al.
8,033,913 B2 10/2011 Cockerille et al.
8,037,313 B2 10/2011 Hämäläinen et al.
8,051,180 B2 11/2011 Mazzaferri et al.
8,062,121 B2 11/2011 Crivelli
8,070,583 B2 12/2011 Baerlocher et al.
8,073,657 B2 12/2011 Moore, III et al.
8,117,461 B2 2/2012 Bigelow, Jr. et al.
8,157,652 B2 * 4/2012 Nguyen et al. ..... 463/42
8,177,634 B2 5/2012 Herrmann et al.
8,182,346 B2 5/2012 Herrmann et al.
8,187,101 B2 5/2012 Herrmann et al.
8,192,289 B2 6/2012 Herrmann et al.
8,197,340 B2 6/2012 Garvey et al.
8,197,344 B2 6/2012 Rathsack et al.
8,201,229 B2 6/2012 Ruppert et al.
8,246,466 B2 8/2012 Herrmann et al.
8,272,945 B2 * 9/2012 Kelly et al. ..... 463/25
8,277,324 B2 10/2012 Herrmann et al.
8,280,777 B2 10/2012 Mengerink et al.
8,285,740 B2 10/2012 Graham et al.
8,303,414 B2 11/2012 Joshi
8,308,554 B2 11/2012 Rowe et al.
8,360,870 B2 1/2013 Herrmann et al.
8,366,550 B2 2/2013 Herrmann et al.
8,512,150 B2 8/2013 Herrmann et al.
2001/0019966 A1 9/2001 Idaka
2002/0004824 A1 1/2002 Cuan et al.
2002/0036380 A1 * 3/2002 Perrie et al. ..... 273/146
2002/0094869 A1 * 7/2002 Harkham ..... 463/42
2002/0111213 A1 8/2002 McEntee et al.
2002/0113371 A1 8/2002 Snow
2002/0115487 A1 8/2002 Wells
2002/0115490 A1 8/2002 Burnet et al.
2002/0119824 A1 8/2002 Allen
2002/0142844 A1 10/2002 Kerr
2002/0144115 A1 10/2002 Lemay et al.
2002/0147047 A1 10/2002 Letovsky et al.
2002/0151363 A1 10/2002 Letovsky et al.
2002/0152120 A1 10/2002 Howington
2003/0004871 A1 1/2003 Rowe
2003/0032474 A1 2/2003 Kaminkow
2003/0042679 A1 3/2003 Snow
2003/0064798 A1 4/2003 Grauzer et al.
2003/0075869 A1 4/2003 Breeding et al.
2003/0090064 A1 5/2003 Hoyt et al.
2003/0104865 A1 6/2003 Itkis et al.
2003/0130024 A1 7/2003 Darby
2003/0134675 A1 7/2003 Oberberger
2003/0182414 A1 9/2003 O'Neill
2003/0185229 A1 10/2003 Shachar et al.
2003/0195025 A1 * 10/2003 Hill ..... 463/11
2003/0195037 A1 10/2003 Vuong et al.
2003/0206548 A1 11/2003 Bannai et al.
2003/0224858 A1 12/2003 Yoseloff et al.
2003/0228912 A1 12/2003 Wells et al.
2003/0232651 A1 12/2003 Huard et al.
2004/0002386 A1 1/2004 Wolfe et al.
2004/0002388 A1 1/2004 Larsen et al.
2004/0029635 A1 2/2004 Giobbi
2004/0043815 A1 3/2004 Kaminkow
2004/0043820 A1 3/2004 Schlottmann
2004/0048669 A1 3/2004 Rowe
2004/0048671 A1 3/2004 Rowe
2004/0064817 A1 4/2004 Shibayama et al.
2004/0082385 A1 4/2004 Silva et al.
2004/0087375 A1 5/2004 Gelinotte
2004/0106452 A1 6/2004 Nguyen et al.
2004/0110119 A1 6/2004 Riconda et al.
2004/0127291 A1 7/2004 George et al.
2004/0132529 A1 7/2004 Mkrtchyan et al.
2004/0133485 A1 7/2004 Schoonmaker et al.
2004/0142744 A1 7/2004 Atkinson et al.
2004/0166940 A1 8/2004 Rothschild
2004/0185936 A1 9/2004 Block et al.
2004/0219982 A1 11/2004 Khoo et al.
2004/0229682 A1 11/2004 Gelinotte
2004/0229684 A1 11/2004 Blackburn et al.
2004/0254993 A1 12/2004 Mamas
2004/0259618 A1 12/2004 Soltys et al.
2005/0026680 A1 2/2005 Gururajan
2005/0027604 A1 2/2005 Bandy et al.
2005/0043094 A1 2/2005 Nguyen et al.
2005/0051965 A1 3/2005 Gururajan
2005/0054408 A1 3/2005 Steil et al.
2005/0054438 A1 3/2005 Rothschild et al.
2005/0054445 A1 3/2005 Gatto et al.
2005/0059479 A1 3/2005 Soltys et al.
2005/0070358 A1 3/2005 Angell et al.
2005/0080898 A1 4/2005 Block
2005/0116020 A1 6/2005 Smolucha et al.
2005/0119052 A1 6/2005 Russell et al.
2005/0153778 A1 7/2005 Nelson et al.
2005/0164761 A1 7/2005 Tain
2005/0171808 A1 8/2005 Saenz et al.
2005/0176507 A1 8/2005 Ephrati
2005/0222891 A1 10/2005 Chan et al.
2005/0239542 A1 10/2005 Olsen
2005/0266919 A1 12/2005 Rowe et al.
2005/0282608 A1 * 12/2005 O'Halloran ..... 463/16
2005/0282623 A1 12/2005 Matsuno et al.
2005/0282626 A1 12/2005 Manfredi et al.
2005/0288083 A1 12/2005 Downs, III
2006/0003828 A1 * 1/2006 Abecassis ..... 463/16
2006/0004618 A1 1/2006 Brixius
2006/0009282 A1 1/2006 George et al.
2006/0015716 A1 1/2006 Thornton et al.
2006/0019745 A1 1/2006 Benbrahim
2006/0026499 A1 2/2006 Weddle
2006/0031763 A1 2/2006 Yeung
2006/0035707 A1 2/2006 Nguyen et al.
2006/0046849 A1 3/2006 Kovacs
2006/0052169 A1 3/2006 Britt et al.
2006/0073865 A1 * 4/2006 Groves ..... 463/11
2006/0100019 A1 * 5/2006 Hornik et al. ..... 463/42
2006/0111179 A1 * 5/2006 Inamura ..... 463/29
2006/0116208 A1 6/2006 Chen et al.
2006/0121970 A1 6/2006 Khal
2006/0172804 A1 8/2006 Acres et al.
2006/0183541 A1 8/2006 Okada et al.
2006/0195847 A1 8/2006 Amano et al.
2006/0205508 A1 9/2006 Green
2006/0217202 A1 9/2006 Burke et al.
2006/0247013 A1 11/2006 Walker et al.
2006/0247057 A1 11/2006 Green et al.
2006/0248161 A1 11/2006 O'Brien et al.

(56) References Cited

U.S. PATENT DOCUMENTS

2006/0252530 A1 11/2006 Oberberger et al.
2006/0253702 A1 11/2006 Lowell et al.
2006/0258446 A1* 11/2006 Nguyen et al. ..... 463/30
2006/0259604 A1 11/2006 Kotchavi et al.
2006/0277487 A1 12/2006 Poulsen et al.
2006/0287098 A1 12/2006 Morrow et al.
2007/0015583 A1 1/2007 Tran
2007/0026935 A1 2/2007 Wolf et al.
2007/0026942 A1 2/2007 Kinsley et al.
2007/0032288 A1 2/2007 Nelson et al.
2007/0033247 A1 2/2007 Martin
2007/0054725 A1 3/2007 Morrow et al.
2007/0054740 A1 3/2007 Salls et al.
2007/0057469 A1 3/2007 Grauzer et al.
2007/0060225 A1 3/2007 Hosogai et al.
2007/0060259 A1 3/2007 Pececnik
2007/0060260 A1 3/2007 Fleckenstein
2007/0060307 A1 3/2007 Mathis et al.
2007/0060310 A1 3/2007 Juds et al.
2007/0060320 A1 3/2007 Kelly et al.
2007/0060354 A1 3/2007 Theimer et al.
2007/0060365 A1 3/2007 Tien et al.
2007/0077995 A1 4/2007 Oak et al.
2007/0093298 A1 4/2007 Brunet
2007/0105628 A1 5/2007 Arbogast et al.
2007/0111775 A1 5/2007 Yoseloff
2007/0111791 A1 5/2007 Arbogast et al.
2007/0111794 A1 5/2007 Hogan et al.
2007/0117604 A1* 5/2007 Hill ..... 463/16
2007/0117608 A1 5/2007 Roper et al.
2007/0118844 A1 5/2007 Huang et al.
2007/0123346 A1 5/2007 Perez et al.
2007/0124483 A1 5/2007 Marples et al.
2007/0129145 A1 6/2007 Blackburn et al.
2007/0149282 A1 6/2007 Lu et al.
2007/0150329 A1 6/2007 Brook et al.
2007/0155490 A1 7/2007 Phillips et al.
2007/0167235 A1 7/2007 Naicker
2007/0191102 A1 8/2007 Coliz et al.
2007/0192748 A1 8/2007 Martin et al.
2007/0198418 A1 8/2007 MacDonald et al.
2007/0208816 A1 9/2007 Baldwin et al.
2007/0214030 A1 9/2007 Shear et al.
2007/0218998 A1 9/2007 Arbogast et al.
2007/0235521 A1 10/2007 Mateen et al.
2007/0238526 A1 10/2007 Chandranmenon et al.
2007/0243925 A1 10/2007 LeMay et al.
2007/0243927 A1* 10/2007 Soltys ..... 463/25
2007/0243935 A1* 10/2007 Huizinga ..... 463/42
2007/0259709 A1 11/2007 Kelly et al.
2007/0259711 A1 11/2007 Thomas
2007/0265092 A1 11/2007 Betteridge
2007/0287535 A1 12/2007 Soltys
2007/0298865 A1 12/2007 Soltys
2007/0298868 A1 12/2007 Soltys
2008/0004108 A1 1/2008 Klinkhammer
2008/0009344 A1 1/2008 Graham et al.
2008/0026832 A1 1/2008 Stevens et al.
2008/0026848 A1 1/2008 Byng
2008/0038035 A1 2/2008 Shuldman et al.
2008/0045341 A1 2/2008 Englman
2008/0045342 A1 2/2008 Crowder, Jr. et al.
2008/0051171 A1* 2/2008 Lutnick et al. ..... 463/20
2008/0058105 A1 3/2008 Combs et al.
2008/0064501 A1 3/2008 Patel
2008/0065590 A1 3/2008 Castro et al.
2008/0076572 A1 3/2008 Nguyen et al.
2008/0090651 A1 4/2008 Baerlocher
2008/0096659 A1 4/2008 Kreloff et al.
2008/0102919 A1 5/2008 Rowe et al.
2008/0102932 A1 5/2008 Anderson et al.
2008/0108405 A1 5/2008 Brosnan et al.
2008/0108433 A1 5/2008 DiMichele et al.
2008/0113764 A1 5/2008 Soltys
2008/0113767 A1* 5/2008 Nguyen et al. ..... 463/25
2008/0113773 A1 5/2008 Johnson et al.
2008/0113781 A1 5/2008 Soltys et al.
2008/0119284 A1 5/2008 Luciano, Jr. et al.
2008/0127174 A1 5/2008 Johnson
2008/0138773 A1 6/2008 Lathrop
2008/0146337 A1 6/2008 Halonen et al.
2008/0153599 A1 6/2008 Atashband et al.
2008/0153600 A1 6/2008 Swarna
2008/0154916 A1 6/2008 Atashband
2008/0155665 A1 6/2008 Ruppert et al.
2008/0162729 A1 7/2008 Ruppert
2008/0165771 A1 7/2008 Gainey et al.
2008/0171588 A1 7/2008 Atashband
2008/0171598 A1 7/2008 Deng
2008/0180250 A1* 7/2008 Steil ..... 340/572.1
2008/0200255 A1 8/2008 Eisele
2008/0217851 A1 9/2008 Colton
2008/0243697 A1 10/2008 Irving et al.
2008/0244565 A1 10/2008 Levidow et al.
2008/0248849 A1* 10/2008 Lutnick et al. ..... 463/16
2008/0261699 A1 10/2008 Topham et al.
2008/0261701 A1 10/2008 Lewin et al.
2008/0287197 A1 11/2008 Ruppert et al.
2008/0293494 A1 11/2008 Adiraju et al.
2008/0300046 A1 12/2008 Gagner et al.
2008/0311971 A1 12/2008 Dean
2008/0313282 A1 12/2008 Warila et al.
2008/0318655 A1 12/2008 Davies
2008/0318685 A9 12/2008 Oak et al.
2009/0005176 A1 1/2009 Morrow et al.
2009/0005177 A1 1/2009 Kishi et al.
2009/0011833 A1 1/2009 Seelig et al.
2009/0029775 A1 1/2009 Ruppert et al.
2009/0054139 A1 2/2009 Anderson
2009/0063309 A1 3/2009 Stephens
2009/0069076 A1 3/2009 Silvestro
2009/0115133 A1 5/2009 Kelly et al.
2009/0117994 A1 5/2009 Kelly et al.
2009/0118001 A1 5/2009 Kelly et al.
2009/0118005 A1 5/2009 Kelly et al.
2009/0118006 A1 5/2009 Kelly et al.
2009/0124323 A1* 5/2009 Dunn et al. ..... 463/17
2009/0124329 A1 5/2009 Palmisano
2009/0124362 A1* 5/2009 Cuddy et al. ..... 463/27
2009/0124392 A1 5/2009 Ruppert et al.
2009/0124394 A1 5/2009 Swarna
2009/0125603 A1 5/2009 Atashband et al.
2009/0131144 A1 5/2009 Allen
2009/0131163 A1 5/2009 Arbogast et al.
2009/0132720 A1 5/2009 Ruppert et al.
2009/0137312 A1 5/2009 Walker et al.
2009/0156313 A1 6/2009 Blackburn et al.
2009/0163279 A1 6/2009 Hermansen et al.
2009/0170594 A1 7/2009 Delaney et al.
2009/0176556 A1 7/2009 Gagner et al.
2009/0176578 A1 7/2009 Herrmann et al.
2009/0176580 A1 7/2009 Herrmann et al.
2009/0181776 A1 7/2009 Deng
2009/0239667 A1 9/2009 Rowe et al.
2009/0253483 A1 10/2009 Pacey et al.
2009/0270170 A1 10/2009 Patton
2009/0275374 A1 11/2009 Nelson et al.
2009/0275393 A1 11/2009 Kisenwether et al.
2009/0275394 A1 11/2009 Young et al.
2009/0275398 A1 11/2009 Nelson
2009/0275399 A1 11/2009 Kelly et al.
2009/0275400 A1 11/2009 Rehm et al.
2009/0275401 A1 11/2009 Allen et al.
2009/0275402 A1 11/2009 Backover et al.
2009/0275410 A1 11/2009 Kisenwether et al.
2009/0275411 A1 11/2009 Kisenwether et al.
2009/0276341 A1 11/2009 McMahan et al.
2009/0276715 A1 11/2009 Arbogast et al.
2009/0298575 A1 12/2009 Hopkins et al.
2009/0298583 A1 12/2009 Jones
2009/0307069 A1 12/2009 Meyerhofer
2009/0325708 A9 12/2009 Kerr
2009/0325716 A1 12/2009 Harari
2010/0016067 A1 1/2010 White et al.

(56) References Cited

U.S. PATENT DOCUMENTS

| | | | | |
|---|---|---|---|---|
| 2010/0016068 | A1 | 1/2010 | White et al. | |
| 2010/0029385 | A1 | 2/2010 | Garvey et al. | |
| 2010/0048291 | A1 | 2/2010 | Warkentin | |
| 2010/0058320 | A1 | 3/2010 | Milligan et al. | |
| 2010/0062838 | A1 | 3/2010 | Nguyen et al. | |
| 2010/0093440 | A1 | 4/2010 | Burke | |
| 2010/0093441 | A1 | 4/2010 | Rajaraman et al. | |
| 2010/0099480 | A1* | 4/2010 | Caputo | 463/12 |
| 2010/0124990 | A1 | 5/2010 | Crowder | |
| 2010/0125851 | A1 | 5/2010 | Singh et al. | |
| 2010/0130280 | A1 | 5/2010 | Arezina et al. | |
| 2010/0131772 | A1 | 5/2010 | Atashband et al. | |
| 2010/0151926 | A1 | 6/2010 | Ruppert et al. | |
| 2010/0161798 | A1 | 6/2010 | Ruppert et al. | |
| 2010/0171267 | A1* | 7/2010 | Walker | 273/274 |
| 2010/0210353 | A1 | 8/2010 | Gagner et al. | |
| 2010/0234104 | A1 | 9/2010 | Ruppert et al. | |
| 2010/0248842 | A1 | 9/2010 | Ruppert | |
| 2011/0009184 | A1 | 1/2011 | Byng | |
| 2011/0009188 | A1 | 1/2011 | Adiraju et al. | |
| 2011/0111826 | A1 | 5/2011 | Baerlocher et al. | |
| 2011/0124417 | A1 | 5/2011 | Baynes et al. | |
| 2011/0179409 | A1 | 7/2011 | Yoseloff et al. | |
| 2011/0269534 | A1 | 11/2011 | Kelly et al. | |
| 2012/0110649 | A1 | 5/2012 | Murphy | |
| 2012/0203692 | A1 | 8/2012 | Olliphant et al. | |

FOREIGN PATENT DOCUMENTS

| | | | |
|---|---|---|---|
| EP | 1 291 045 | A2 | 3/2003 |
| EP | 1 463 008 | A2 | 9/2004 |
| GB | 2380143 | A | 4/2003 |
| JP | 8255059 | A | 10/1996 |
| JP | 2005-066133 | A | 3/2005 |
| JP | 2007-130212 | A | 5/2007 |
| KR | 2001-0084838 | A | 9/2001 |
| KR | 2002-0061793 | A | 7/2002 |
| KR | 2003-0091635 | A | 12/2003 |
| WO | 96/36253 | A1 | 11/1996 |
| WO | 97/13227 | A1 | 4/1997 |
| WO | 02/05914 | A1 | 1/2002 |
| WO | 03/023751 | A1 | 3/2003 |
| WO | 2005/035084 | A1 | 4/2005 |
| WO | 2007/033207 | A2 | 3/2007 |

OTHER PUBLICATIONS

Bally TMS, "MP21—Automated Table Tracking/Features," 2 pages, Nov. 2005.

Bally TMS, "MPBacc—Specifications/Specifications," 2 pages, Nov. 2005.

Bally TMS, "MPLite—Table Management System/Features," 2 pages, Nov. 2005.

Bulavsky, J., "Tracking the Tables," *Casino Journal*, May 2004, pp. 44-47, accessed Dec. 21, 2005, URL = http://www.ascendgaming.com/cj/vendors_manufacturers_table/Trackin916200411141AM.htm, 5 pages.

Burke, A., "Tracking the Tables," reprinted from *International Gaming & Wagering Business*, Aug. 2003, 4 pages.

Gros, R., "All You Ever Wanted to Know About Table Games," reprinted from *Global Gaming Business*, Aug. 1, 2003, 2 pages.

Hewlett Packard Handhelds, accessed Sep. 8, 2003, URL = http:/www.shopping.hp.com/cgi-bin/hpdirect/shopping/scripts/home/store_access.jsp?temp . . . , 2 pages.

International Guild of Hospitality & Restaurant Managers, "Shuffle Master, Inc. (NasdaqNM:SHFL)," accessed Dec. 30, 2003, URL = http://hospitalityguide.com/Financial/Casinos/Shuffle.htm, 3 pages.

MagTek, "Port Powered Swipe Reader," Technical Reference Manual, Manual Part No. 99875094 Rev 12, Jun. 2003, 20 pages.

Mikohn, "Mikohn Tablelink—The Industry's Premier Table Tracking Solution Delivers Improvements Straight to the Bottom Line," 2 pages, before Jan. 1, 2004.

Palermo, V. "Near-field magnetic comms emerges," EE Times Design, Oct. 31, 2003.

Semtek PDA & Handheld Devices, Compaq iSwipe™ Magnetic Card Reader, accessed Sep. 8, 2003, URL = http:/www.semtek.com/products/iswipe.html, 3 pages.

Terdiman, D., "Who's Holding the Aces Now?", reprinted from *Wired News*, Aug. 18, 2003, 2 pages.

Winkler, C., "Product Spotlight: MindPlay," reprinted from *Gaming and Leisure Technology*, Fall 2003, 2 pages.

"BOB and LDAP," Gaming Standards Association, Fremont, California, 7 pages, Oct. 26, 2003.

"GSA Point-to-Point SOAP/HTTPS Transport and Security Specification v1.0.3," Gaming Standards Association TRANSPORT Technical Committee, 16 pages, Jun. 5, 2007.

Gwyddion User Guide, "False Color Mapping: Chapter 3. Getting Started," retrieved from URL=http://sourceforge.net/projects/gwyddion/files/user-guide/2007-06-28/gwyddion-user-guide-xhtml-2007-06-28.tar.gz/download, retrieved on Nov. 21, 2012, 2 pages.

Requirements document, "Game Authentication Terminal Program (GAT3)," to Gaming Standards Association, Aug. 2005, 27 pages.

Standards document, "Technical Standards for Gaming Devices and On-Line Slot Systems," to Nevada Gaming Commission and State Gaming Control Board, Aug. 17, 2005, 15 pages.

Hung et al., "Performance Evaluation of the Least Conflict Sharable Spreading Code Assignment Algorithm," IEEE, 1996, 5 pages.

Olesiejuk, "Discovery Services for Gaming Devices on a Casino Floor," Gaming Standards Association, 3 pages, Mar. 12, 2007.

Soltys, "Wireless Gaming Enviornment," U.S. Appl. No. 60/791,397, filed Apr. 12, 2006, 107 pages.

* cited by examiner

| PIT | TABLE | STATUS |
|---|---|---|
| 1 | BA-001 | PLAY |
| 1 | BA-002 | PLAY |
| 1 | BA-003 | WAIT |
| 1 | BA-004 | CLOSED |
| 2 | BA-037 | PLAY |
| 2 | BA-038 | PLAY |
| 2 | BA-039 | WAIT |
| 2 | BA-040 | DEALER CHANGE |
| 3 | BA-05 | PLAY |
| 3 | BA-06 | SHUFFLING |
| 3 | BA-07 | PLAY |
| 3 | BA-08 | PLAY |
| 4 | BA-09 | CLOSED |
| 4 | BA-10 | CLOSED |
| 4 | BA-11 | CLOSED |
| 4 | BA-12 | CLOSED |
| 5 | BA-21 | CLOSED |
| 5 | BA-22 | CLOSED |

REMOTE GAME PLAY IN A WIRELESS GAMING ENVIRONMENT

CROSS REFERENCE TO RELATED APPLICATIONS

This application claims the benefit of U.S. Provisional Patent Application No. 61/493,891, entitled "REMOTE GAME PLAY IN A WIRELESS GAMING ENVIRONMENT," filed Jun. 6, 2011, which is incorporated herein by reference in its entirety.

BACKGROUND

1. Field of the Invention

This description generally relates to the field of gaming, and more particularly to facilitating and automating the gaming environment via communications devices, for example, handheld wireless communications devices.

2. Description of the Related Art

Gaming has enjoyed phenomenal growth over the recent past, with the construction of numerous casinos to service the increasing demand for gaming opportunities.

Casinos provide a large variety of games and other forms of entertainment for their customers. For example, casinos may provide gaming machines such as slot machines, video slot machines or video poker machines. Casinos also provide table games such as baccarat, blackjack, various types of poker, craps, roulette, and big wheel or wheel of fortune, to name a few. Due to the large amounts of money, particularly cash, involved in gaming, casinos must carefully monitor the activities of both players and casino employees. Careful and continuous monitoring of gaming activities not only enhances security, but also permits the management to better manage the casinos' business, for example, selecting the number and mix of tables, the hours of operation of various tables, staffing, etc.

Most casinos employee a large number of individuals to manually track the gaming activities. These individuals, often referred to as "pit bosses", observe the activity at various tables and/or gaming machines, and manually record the activity. In some casinos, the manually recorded information is later manually entered into one or more computing systems. This information may include information regarding the dealer's performance, for example, the number of hands dealt during all or a portion of a dealer's shift, average house take, etc. This information may also include information regarding a player's performance. The manual system suffers numerous drawbacks, including the delay in entry and processing of the information by the computing systems, if any, the use of disparate databases to store information, and the added opportunity to introduce errors while transferring the information from manually recorded sheets to the computing systems.

A number of systems have been proposed for automating certain aspects of tracking a player's performance. Many casinos employ player identification or "comp" cards to identify players and automated systems for monitoring how long a player remains at a gaming table. In such systems, the time is typically determined as the time between a first reading of the comp card when the player arrives at a gaming table and a second reading when the player leaves the gaming table. These systems typically rely on manual observations in order to estimate the amount played and consequently the amount of complimentary benefit to be awarded to the player. Some players have learned to take advantage of these systems to enhance the value of complimentary benefits, commonly referred to as "comps," received by increasing the positions they are taking when the pit boss is watching, and reducing the positions they are taking when the pit boss is not watching.

Further, many casinos experience a wide fluctuation in the number of customers who wish to play or otherwise enjoy the various accommodations offered by the casino. These fluctuations may be periodic, for example, daily, weekly, monthly or yearly, or may be non-periodic, for example, during special events. The building and staffing of new casino facilities is daunting. Zoning, the cost of land, the cost of construction, cost of equipment, and the costs associated with background checking, training and keeping casino staff available are substantial. Casino operators are thus typically presented with the unenviable decision of committing significant resources to building and staffing sufficiently to accommodate the maximum number of players during times of high demand, or risk losing business during times of high demand.

Like any business, casinos can greatly benefit by increasing the timeliness and accuracy of data capture, and by seamlessly integrating the data in its various database systems. Casinos can also greatly benefit if variations in demand can be accommodated without building and staffing new facilities.

BRIEF SUMMARY OF THE INVENTION

A method may be summarized as including receiving input indicative of which primary player positions at a gaming table are occupied by at least one respective primary player; and in response to the received input: configuring a user interface to present at least one user-selectable game outcome position type icon for each of the occupied primary player positions at the gaming table, the game outcome position type icon selectable to indicate a type of position a player is taking on a potential outcome of a game; and configuring the user interface to prevent entry of a game outcome position type for any unoccupied player position at the gaming table.

A selection of the at least one user-selectable game outcome position type icon may logically associate at least one of the primary player or the primary player positions with a type of game outcome position in at least one non-transitory computer-readable medium for at least one instance of a game. Each of the user-selectable game outcome position type icons for a respective primary player position may have a respective legend indicative of a type of game outcome position that is selectable by the primary player at the respective primary player position. The configuring the user interface to prevent entry of the game outcome position type for any unoccupied primary player positions at the gaming table may include omitting any game outcome position type icons for the unoccupied primary player positions from the user interface. The configuring the user interface to prevent entry of the game outcome position type for any unoccupied primary player positions at the gaming table may include presenting non-selectable game outcome position type icons for the unoccupied primary player positions. The receiving input indicative of which primary player positions at the gaming table are occupied may include detecting selection of at least one user-selectable icon of a plurality of user-selectable icons respectively representing each primary player position at the gaming table. The receiving input indicative of which primary player positions at the gaming table are occupied may include detecting by at least one sensor a physical presence or absence of at least one of a player or a game piece at the primary player positions.

The method may further include: in response to the detecting, detecting selection of one or more of the user-selectable game outcome position type icons; and changing an appearance of the respective selected user-selectable game outcome position type icons to visually indicate a selected status or condition.

The changing the appearance may include highlighting or removing highlighting of the respective selected user-selectable game outcome position type icons.

The method may further include: in response to the detecting selection of one or more of the user-selectable game outcome position type icons, transmitting game outcome position type selection information to a back end system.

The method may further comprise sending by the back end system an update to a secondary player operated wireless tablet device.

A method may be summarized as including: receiving input indicative of which primary player positions at a gaming table are occupied by at least one respective primary player; in response to the received input, configuring a user interface to allow selection by a secondary player of an occupied primary player position via a number of user-selectable icons of the user interface and prevent selection by the secondary player of unoccupied primary player positions.

The method may further include: determining if primary a player position previously selected by the secondary player is currently unoccupied; and notifying the secondary player via the user interface.

The method may further comprise determining if a primary player position previously selected by a secondary player is currently unoccupied and resetting a primary player position selection of the secondary player in response.

The configuring the user interface may include configuring the user interface by presenting respective ones of the user-selectable icons for each of the occupied primary player positions without presenting any icon for each of the unoccupied primary player positions. The configuring the user interface may include configuring the user interface by presenting respective ones of the user-selectable icons for each of the occupied primary player positions and presenting icons that are not user selectable for each of the unoccupied primary player positions. The receiving input may include receiving a number of wireless signals from a back end system. The wireless signals from the back end system may be indicative of primary player position occupancy information received from a front end device operated by casino personnel.

A non-transitory computer readable storage medium may be summarized as: having computer computer-executable instructions stored thereon that when executed by a computer processor cause the computer processor to perform: receiving input indicative of which primary player positions at a gaming table are occupied by at least one respective primary player; and in response to the received input: configuring a user interface to present at least one user-selectable game outcome position type icon for each of the occupied primary player positions at the gaming table, the game outcome position type icon selectable to indicate a type of position a player is taking on a potential outcome of a game; and configuring the user interface to prevent entry of a game outcome position type for any unoccupied player position at the gaming table.

A selection of the at least one user-selectable game outcome position type icon may cause the computer-executable instructions, when executed by the computer processor, to further cause the computer processor to logically associate at least one of the primary player or the primary player positions with a type of game outcome position for at least one instance of a game. Each of the user-selectable game outcome position type icons for a respective primary player position may have a respective legend indicative of a type of game outcome position that is selectable by the primary player at the respective primary player position.

A wireless communication device operable to facilitate gaming may be summarized as including: a processor; a processor-readable memory that stores instructions executable by the processor to cause the processor to: receive input indicative of which primary player positions at a gaming table are occupied by at least one respective primary player; and in response to the received input: configure a user interface to present at least one user-selectable game outcome position type icon for each of the occupied primary player positions at the gaming table, the game outcome position type icon selectable to indicate a type of position a player is taking on a potential outcome of a game; and configure the user interface to prevent entry of a game outcome position type for any unoccupied player position at the gaming table.

The executable instructions may further cause the processor to: determine if primary a player position previously selected by the secondary player is currently unoccupied; and notify the secondary player via the user interface. The executable instructions may further cause the processor to determine if a primary player position previously selected by a secondary player is currently unoccupied and reset a primary player position selection of the secondary player in response.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements and angles are arbitrarily enlarged and positioned to improve drawing legibility. Further, the particular shapes of the elements as drawn are not intended to convey any information regarding the actual shape of the particular elements, and have been solely selected for ease of recognition in the drawings.

DETAILED DESCRIPTION OF THE INVENTION

In the following description, certain specific details are set forth in order to provide a thorough understanding of various embodiments of the invention. However, one skilled in the art will understand that the invention may be practiced without these details. In other instances, well-known structures associated with cameras, imagers, scanners, optics, computers, computer networks, data structures, databases, and networks such as the Internet or cellular networks, have not been described in detail to avoid unnecessarily obscuring the descriptions of the embodiments of the invention.

Unless the context requires otherwise, throughout the specification and claims which follow, the word "comprise" and variations thereof, such as "comprises" and "comprising" are to be construed in an open, inclusive sense, that is as "including but not limited to."

Reference throughout this specification to "one embodiment" or "an embodiment" means that a particular feature, structure or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

The headings provided herein are for convenience only and do not interpret the scope or meaning of the claimed invention.

Environment

Figure 1:
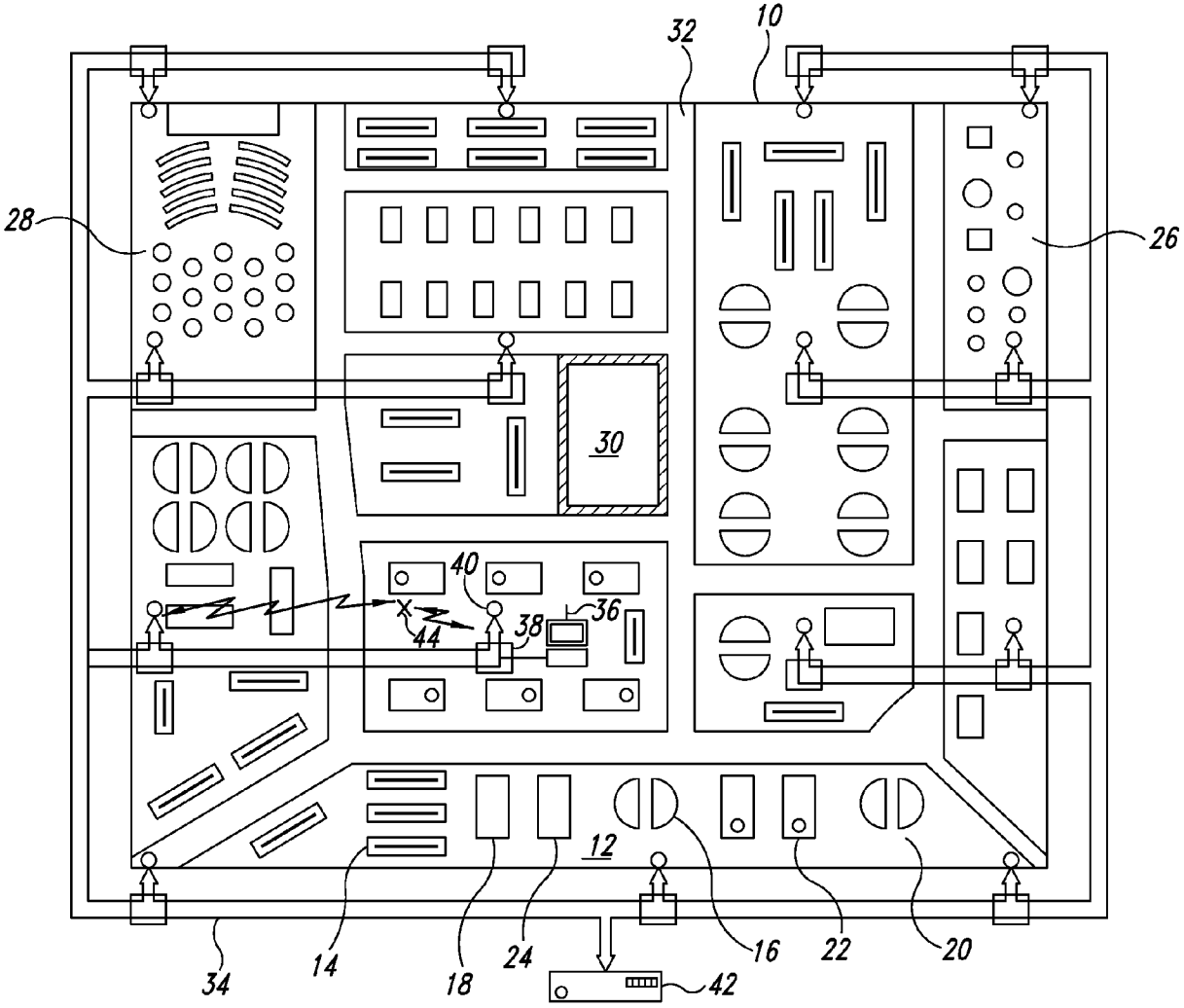
FIG. 1 is a schematic diagram of a casino communications system employing a network comprising a number of wired access points such as pit podium personal computers, a number of wireless communications devices, a number of wireless access points for providing communications with the wireless communications devices, and a server computing system, according to one illustrated embodiment.

FIG. 1 shows a gaming environment, such as a casino 10, having a number of areas for performing, participating or otherwise engaging in various activities typically associated with casinos. For example, the casino 10 may include a number of gaming areas 12 devoted to gaming activities. Gaming areas 12 may include a number of games such as banks of gaming machines 14 and/or gaming tables such as baccarat 18, blackjack 16, poker 20, roulette 22, and/or big wheel 24 tables to name a few. Only one gaming area and only one of each type of table is enumerated in FIG. 1 for the sake of clarity of illustration. The games may be clustered in groups commonly referred to as pits. Also, for example, the casino 10 may include one or more customer facility areas 26 devoted to customer facilities such as guest rooms, restaurants, coffee shops, souvenir or gift shops, gymnasiums, restrooms, and/or childcare facilities. Also for example, the casino 10 may include one or more entertainment areas 28 such as theaters or nightclubs or play areas. The casino may further include one or more backroom areas 30, such as counting rooms and/or cashiers' or tellers' cages. These areas 12, 26, 28 are typically connected by walkways 32.

The casino may employ a network 34. The network 34 may include a number of wired access points such as pit podium personal computers 36 linked to the network 34 by one or more network switches 38. Note only one pit podium personal computer 36 and only one network switch 38 is enumerated in FIG. 1 for the sake of clarity or presentation. In typical use, the pit podium personal computers 36 will provide information to casino personnel such as dealers or pit bosses, regarding a specific player's performance, previous history with the casino, and/or preferences. Additionally, the pit podium personal computers 36 may be manually operated by authorized casino personnel, for entering gaming information.

The network 34 may additionally or alternatively include a number of wireless access points 40 linked to the network 34 by one or more network switches 38. Note only one wireless access point 40 is enumerated in FIG. 1 for the sake of clarity of presentation. The wireless access points 40 include receivers and antennas, and may also include transmitters to allow wireless communications with one or more casino server computing systems 42 by one or more wireless communications devices 44 via the network 34. Note only one wireless communications device 44 is enumerated in FIG. 1 for the sake of clarity or presentation.

In one embodiment, the wireless communications devices 44 are distributed to authorized casino personnel, such as pit bosses, to allow the casino personnel to manually enter information regarding customers or players, and/or employees such as dealers, servers or wait staff. In another embodiment, the wireless communications devices 44 are distributed to customers or players, for example, to allow players to play, track their own comps and/or to order services and merchandise such as food, drinks, tickets, parking valet, cleaning, room service, etc. Playing may include taking a position directly on the outcome of a game, taking a position indirectly on the outcome of a game (i.e., backline playing) and taking positions on intermediary outcomes of games or outcomes of players at various tables and/or gaming machines. In some embodiments, the wireless communications devices 44 may be the player's own personal device appropriately configured to communicate with the applicable casino systems, or another device not owned by the casino appropriately configured to communicate with the applicable casino systems.

The wireless access points 40 may be distributed about the casino 10, including one or more floors, to provide wireless coverage of all or selected portions of the casino 10. For example, the wireless access points 40 may be distributed in a grid pattern, and attached to the ceiling or walls of the casino 10. The wireless access points 40 may be attached to various equipment or structures such as the gaming tables 16-24 and/or gaming machine banks 14. The wireless access points 40 may further be distributed in guest rooms (not shown).

While illustrated as a single network 34, the network may be composed of one or more networks, interconnected via various bridges, routers and/or other network equipment, as will be readily apparent to one of skill in the art. While FIG. 1 illustrates a number of pit podium personal computers 36 and wireless access points 40 positioned within the casino 10, in some embodiments one or more wired or wireless access points may exist outside of the casino 10, as will be readily apparent to those of ordinary skill in the art.

Figure 2:
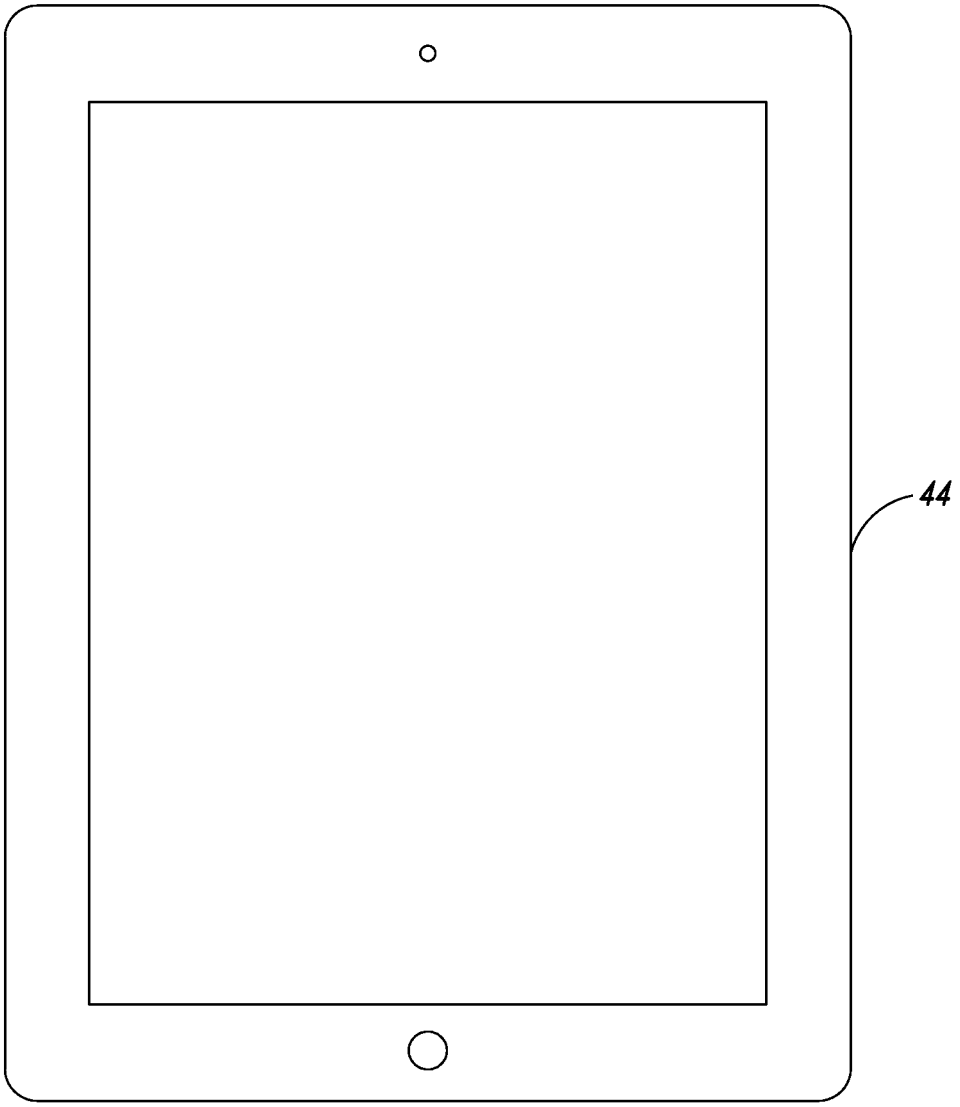
FIG. 2 is a front plan view of a wireless communications device suitable for use as part of the casino communications system of FIG. 1, according to one illustrated embodiment.
Figure 3:
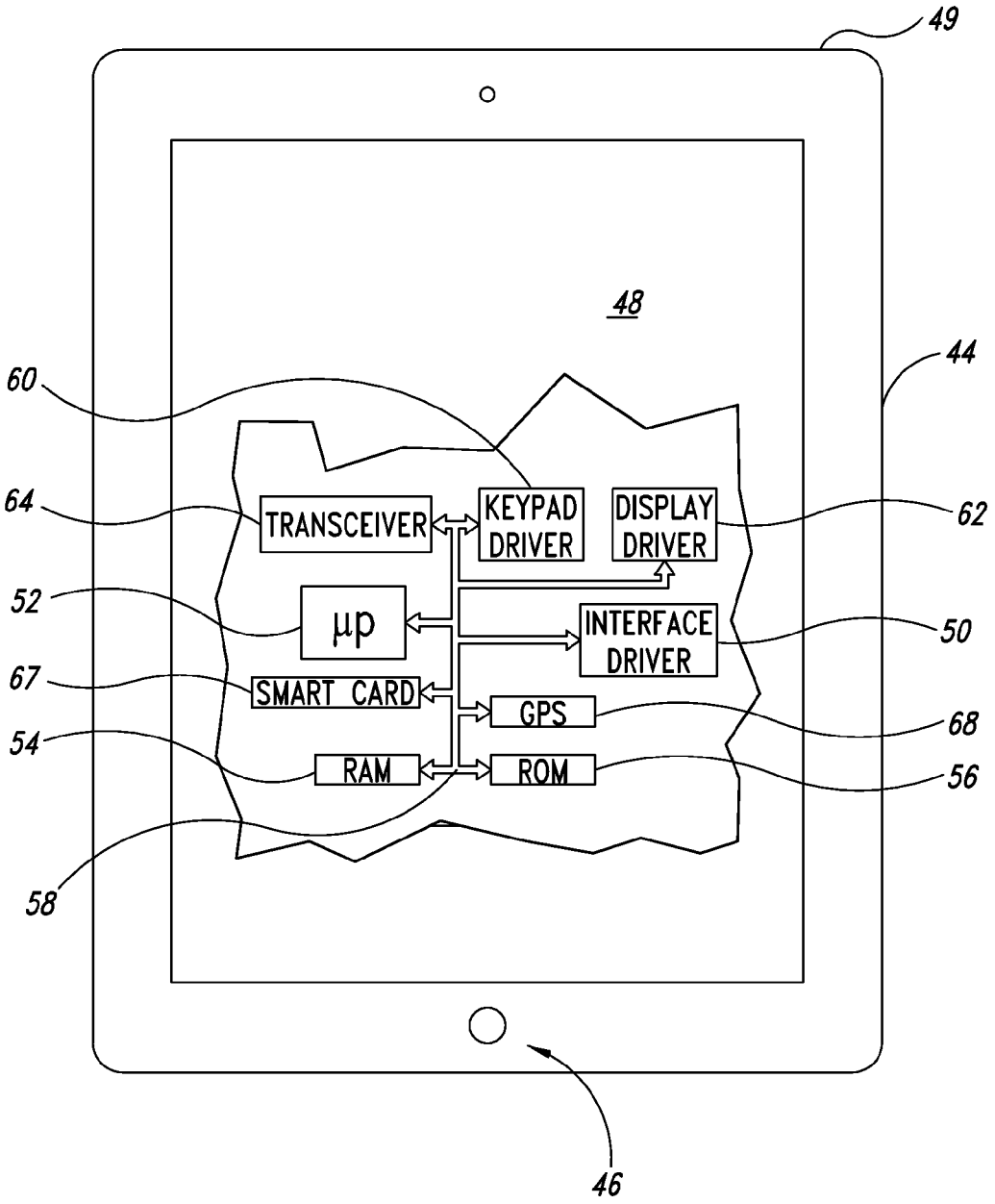
FIG. 3 is a functional block diagram of a wireless communications device suitable for use as part of the casino communications system of FIG. 1, according to one illustrated embodiment.

FIGS. 2 and 3 show a wireless communications device 44 according to one illustrated embodiment. The wireless communications devices 44 may take the form of personal digital assistants (PDAs), handheld personal computers (PCs), tablet computers, netbooks, appropriately configured cellular telephones or smart phones, or other handheld communications devices. Suitable wireless communications devices 44 may, for example, take the form of devices with wireless local area network (WLAN) capability per IEEE specification 802.11b.

The wireless communications devices 44 may include a power button 49 and a user interface such as one or more buttons 46 and/or display 48 such as a liquid crystal display (LCD) which may, or may not, be touch-sensitive to serve as a user input device. Where the display 48 is touch-sensitive, the wireless communications devices 44 may in some instances include a stylus (not shown) to enter information via the touch-sensitive display 48. The wireless communications devices 44 may also include a magnetic strip reader, bar code or symbol reader, or radio frequency identification (RFID) reader (not shown) to read identifying information from media such as player complimentary ("comp") cards, and/or credit, debit and gift cards or other cards or devices having such magnetic strips, bar codes, symbols, or RFID transmitters.

The wireless communications devices 44 may include a processor 52, and memory such as random access memory (RAM) 54, Read Only Memory (ROM) 56, flash memory and/or electronically erasable programmable read only memory (EEPROM) coupled by one or more system buses 58 to store data and instructions for execution by the processor 52. The wireless communications devices 44 may also include an interface driver 50 to couple user entries at the one or more buttons 46 or touch screen entries to the processor 52, and/or a display driver 62 to couple display data from the processor 52 to the display 48.

The wireless communications devices 44 may also include a transmitter and receiver, or transceiver 64 under the control of the processor 52, and coupled to one or more external or internal antennas (not shown) to wirelessly transmit and/or receive information. Additionally, or alternatively, the wireless communications devices 44 may include an illuminator (not shown), for example, a laser or a light emitting diode (LED) such as an infrared LED to optically transmit information. Optical transmission requires line-of-sight between the transmitter and receiver, which is typically considered to be a disadvantage, but may be considered advantageous where security is a concern or where location determination is desirable.

The wireless communications devices 44 may optionally include a smartcard 67, RFID chip, or similar module. The smartcard 67, RFID chip, or similar module may encode a unique identifier which may be associated with a user, for example, via a secure database operated by the casino. The smartcard 67, RFID chip, or similar module may be programmable by the casino to encode the unique identifier which may be associated with the user. The smartcard 67, RFID chip, or similar module may be permanently secured in the wireless communications device 44. Alternatively, the smartcard 67, RFID chip, or similar module may be selectively removable therefrom and installable in another wireless communications device, allowing the user to easily upgrade wireless communications devices 44, use their own personal communications device 44, or switch wireless communications devices 44, for example, based on the particular casino they are patronizing.

The unique identifier may advantageously be hardwired in the smartcard 67, and may not be read, copied or otherwise discernable without the destruction of the smartcard 67. For example, the unique identifier may be used to generate responses to identification queries produced by the casino system. The smartcard 67 may execute a cryptographic algorithm to generate the response using the unique identifier. In one embodiment, the cryptographic algorithm may take the form of a public/private key pair algorithm. The smart card 67 may also employ a seed or other value provided in the identification query in generating the response using the cryptographic algorithm. Consequently, the unique identifier and/or cryptographic algorithm is only known by the casino server computing system 42, and the unique identifier itself is never transmitted beyond the casino server computing system 42 or firewall associated therewith.

The identifying information may be related by the casino server computing system 42 to an equipment identifier physically associated with the wireless communication device (e.g., stored in memory 54, 56 or microprocessor 52). This may, for example, allow the casino server computing system 42 to determine whether a particular wireless communications device 44 is authorized for use, and also whether the particular user using the particular wireless communications device is the owner or authorized or registered user for the wireless communications device 44. Thus, the casino server computing system 42 may track stolen, lost or otherwise undesirable wireless communications devices 44, and deny access by such wireless communications devices 44 to the casino's automated facilities. Likewise, the casino server computing system 42 may track users who have bad debt, have been identified as cheaters or are otherwise undesirable, and deny access to the casino's automated facilities by smartcards 67 associated with such users. Further, the casino may rely on the smartcard 67 to verify the age of a user attempting to play. The user's age may be verified during a registration or authorization process. For example, casino personnel may verify age from a government issued identification document (e.g., driver's license, passport) as a prerequisite to receiving a smartcard 67 or to registering or otherwise authorizing the smartcard 67 for use in playing. Allowing a minor to use a smartcard 67 may be considered a crime similar to lending a minor a drivers license. As a further example, a photograph of the authorized or registered smartcard user may be displayed by a wireless communications device 44 used by a casino employee, for example, when suspicion exists that a minor is playing. This approach may be enhanced with the use of biometric data captured by one or more biometric sensors, which may be a part of the wireless communications device 44 or a peripheral device. Biometric data may include iris scan, finger or thumbprints, voice samples, or other biometric measures.

The wireless communications devices 44 may optionally include a global positioning system (GPS) receiver 68 to receive GPS positioning information from one or more GPS satellites. The wireless communications device 44 may provide the global positioning data to the casino server computing system(s) 42 (FIG. 1). Additionally, or alternatively, the casino server computing system(s) 42 may optionally employ other means for determining the location of the wireless communications device 44, for example, triangulation, delay between receipt of a signal by two or more wireless access points 40, determination of signal strength at two or more wireless access points 40, or other similar techniques.

Figure 4:
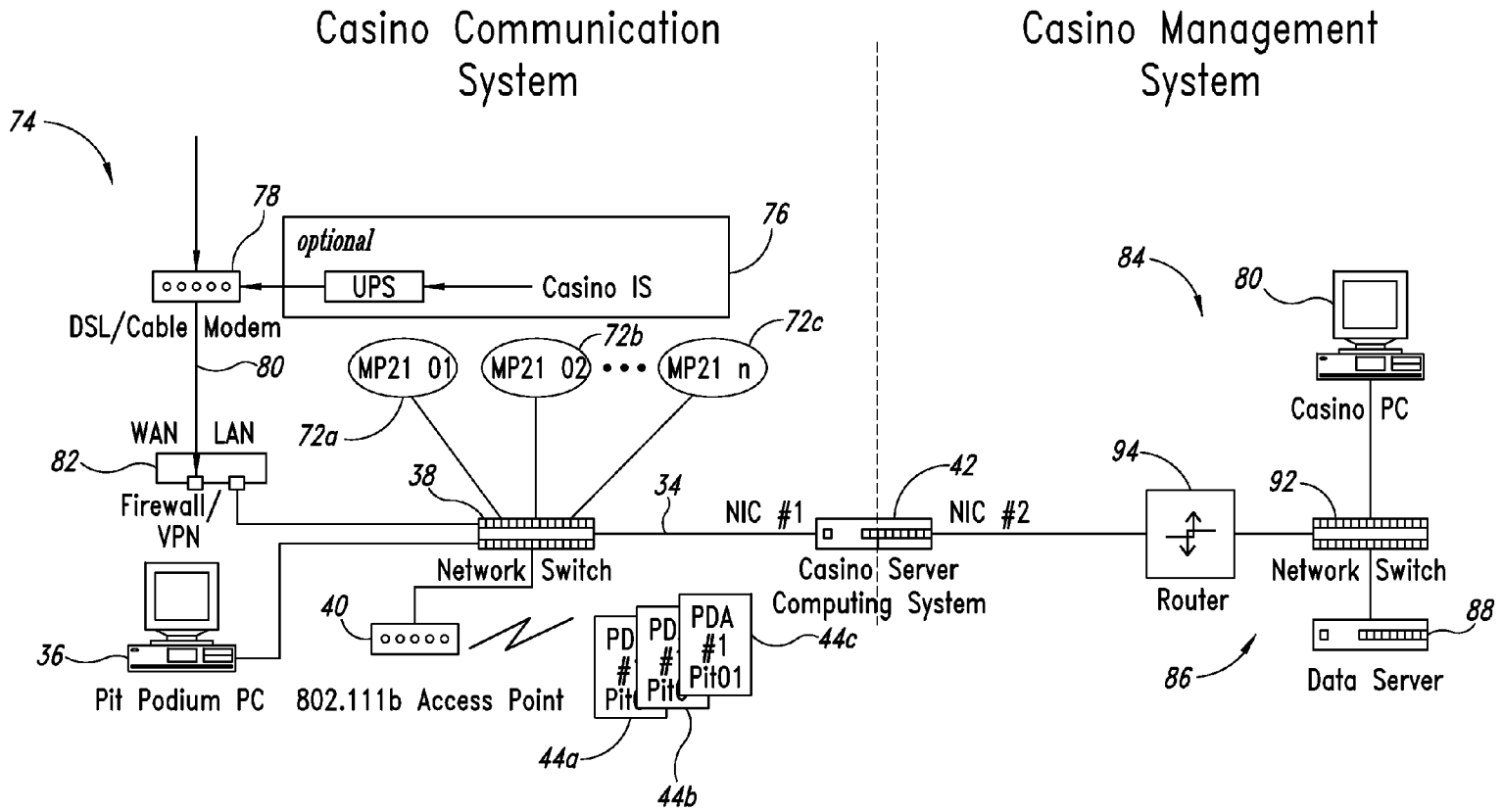
FIG. 4 is a schematic diagram of a casino communications system integrated with a casino management system according to one illustrated embodiment.

FIG. 4 shows one embodiment of a casino communications system 70, employing the network 34, pit podium personal computers 36, network switches 38, wireless access points 40, the casino server computing system(s) 42, and wireless communications devices 44*a*, 44*b*, 44*c*. Additionally, the casino communications system 70 may include a variety of gaming table or gaming machine (e.g., slots, video slots, video poker) based automatic data collection systems 72*a*, 72*b*, 72*c*, such as the table game data collection system discussed in commonly assigned U.S. Pat. No. 6,460,848. These automatic data collection systems, collectively referenced as 72, may communicate over the network 34 with the casino server computing system(s) 42 via one or more of the network switches 38.

The casino communications system 70 may additionally or alternatively include an interface 74 to casino information services 76. For example, the interface 74 may include a digital subscriber line (DSL) or cable modem 78, a LAN or WAN connection 80 to a firewall or virtual private network (VPN) 82 between the modem 78 and a network switch 38.

The casino server computing system(s) 42 may serve as a proxy for the casino's legacy networked computing system(s) 84. The legacy networked computing system(s) 84 may, for example, comprise a local area network (LAN) 86 including a casino management system (CMS) 88, one or more casino personal computers 90, one or more network switches 92, and a router 94. The legacy networked computing system(s) 84 may, for example, include one or more of the following: existing player comp systems, security systems, reservation systems, room service systems, telephone billing systems, POS terminals and/or systems, accounting systems, employee tracking and monitoring systems.

Figure 5:
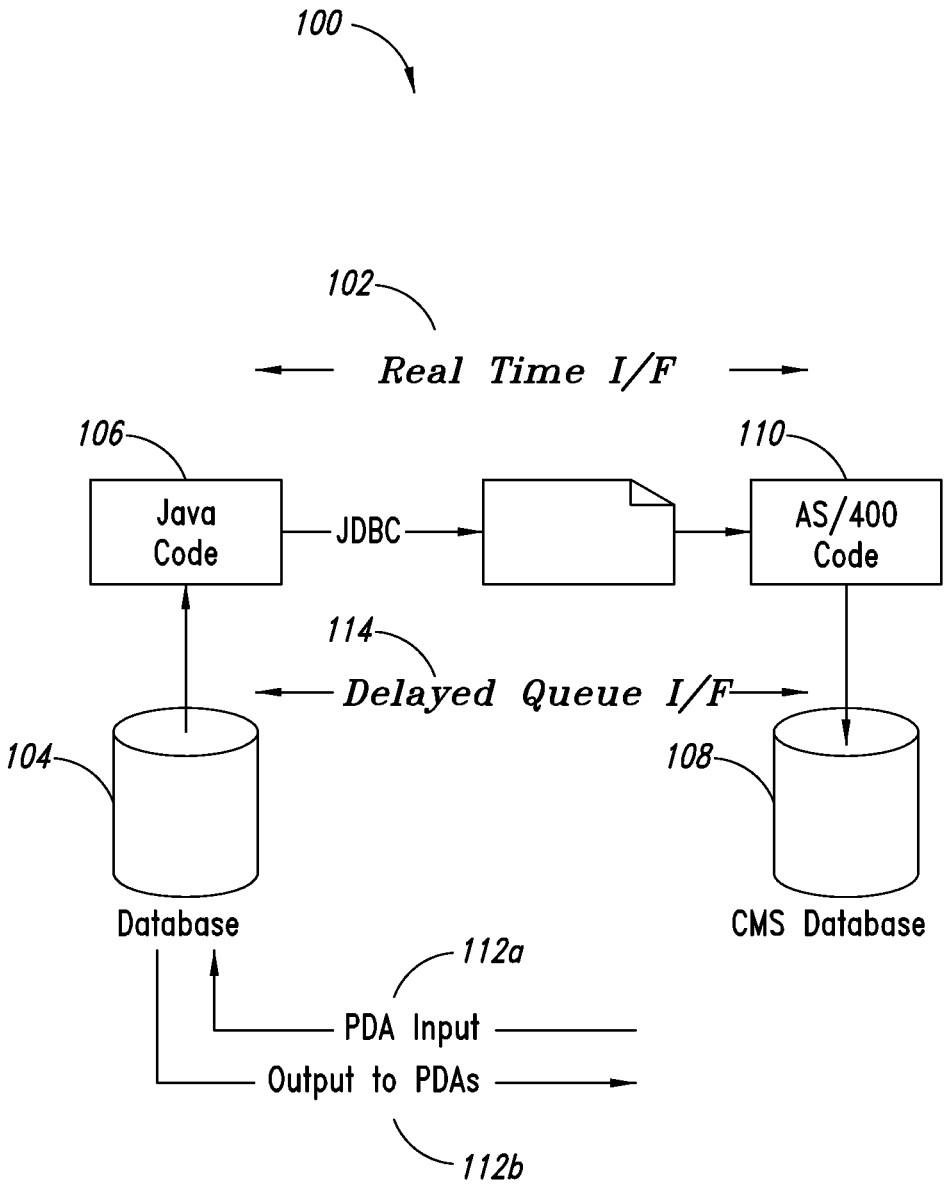
FIG. 5 is a schematic diagram of a data exchange model for the casino communications system according to one illustrated embodiment.

FIG. 5 shows a data exchange model 100 illustrating bi-directional communications between the casino communications system 70 and the CMS 88 for facilitating the integration of information between pit podium personal computers 36, wireless communications devices 44, automatic data collection systems 72, and the legacy CMS 88. In particular, a real-time interface 102 provides time sensitive bi-directional communications between a database 104 via Java system 106 and a CMS database 108 via legacy system 110 (e.g., AS/400). For example, the real-time interface 102 may transfer player rating and/or player comp information. The database may communicate with one or more of the wireless communications devices 44 via suitable communications channels 112*a*, 112*b*. Additionally, a delayed queue interface 114 provides less time sensitive bi-directional communications between the casino communications system 70 and the CMS 88.

Monitoring/Tracking of Players

Figure 6:
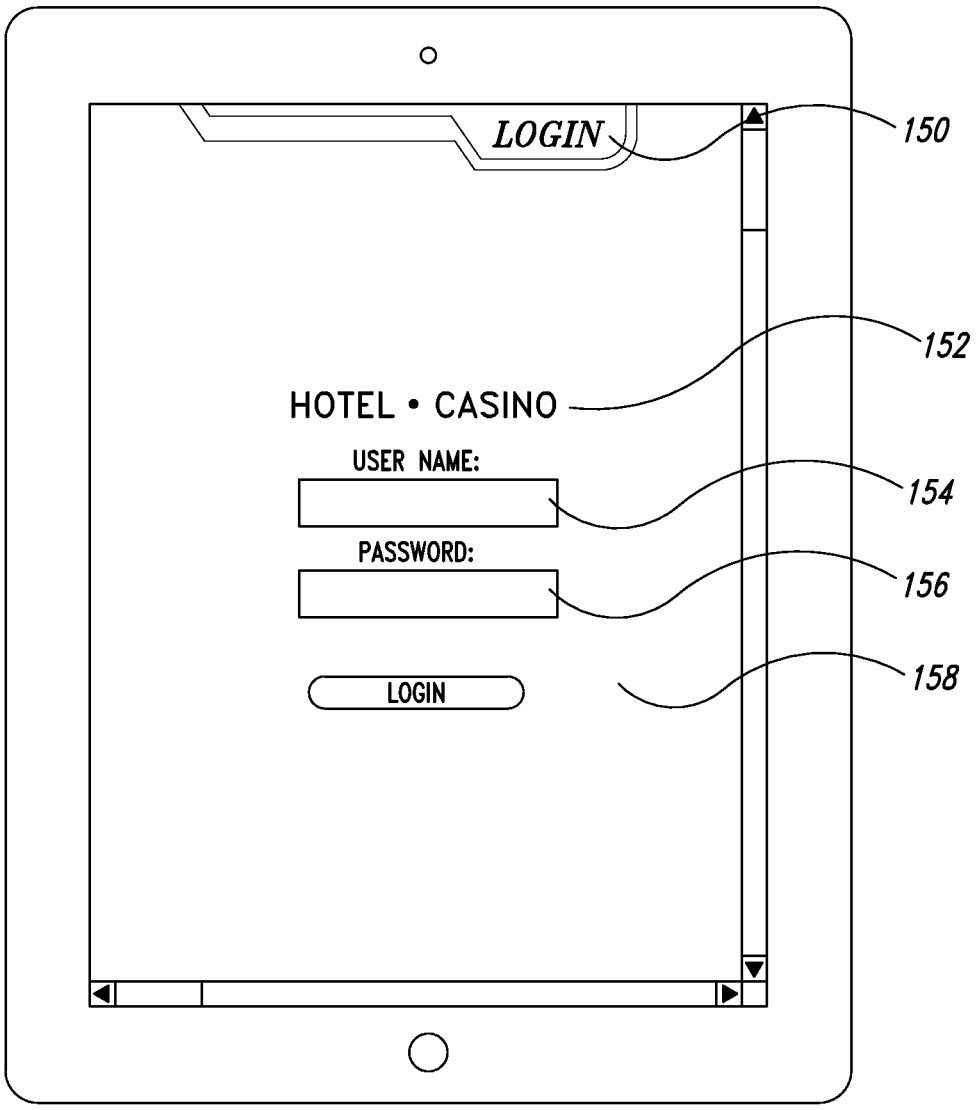
FIG. 6 is a front plan view of the wireless communications device of FIG. 1, showing a login screen of a graphical user interface, according to one illustrated embodiment.

FIG. 6 shows a login screen 150 of a graphical user interface as displayed by a wireless communications device 44, according to one illustrated embodiment.

The login screen 150 may include the name and/or advertisement 152 for the particular casino. The login screen 150 includes a user name field 154 for entry of a user name and a password field 156 for entry of a user password. Access is denied unless an authorized user name and corresponding password are entered into the appropriate fields 154, 156. A user-selectable login icon 158 allows the user to submit the user name and password for authentication/verification. The user may be an employee of the casino or a player. However, the various graphical user interfaces and tracking functionalities provided to casino employees and players will be different. The various graphical user interfaces and tracking functionalities available to users and players are selectable by the casino. The various graphical user interfaces and tracking functionalities, for example, may be based on permissions attributed to or otherwise given to particular player or employee accounts by the casino.

Figure 7B:
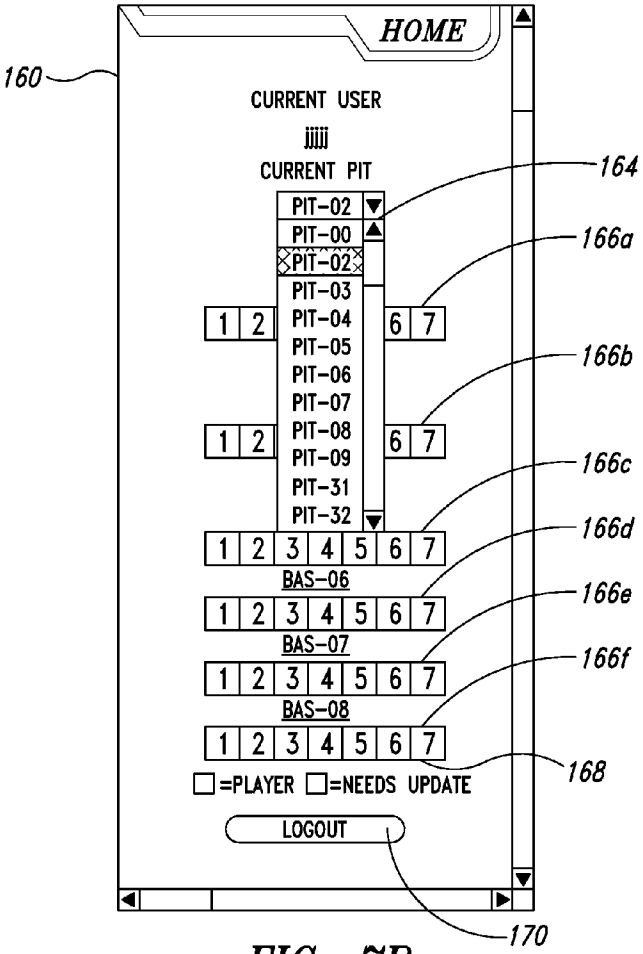
FIG. 7B is a front plan view of the tracking screen of FIG. 7A.
Figure 7A:
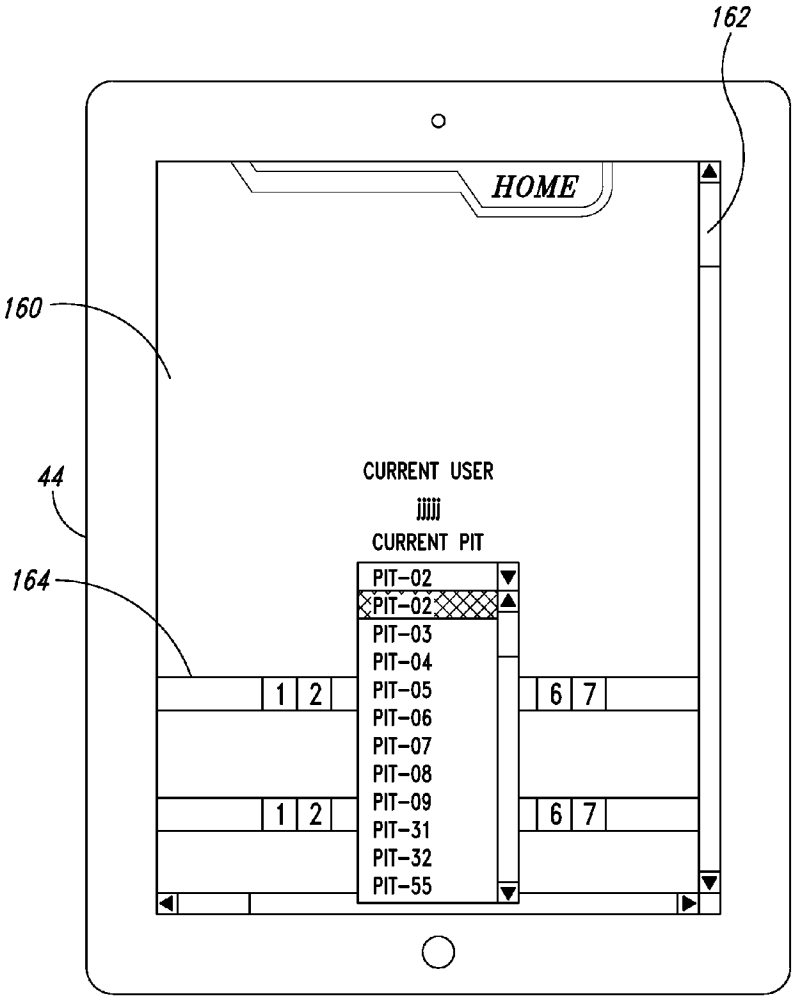
FIG. 7A is a front plan view of the wireless communications device of FIG. 1, showing a portion of a tracking screen of a graphical user interface, according to one illustrated embodiment.

FIGS. 7A and 7B show a tracking screen 160 of a graphical user interface as displayed by a wireless communications device 44, according to one illustrated embodiment. The tracking screen 160 shows the tables and/or active players that are being tracked. The tracking screen 160 of the graphical user interface is an example that may be used by an employee or a player to track and select particular tables, games, player positions, or other particular players of interest. For example, a dealer may track and find a particular table to procure at which they will be dealing. Also, a player may track and select other particular non-anonymous players who have elected to make their location at a player position known to all other players or particular other players selected by the non-anonymous player. In this way, the player may select one or more particular non-anonymous primary players on whom they would like to take secondary or indirect (i.e., backline) positions. Using the tracking screen 160 of the graphical user interface, a player may also select particular games at particular tables or positions on the table on which they would like to remotely take a position on the direct outcome of the game.

The tracking screen 160 includes a user-selectable scrollable bar 162 for viewing additional portions of the tracking screen 160. The tracking screen 160 also includes a user-selectable and scrollable menu 164 for identifying and selecting among a number of pits to display. The tracking screen 160 displays each gaming table and/or gaming machine in the selected pit as a separate row 166*a*-166*f*. Each player position at the gaming table or gaming machine is also identified by a suitable selectable icon 168 (only one called out in the figures for sake of clarity of illustration). The selectable icon 168 may indicate whether the corresponding position is vacant or occupied by a player such as by displaying a certain color, by bolding, or highlighting the icon. Also or instead, once the user selects the icon, such information may be presented indicating whether the position is occupied or vacant and also may indicate information identifying a non-anonymous player occupying the position. In the illustrated example, the tracking screen 160 shows a selected pit identified as PIT-02, which includes six (6) baccarat tables, each with seven (7) player positions. The tracking screen 160 may further include a user-selectable icon 170 for logging off.

Figure 8:
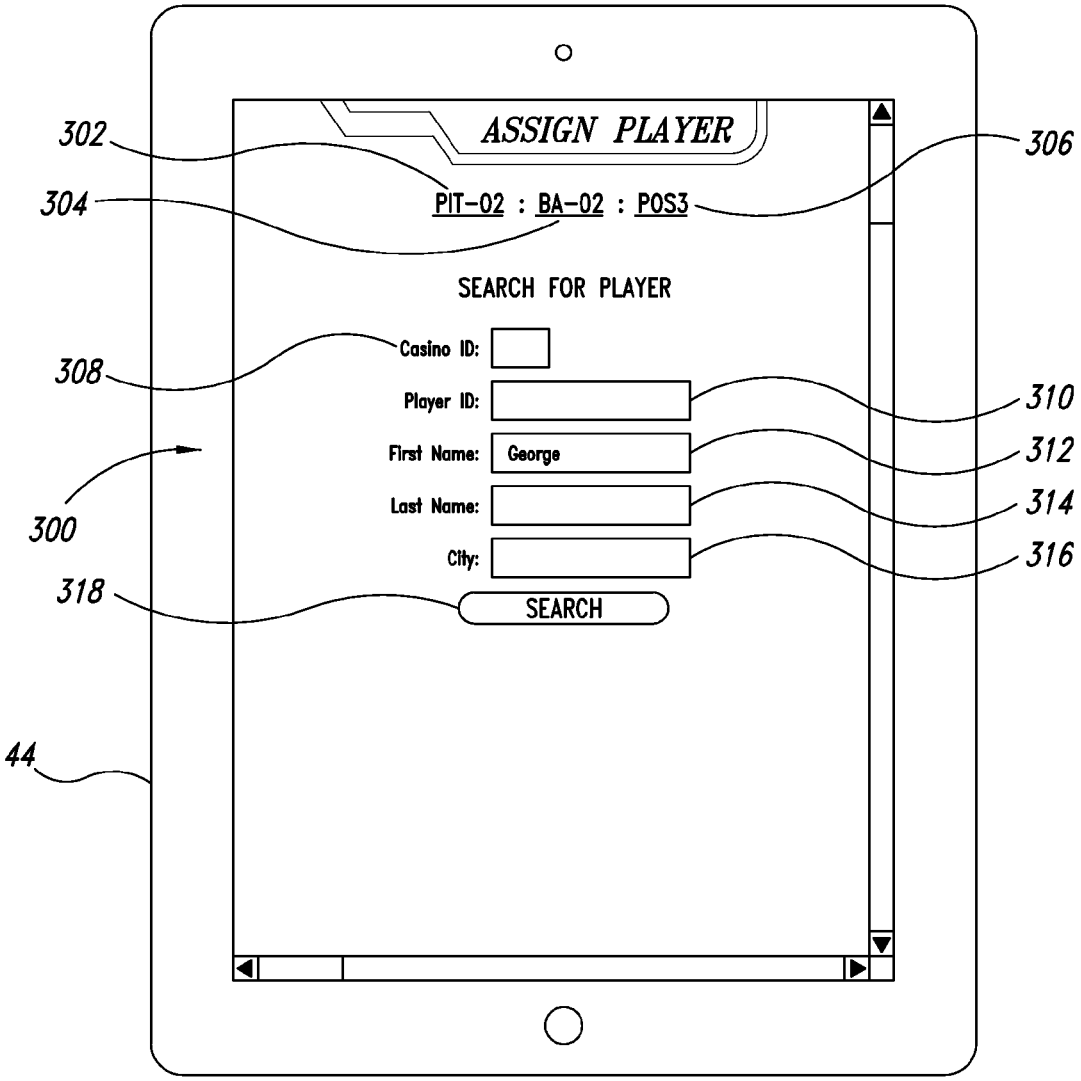
FIG. 8 is a front plan view of the wireless communications device of FIG. 1, showing a portion of an assign new player screen of a graphical user interface, according to one illustrated embodiment.

FIG. 8 shows an assign new player screen 300 of a graphical user interface as displayed by a wireless communications device 44, according to one illustrated embodiment. The assign new player screen 300 allows a user such as a casino employee to enter a new player into the casino communications system 70 using the wireless communications device 44 and may allow a user such as a player to search for one or more other particular non-anonymous players on which they would like to take indirect (i.e., backline) positions.

The assign new player screen 300 includes a pit identification field 302, a table identification field 304, and a player position field 306 in which a user may enter a pit identifier, table identifier, and player position, respectively, of a selected pit, table, and/or player position. The assign new player screen 300 may include a casino identifier field 308, where the user may enter a casino identifier. The assign new player screen 300 may also include a player identifier field 310 where the user may enter a player identifier, player first and second name fields 312, 314 where the user may enter player first and second name, respectively, and a city field 316 where the user may enter a city associated with the player such as a city of primary residence. Where known, this information helps to uniquely identify a player. The assign new player screen 300 may include a user-selectable search icon 316, which the user may use to lookup or otherwise search for a particular player based on the information entered into one or more of the fields of the assign new player screen 300.

Figure 9:
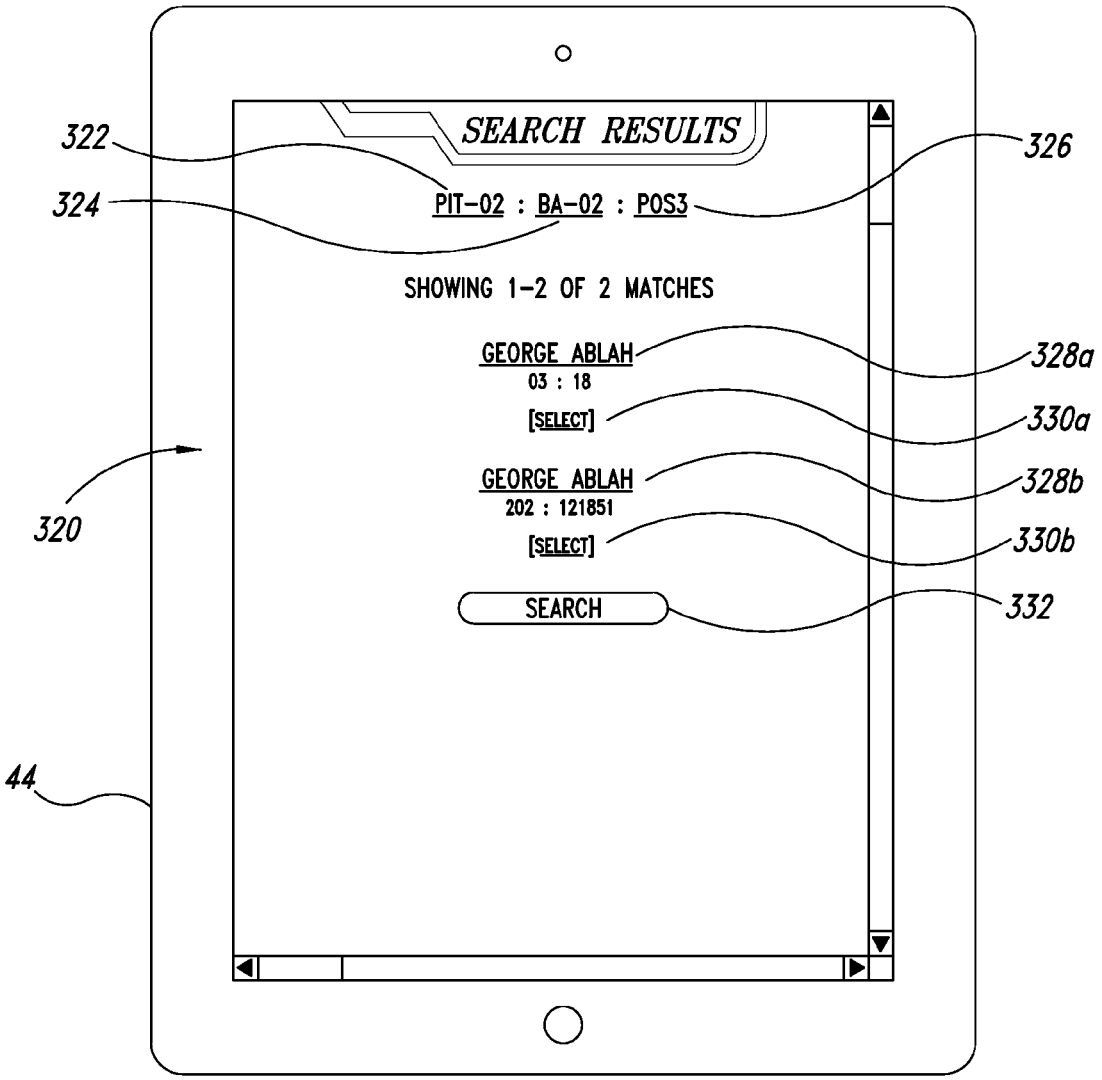
FIG. 9 is a front plan view of the wireless communications device of FIG. 1, showing a portion of a search results screen of a graphical user interface, according to one illustrated embodiment.

FIG. 9 shows a search results screen 320 of a graphical user interface as displayed by a wireless communications device 44, according to one illustrated embodiment. The search results screen 300 provides a user with results in response to selection of the search icon 316 of the assign new player screen 300.

The search results screen 320 includes a pit identification field 322, a table identification field 324 and a player position field 326 which display pit identifier, table identifier, and player position, respectively, of a selected pit, table, and player. The player position field may show different types of identification data depending on whether the user is a casino employee or another player. In the illustrated embodiment, the player position field 326 displays the player position number of the player. The search results screen 320 lists names 328*a*, 328*b* of each player that matches the criteria identified or entered in the fields of the assign new player screen 300 when the search icon 316 was selected, with associated user-selectable icons 330*a*, 330*b* for selecting the associated name. If multiple names match the search criteria, the pit identification field 322, table identification field 324 and player position field 326 display the pit identifier, table identifier, and player position of the first player on the list presented and will display information corresponding to other players in the list presented upon selection of the other players' names. In some instances, the same player may occupy multiple player positions at the same table. In some embodiments, the player names 328*a*, 328*b* may show only the players' first names (or other identification data or label) when the user is another player and may depend on how much information the non-anonymous player has chosen to be available to other players. The search results screen 320 may include a user-selectable search icon 332, selectable to perform further searching.

Once a player shown on the search results screen 320 is identified and selected by a user such as a dealer or other casino employee, if not already occupying a current player position at another table as shown in the pit identification field 322, table identification field 324 and player position field 326, the player may be entered into the casino communications system by the user as occupying (i.e., assigned to) a particular new player position, such that the player may be tracked by the casino and, in some instances, by other players. This tracking enables the other players to take indirect (i.e., backline) positions on the particular player or player position which the player will be occupying.

Also, once identified and selected by another player, if the identified player is currently occupying a player position as shown in the pit identification field 322, table identification field 324 and player position field 326, the other player may choose to take indirect (i.e., backline) positions on the particular player or player position(s) which the player is occupying at a table.

Figure 10:
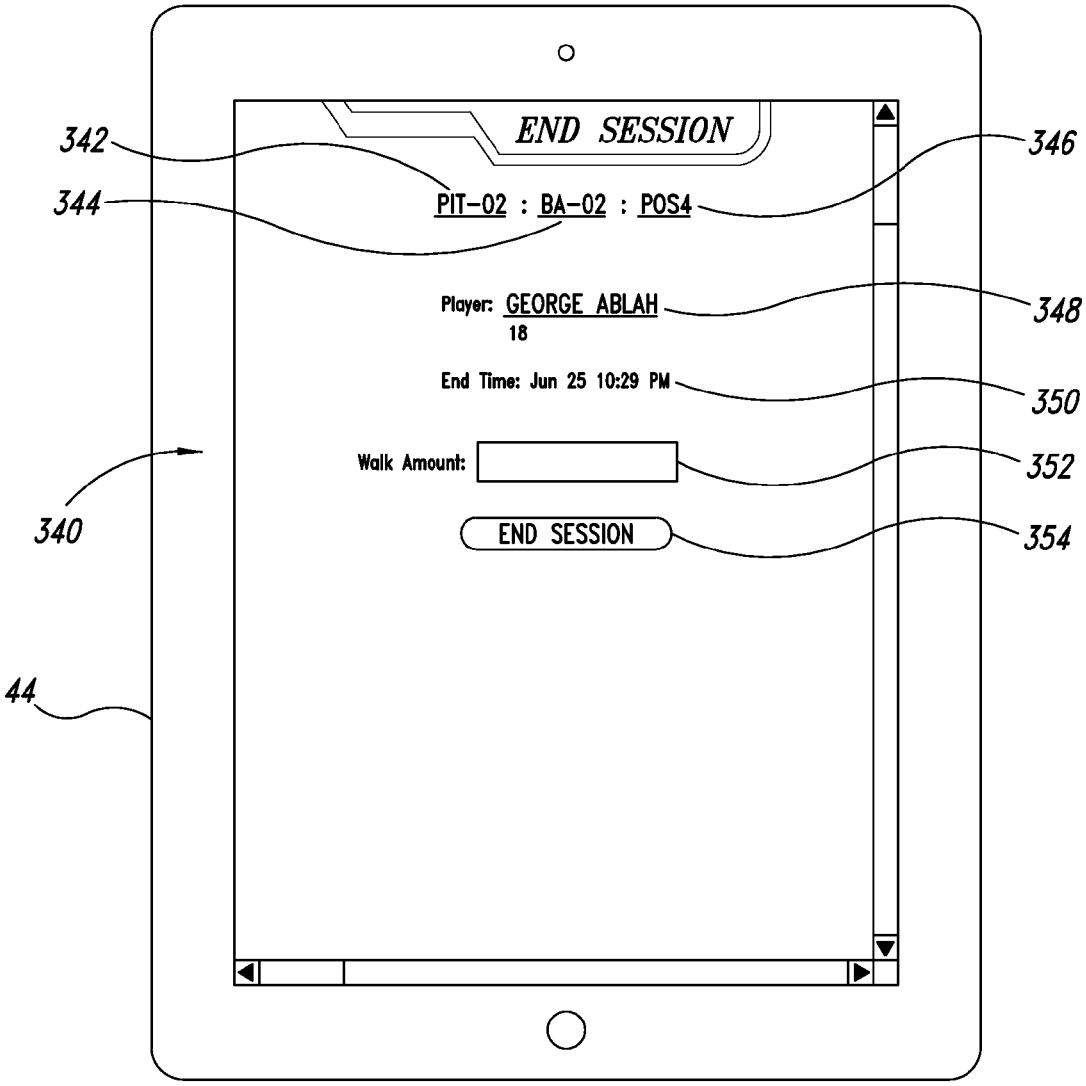
FIG. 10 is a front plan view of the wireless communications device of FIG. 1, showing a portion of an end session screen of a graphical user interface, according to one illustrated embodiment.

FIG. 10 shows an end session screen 340 of a graphical user interface as displayed by a wireless communications device 44, according to one illustrated embodiment. The end session screen 340 allows a user such as a casino employee to indicate when a player has stopped playing such that they may be tracked by the casino and, in some instances, by other players. The indication that the player has stopped playing also allows the casino to automatically prevent further indirect (i.e., backline) playing by other players on the player position previously occupied by the player and to automatically configure the graphical user interface of the casino employee's device (e.g., dealer's graphical user interface) and, in some embodiments, the graphical user interface of other players' devices to indicate the position is vacant.

The end session screen 340 includes a pit identification field 342, a table identification field 344 and a player position field 346 which display pit identifier, table identifier and player identifier, respectively, of a selected pit, table and player. The end session screen 340 also includes a player field 348 that identifies the player. The end session screen 340 further includes an end date and time field 350 that identifies the ending date and time and a walk amount field 352 where the user such as the casino employee may enter an actual or estimated amount of money (cash, chips and/or vouchers) with which the player is walking away from the gaming table or piece of gaming equipment. A user-selectable end session icon 354 allows the user to provide the information to the remainder of the casino communications system 70.

Figure 11:
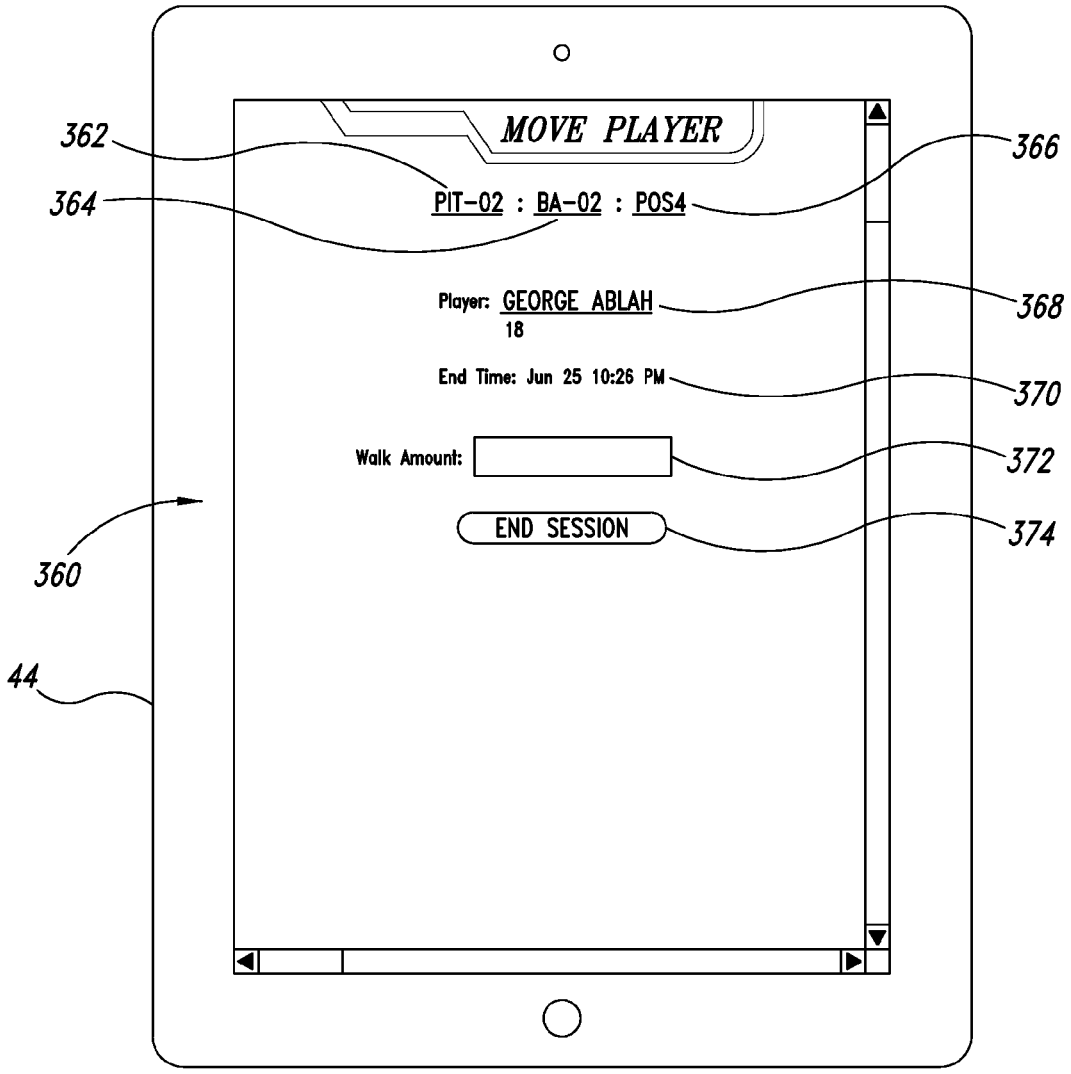
FIG. 11 is a front plan view of the wireless communications device of FIG. 1, showing a portion of a move player screen of a graphical user interface, according to one illustrated embodiment.

FIG. 11 shows a move player screen 360 of a graphical user interface as displayed by a wireless communications device 44, according to one illustrated embodiment. The move player screen 360 allows a user, such as a casino employee, to indicate when and to which new gaming table or gaming machine a player has moved, such that they may be tracked by the casino and, in some instances, by other players. The indication when and to which new gaming table or gaming machine a player has moved enables other players to find and take secondary (i.e., backline) positions on the particular player and thus provides the functionality for other players to follow a non-anonymous player and continue to take indirect (i.e., backline) positions on the particular non-anonymous player as they move player positions at a particular table, move tables, or switch games.

The move player screen 360 includes a pit identification field 362, a table identification field 364 and a player position field 366 where the user may enter the pit identifier, table identifier and player position to which the player has moved. The move player screen 360 also includes a player field 368 that identifies the player. The move player screen 360 further includes an end date and time field 370 that identifies the ending date and time and a walk amount field 372 where the user, such as the casino employee, may enter an actual or estimated amount of money (cash, chips and/or vouchers) with which the player is walking away from the gaming table or piece of gaming equipment before moving to another table or game. A user-selectable end session icon 374 allows the user to provide the information into the remainder of the casino communications system 70.

Game Play

Players may choose to locally play by physically occupying a player position or physically indicating a position the player is taking on an outcome of the game while at a gaming table or at a piece of gaming equipment such as a slot machine, video slot machine or video poker machine. Alternatively, a player may choose to remotely play without physically occupying a player position or physically indicating a position the player is taking on an outcome of the game while at a gaming table or at a piece of gaming equipment, using a wireless communications device 44. Playing via a wireless communications device 44 may be particularly advantageous during times of high demand when the casino is busy or crowded, or when it is otherwise difficult to find an available player position at a gaming table or piece of gaming equipment. Alternatively, playing via a wireless communications device 44 may advantageously allow players to play in a more discreet fashion, and/or in a player preferred setting, for example, a hotel room, lounge, restaurant, or theater.

When remotely playing via the wireless communications device 44, the player may be physically present at or proximate the gaming table or piece of gaming equipment, and may even be able to observe the play on the gaming table or piece of gaming equipment. However, the player will not occupy a player position at the gaming table (e.g., seat circle) or piece of gaming equipment. Alternatively, the remotely playing player may be physically distant from the gaming table or piece of gaming equipment, and unable to directly observe the play on the gaming table or piece of gaming equipment. As described in detail below, in such a situation the wireless communications device 44 may provide the player with a display and audio of the play at the gaming table, either as a video and audio feed of the actual play or as a simulation thereof. This allows the player to enjoy the experience of the sights and sounds of the game without the inconvenience of being physically present at the gaming table or piece of gaming equipment.

As used herein and in the claims, the terms "remotely taking a position," "remote game play," "remotely playing" or similar terms mean that the player is not physically occupying a player position and has not physically taken a position on the outcome of the game at the gaming table or gaming machine, even if the player is proximate the gaming table or gaming machine.

The player may choose to remotely play directly, taking positions directly on the outcome of the game using the wireless communications device 44. Alternatively, or additionally, the player may choose to remotely play indirectly using the wireless communications device 44. For example, the player may take a "backline" position on an outcome of play of another player who may occupy a position at the gaming table or piece of gaming equipment. In such situations, the player directly playing the game may be denominated as the primary player and the player indirectly playing may be denominated as the secondary player. Such a situation may accommodate further orders of players, for example, tertiary players.

Some games do not require or employ intermediary decisions after taking a position on the outcome of the game (e.g., no decision on whether to take additional playing cards, increasing, decreasing, adding amounts associated with the positions taken on the outcome of the game). Such games may, for example, include baccarat, roulette, wheel of fortune, craps, bingo, and/or keno. Other games typically include intermediary decisions by a player after placing taking on initial position on the game outcome (e.g., whether to take additional playing cards, increasing, decreasing, adding amounts associated with the positions taken on the outcome of the game). Such games may, for example, include blackjack, poker, and/or LET IT RIDE®.

Pieces of gaming equipment are typically configured to be played by individual players. Thus, the pieces of gaming equipment are typically "on demand" systems in that they are responsive to a single player, and the player may enter or exit play at any time, for example, by placing a currency or a gaming chip in the gaming machine. In contrast, gaming tables are typically set up to handle multiple players at a time and typically have seven or more player positions. Thus, anywhere from one to seven or more players may be playing a given gaming table. Players typically may enter or exit play at a gaming table only at completion of a game or round of a game.

In order to prevent players from obtaining an advantage over the casino and/or each other, it is important to exercise control over the timing of the taking of positions on the outcome of the game and/or removal of positions taken on the outcome of the game. The dealer or other personnel typically perform this function, limiting the placement or removal of positions taken on the outcome of the game to acceptable times or events. For example, in roulette a croupier may pass their hand over the table and announce no more bets while the wheel is spinning. Also for example, a stickman in craps may hold the dice until all positions on the outcome of the game have been taken by the players, or a dealer in baccarat will wait until the players have taken positions on the outcome of the game before dealing the playing cards.

Controlling the timing of position placement in remote game play is a significant problem. The casino communications system should ensure that positions on the outcome of the game are only taken by players at specified times or instances during the gaming. For example, the casino communications system may only allow positions on the outcome of the game to be taken by players via the wireless communications devices 44 before playing cards are dealt, or before a roulette wheel or wheel of fortune is spun. For some games, the casino communications system may allow positions on the outcome of the game to be taken by players during the game, either at specific periods or in response to the occurrence of defined events.

At set out herein, the particular approach used to control the timing of playing will depend on a variety of factors, such as: 1) whether the remote game play is in the gaming table environment or the gaming machine environment; 2) whether the game is intended for play by an individual player (e.g., on demand) or by multiple players; 3) whether the remote game play is direct or indirect (i.e., backline); and/or 4) whether the game includes intermediary decisions (e.g., hitting, additional positions to be taken by players on the outcome of the game, and/or removal of positions taken by players on the outcome of the game during play) or not.

Figure 12:
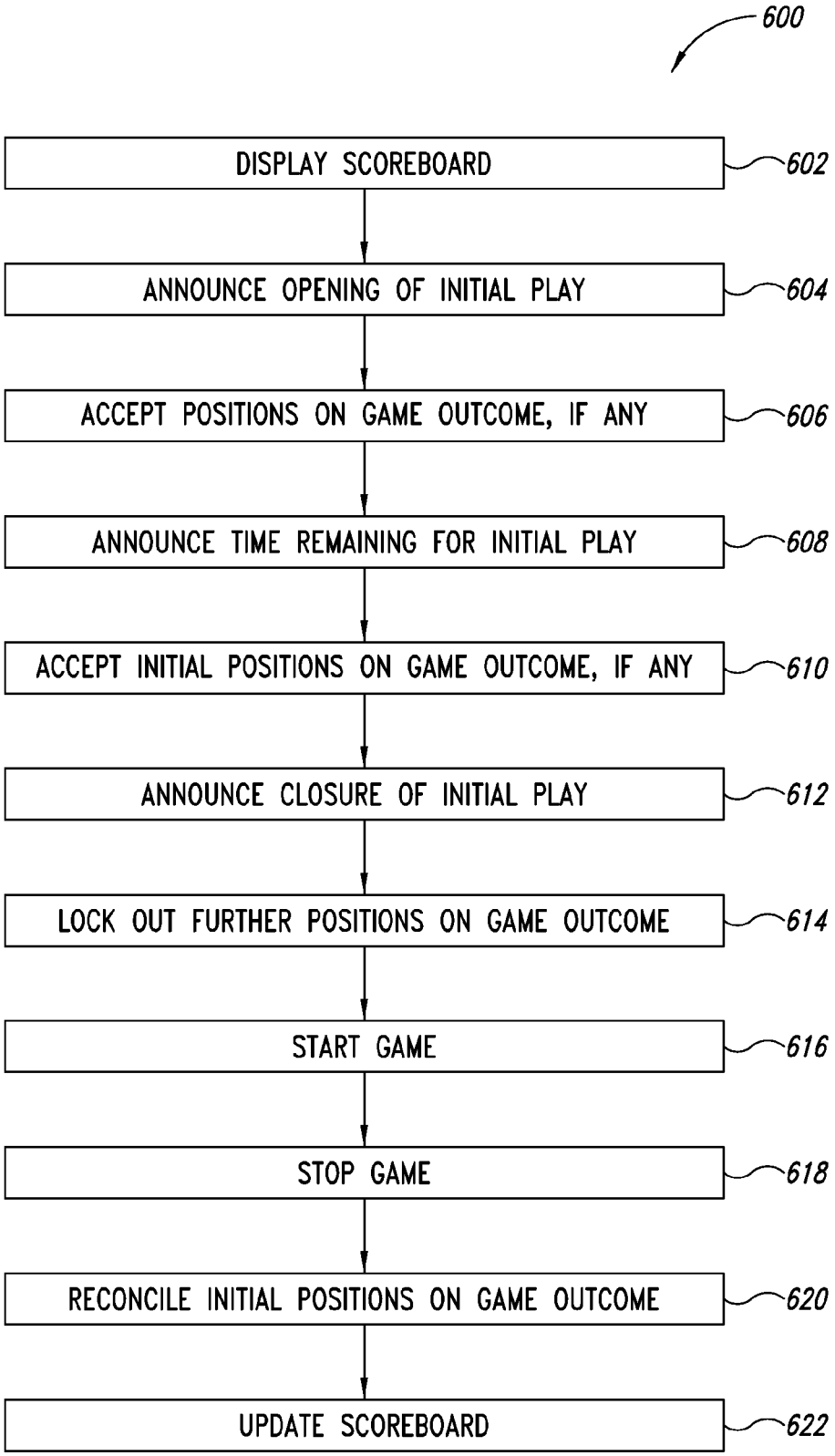
FIG. 12 is a flow diagram of a method useful for controlling remote game play directly on a game occurring at a gaming table, without intermediary decisions or actions by the player (s), according to one illustrated embodiment.

FIG. 12 shows a method 600, that is useful for controlling remote game play directly on a game occurring at a gaming table, without intermediary decisions or actions by the player (s).

Optionally at 602, the wireless communications device 44 and/or some other device provides a scoreboard displaying results of previous games, sessions, or rounds, for example, providing a visual and/or audio prompt to a player or potential player displaying results of previous games, sessions, or rounds. The scoreboard displaying results of previous games, sessions, or rounds are gaming table specific and would typically be provided to the wireless communications device 44 from or by the casino server computing system(s) 42 via the casino communications system 70.

At 604, the wireless communications device 44 and/or some other device announces the opening of initial playing, for example, providing a visual and/or audio prompt to a player or potential player. The announcement may be provided in response to a signal provided to the wireless communications device 44 from or by the casino server computing system(s) 42 via the casino communications system 70, which is generated when the particular gaming table is ready to accept initial positions on the outcome of the game, typically between the end of one game or round and the start of a next game or round.

At 606, initial positions on the outcome of the game, if any, are accepted. As discussed in more detail below, in one embodiment the positions on game outcome are accepted at the wireless communications device, while in another embodiment the positions on game outcome are accepted at the casino server computing system(s) 42 that is part of the casino communications system 70.

At 608, the wireless communications device 44 and/or some other device announces the time remaining for initial playing, for example, providing a visual and/or audio prompt to a player or potential player. The announcement may be provided in response to a signal provided to the wireless communications device 44 from or by the casino server computing system(s) 42 via the casino communications system 70, which is generated by or in response to events on or a timer associated with the particular gaming table, or may be provided in response to a timer or other clock signal generated by the wireless communications device. The announcement may be repeated from time to time, updating the amount of time remaining. Alternatively or additionally, a countdown of the remaining time may be visually and/or aurally provided for all or some portion of the period during which initial positions on game outcome are accepted.

At 610, initial positions on game outcome, if any, are accepted. As discussed in more detail below, in one embodiment the positions on game outcome are accepted at the wireless communications device, while in another embodiment the positions on game outcome are accepted at the casino server computing system(s) 42 that is part of the casino communications system 70.

At 612, the wireless communications device 44 and/or some other device announces the closure of initial playing, for example, providing a visual and/or audio prompt to a player or potential player, and locks out taking further positions on game outcome at 614. The announcement and/or lockout may be provided in response to a signal provided to the wireless communications device 44 from or by the casino server computing system(s) 42 via the casino communications system 70, which is generated by or in response to events on or a timer associated with the particular gaming table, or may be provided in response to a timer or other clock signal generated by the wireless communications device.

At 616, the game starts. For example, the game may start with the dealing of cards, rolling of dice, spinning of a wheel, or drawing of a number. At 618, the game stops. For example, the game may stop when hands of playing cards are resolved against each other or against a standard, when a dice comes to a stop, a wheel stops spinning or a set of numbers have been drawn. In some embodiments, the dealer may indicate one or more particular winners, or indicate a particular hand as a winning hand by selecting or activating an icon on the wireless device 44 or other interface indicating the winning hand, which would indicate the game has stopped. At 620, the initial positions on game outcome are reconciled based on the outcome of the game event(s) and the positions taken on game outcome. In some embodiments reconciliation may take place on the wireless communications device 44, advantageously reducing the computational burden on the casino server computing system(s) 42. In some embodiments reconciliation may take place on the casino server computing system(s) 42, advantageously providing enhanced security.

Figure 13A:
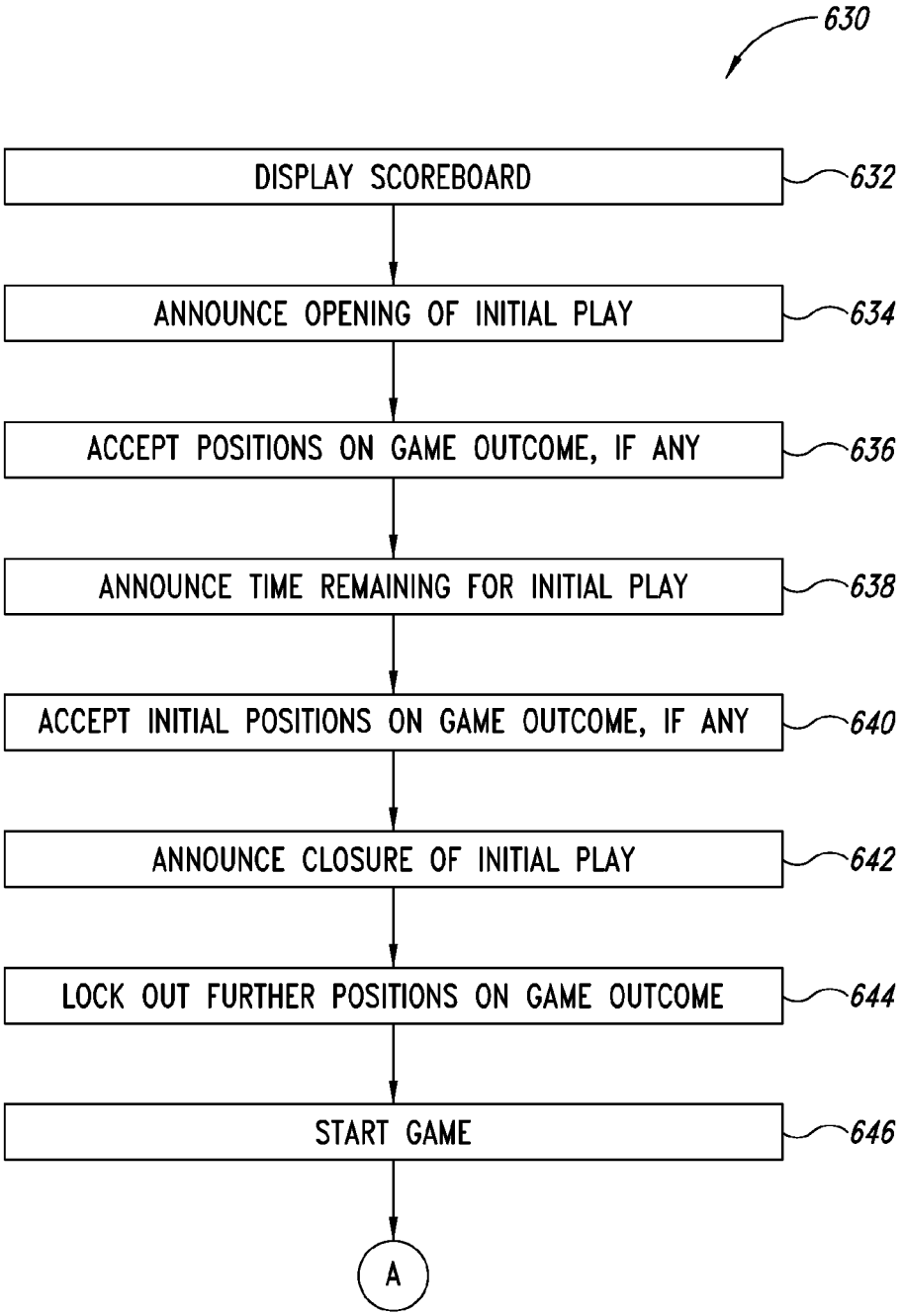
FIGS. 13A-13B are a flow diagram of a method useful for controlling remote game play directly on a game occurring at a gaming table, with intermediary decisions or actions by the player(s), according to one illustrated embodiment.
Figure 13B:
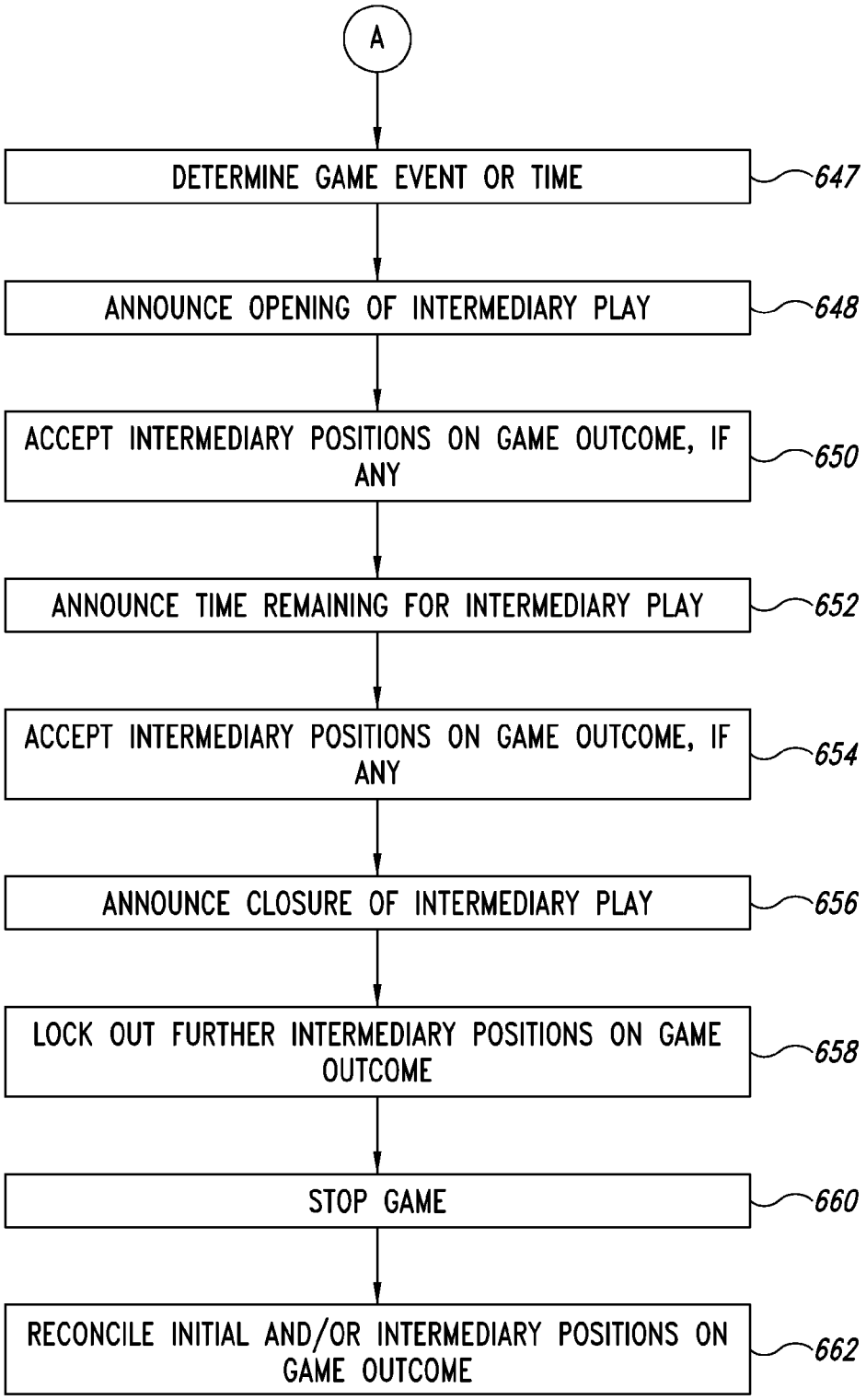

FIGS. 13A-13B show a method 630 that is useful for controlling remote game play directly on a game occurring a gaming table, with intermediary decisions or actions by the player(s).

Optionally at 632, the wireless communications device 44 and/or some other device provides a scoreboard displaying results of previous games, sessions, or rounds, for example, providing a visual and/or audio prompt to a player or potential player displaying results of previous games, sessions, or rounds. The scoreboard displaying results of previous games, sessions, or rounds are gaming table specific and would typically be provided to the wireless communications device 44 from or by the casino server computing system(s) 42 via the casino communications system 70.

At 634, the wireless communications device 44 and/or some other device announces the opening of initial playing, for example, providing a visual and/or audio prompt to a player or potential player. The announcement may be provided in response to a signal provided to the wireless communications device 44 from or by the casino server computing system(s) 42 via the casino communications system 70, which is generated when the particular gaming table is ready to accept initial positions on game outcome, typically between the end of one game or round and the start of a next game or round.

At 636, initial positions on game outcome, if any, are accepted. As discussed in more detail below, in one embodiment the positions on game outcome are accepted at the wireless communications device, while in another embodiment the positions on game outcome are accepted at the casino server computing system(s) 42 that is part of the casino communications system 70.

At 638, the wireless communications device 44 and/or some other device announces the time remaining for initial playing, for example, providing a visual and/or audio prompt to a player or potential player. The announcement may be provided in response to a signal provided to the wireless communications device 44 from or by the casino server computing system(s) 42 via the casino communications system 70, which is generated by or in response to events on or a timer associated with the particular gaming table, or may be provided in response to a timer or other clock signal generated by the wireless communications device. The announcement may be repeated from time to time, updating the amount of time remaining. Alternatively or additionally, a countdown of the remaining time may be visually and/or aurally provided for all or some portion of the period during which initial positions on game outcome are accepted.

At 640, initial positions on game outcome, if any, are accepted. As discussed in more detail below, in one embodiment the positions on game outcome are accepted at the wireless communications device, while in another embodiment the positions on game outcome are accepted at the casino server computing system(s) 42 that is part of the casino communications system 70.

At 642, the wireless communications device 44 and/or some other device announces the closure of initial playing, for example, providing a visual and/or audio prompt to a player or potential player, and at 644 taking further positions on game outcome are locked out. The announcement and/or lockout may be provided in response to a signal provided to the wireless communications device 44 from or by the casino server computing system(s) 42 via the casino communications system 70, which is generated by or in response to events on or a timer associated with the particular gaming table, or may be provided in response to a timer or other clock signal generated by the wireless communications device.

At 646, the game starts. For example, the game may start with the dealing of cards, rolling of dice, spinning of a wheel, or drawing of a number.

At 647, the occurrence of a game event or a time is determined. For example, a game event may be the dealing of a first playing card, last playing card or other playing card, the spin of a wheel, a spinning wheel coming to a stop, roll of dice, an action by a player, dealer, other participant, or other casino personnel. The determination may be performed using sensors at the gaming table, or based on information from such sensors. Also, for example, time may be a period based on a time of day, week or year or on a period after or before the occurrence of an action or event occurring at the gaming table or elsewhere.

At 648, the wireless communications device 44 and/or some other device announces the opening of intermediary playing, for example, providing a visual and/or audio prompt to a player or potential player. The announcement may be provided in response to a signal provided to the wireless communications device 44 from or by the casino server computing system(s) 42 via the casino communications system 70, which is generated when the particular gaming table is ready to accept intermediary positions on game outcome, typically between the end of one game or round and the start of a next game or round.

At 650, intermediary positions on game outcome, if any, are accepted. As discussed in more detail below, in one embodiment the positions on game outcome are accepted at the wireless communications device, while in another embodiment the positions on game outcome are accepted at the casino server computing system(s) 42 that is part of the casino communications system 70.

At 652, the wireless communications device 44 and/or some other device announces the time remaining for intermediary playing, for example, providing a visual and/or audio prompt to a player or potential player. The announcement may be provided in response to a signal provided to the wireless communications device 44 from or by the casino server computing system(s) 42 via the casino communications system 70, which is generated by or in response to events on or a timer associated with the particular gaming table, or may be provided in response to a timer or other clock signal generated by the wireless communications device. The announcement may be repeated from time to time, updating the amount of time remaining. Alternatively or additionally, a countdown of the remaining time may be visually and/or aurally provided for all or some portion of the period during which intermediary positions on game outcome are accepted.

At 654, intermediary positions on game outcome, if any, are accepted. As discussed in more detail below, in one embodiment the positions on game outcome are accepted at the wireless communications device, while in another embodiment the positions on game outcome are accepted at the casino server computing system(s) 42 that is part of the casino communications system 70.

At 656, the wireless communications device 44 and/or some other device announces the closure of intermediary playing, for example, providing a visual and/or audio prompt to a player or potential player, and locks out taking further positions on game outcome at 658. The announcement and/or lockout may be provided in response to a signal provided to the wireless communications device 44 from or by the casino server computing system(s) 42 via the casino communications system 70, which is generated by or in response to events on or a timer associated with the particular gaming table, or may be provided in response to a timer or other clock signal generated by the wireless communications device.

At 660, the game stops. For example, the game may stop when hands of playing cards are resolved against each other or against a standard, when a dice comes to a stop, a wheel stops spinning or a set of numbers have been drawn. In some embodiments, the dealer may indicate one or more particular winners, or indicate a particular hand as a winning hand by selecting or activating an icon on the wireless device 44 or other interface indicating the winning hand, which would indicate the game has stopped. At 662, the initial positions on game outcome are reconciled based on the outcome of the game event(s) and the positions on game outcome taken. In some embodiments reconciliation may take place on the wireless communications device 44, advantageously reducing the computational burden on the casino server computing system(s) 42. In some embodiments reconciliation may take place on the casino server computing system(s) 42, advantageously providing enhanced security.

Figure 14:
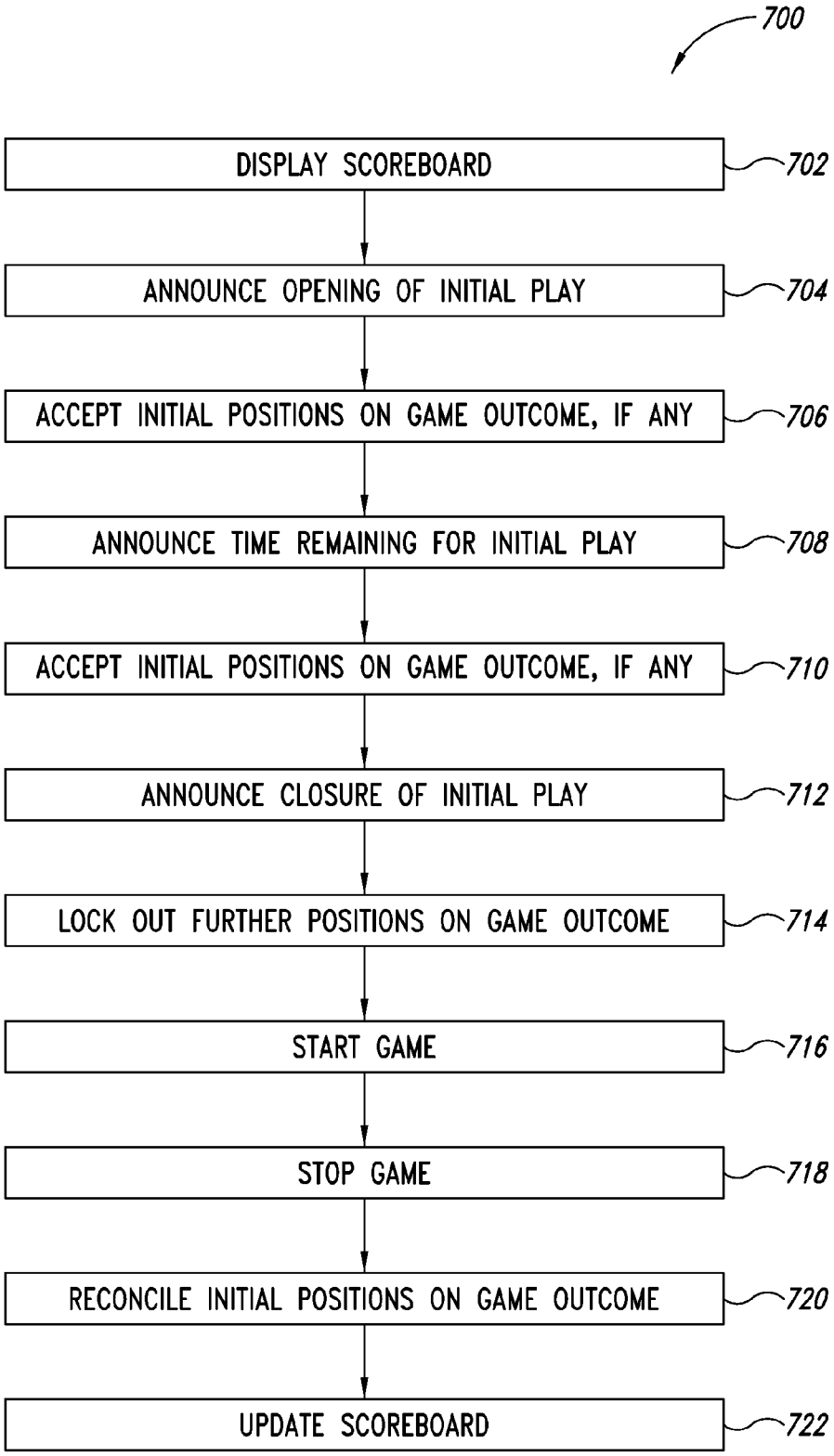
FIG. 14 is a flow diagram of a method useful for controlling remote game play indirectly on a game occurring at a table game or on a gaming machine by a secondary player, without intermediary actions or decisions by the secondary player, according to one illustrated embodiment.

FIG. 14 shows a method 700 that is useful for controlling remote game play indirectly on a game occurring at a table game or on a gaming machine by a secondary player, without intermediary actions or decisions by the secondary players.

Optionally at 702, the wireless communications device 44 and/or some other device provides a scoreboard displaying results of previous games, sessions, or rounds, for example, providing a visual and/or audio prompt to a player or potential player displaying results of previous games, sessions, or rounds. The scoreboard displaying results of previous games, sessions, or rounds are gaming table specific and would typically be provided to the wireless communications device 44 from or by the casino server computing system(s) 42 via the casino communications system 70.

At 704, the wireless communications device 44 and/or some other device announces the opening of initial playing, for example, providing a visual and/or audio prompt to a secondary player or potential secondary player. The announcement may be provided in response to a signal provided to the wireless communications device 44 from or by the casino server computing system(s) 42 via the casino communications system 70, which is generated when the particular gaming table is ready to accept initial positions on game outcome taken by the secondary player(s), typically between the end of one game or round and the start of a next game or round.

At 706, initial positions on game outcome, if any, are accepted. As discussed in more detail below, in one embodiment the positions on game outcome are accepted at the wireless communications device, while in another embodiment the positions on game outcome are accepted at the casino server computing system(s) 42 that is part of the casino communications system 70.

At 708, the wireless communications device 44 and/or some other device announces the time remaining for initial playing, for example, providing a visual and/or audio prompt to a secondary player or potential secondary player. The announcement may be provided in response to a signal provided to the wireless communications device 44 from or by the casino server computing system(s) 42 via the casino communications system 70, which is generated by or in response to events on or a timer associated with the particular gaming table, or may be provided in response to a timer or other clock signal generated by the wireless communications device. The announcement may be repeated from time to time, updating the amount of time remaining. Alternatively or additionally, a countdown of the remaining time may be visually and/or aurally provided for all or some portion of the period during which initial positions on game outcome are accepted.

At 710, initial positions on game outcome from the secondary player(s), if any, are accepted. As discussed in more detail below, in one embodiment the positions on game outcome are accepted at the wireless communications device, while in another embodiment the positions on game outcome are accepted at the casino server computing system(s) 42 that is part of the casino communications system 70.

At 712, the wireless communications device 44 and/or some other device announces the closure of initial playing, for example, providing a visual and/or audio prompt to a secondary player or potential secondary player, and locks out taking further positions on game outcome at 714. The announcement and/or lockout may be provided in response to a signal provided to the wireless communications device 44 from or by the casino server computing system(s) 42 via the casino communications system 70, which is generated by or in response to events on or a timer associated with the particular gaming table, or may be provided in response to a timer or other clock signal generated by the wireless communications device.

At 716, the game starts. For example, the game may start with the dealing of cards, rolling of dice, spinning of a wheel, or drawing of a number. At 718, the game stops. For example, the game may stop when hands of playing cards are resolved against each other or against a standard, when a dice comes to a stop, a wheel stops spinning or a set of numbers have been drawn. At 720, the initial primary and secondary positions on game outcome are reconciled based at least in part on the outcome of the game event(s), the primary and secondary positions on game outcome taken, and the primary odds (i.e., game odds) and secondary odds (i.e., odds for a particular primary player). In some embodiments reconciliation may take place on the wireless communications device 44, advantageously reducing the computational burden on the casino server computing system(s) 42. In some embodiments reconciliation may take place on the casino server computing system(s) 42, advantageously providing enhanced security.

At 722, the casino server computer updates the scoreboard displaying results of previous games, sessions, or rounds, based at least in part on the outcome of the game.

Figure 15A:
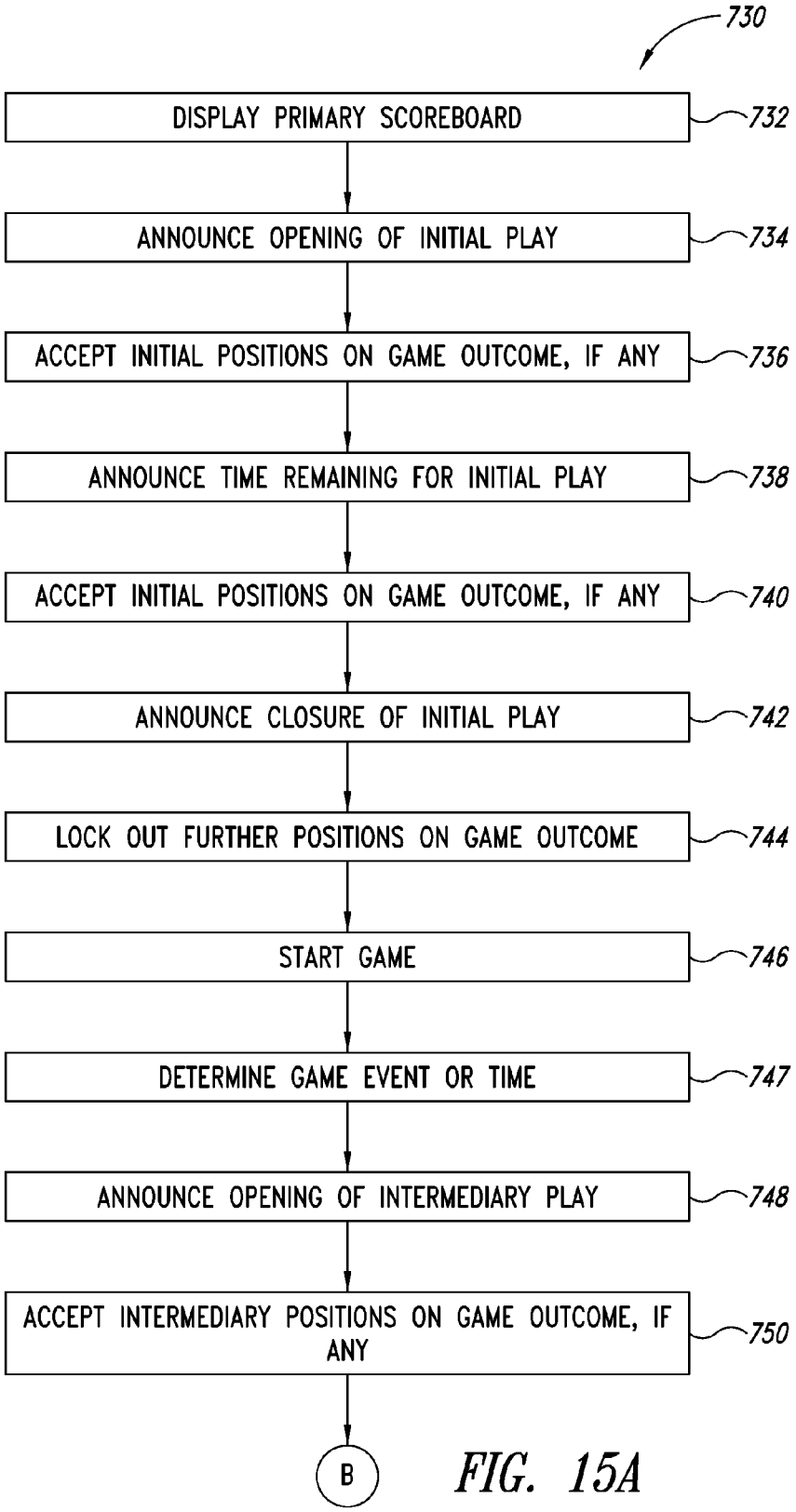
FIGS. 15A-15B are a flow diagram of a method useful for controlling remote game play indirectly on a game occurring at a table game or on a gaming machine with intermediary actions of decisions by the primary player(s), according to one illustrated embodiment.
Figure 15B:
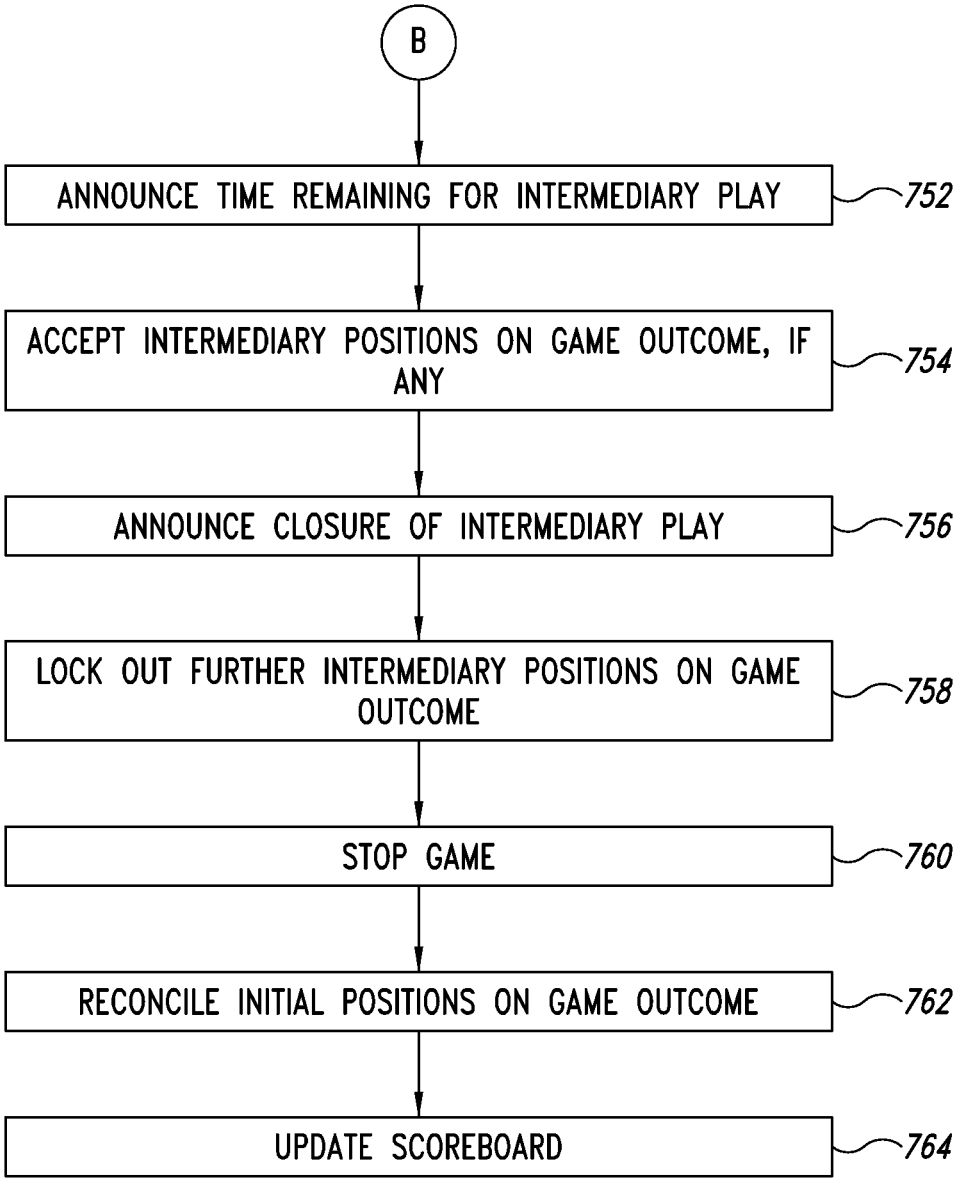

FIGS. 15A-15B show a method 730 that is useful for controlling remote game play indirectly on a game occurring at a table game or on a gaming machine with intermediary actions of decisions by the primary player(s).

Optionally at 732, the wireless communications device 44 and/or some other device provides a scoreboard displaying results of previous games, sessions, or rounds, for example, providing a visual and/or audio prompt to a player or potential player displaying results of previous games, sessions, or rounds. The scoreboard displaying results of previous games, sessions, or rounds are gaming table specific and would typically be provided to the wireless communications device 44 from or by the casino server computing system(s) 42 via the casino communications system 70. Also, the wireless communications device 44 and/or some other device may provide the primary player odds, for example, providing a visual and/or audio prompt to a secondary player or potential secondary player. The primary player odds will typically vary over time, thus the primary player odds may be provided to the wireless communications device 44 from or by the casino server computing system(s) 42 via the casino communications system 70.

At 734, the wireless communications device 44 and/or some other device announces the opening of initial playing, for example, providing a visual and/or audio prompt to a secondary player or potential secondary player. The announcement may be provided in response to a signal provided to the wireless communications device 44 from or by the casino server computing system(s) 42 via the casino communications system 70, which is generated when the particular gaming table is ready to accept initial positions on game outcome, typically between the end of one game or round and the start of a next game or round.

At 736, initial positions on game outcome, if any, are accepted. As discussed in more detail below, in one embodiment the positions on game outcome are accepted at the wireless communications device, while in another embodiment the positions on game outcome are accepted at the casino server computing system(s) 42 that is part of the casino communications system 70.

At 738, the wireless communications device 44 and/or some other device announces the time remaining for initial playing, for example, providing a visual and/or audio prompt to a secondary player or potential secondary player. The announcement may be provided in response to a signal provided to the wireless communications device 44 from or by the casino server computing system(s) 42 via the casino communications system 70, which is generated by or in response to events on or a timer associated with the particular gaming table, or may be provided in response to a timer or other clock signal generated by the wireless communications device. The announcement may be repeated from time to time, updating the amount of time remaining. Alternatively or additionally, a countdown of the remaining time may be visually and/or aurally provided for all or some portion of the period during which initial secondary positions on game outcome are accepted.

At 740, initial positions on game outcome, if any, are accepted. As discussed in more detail below, in one embodiment the positions on game outcome are accepted at the wireless communications device, while in another embodiment the positions on game outcome are accepted at the casino server computing system(s) 42 that is part of the casino communications system 70.

At 742, the wireless communications device 44 and/or some other device announces the closure of initial playing, for example, providing a visual and/or audio prompt to a secondary player or potential secondary player, and at 744 taking further positions on game outcome is locked out. The announcement and/or lockout may be provided in response to a signal provided to the wireless communications device 44 from or by the casino server computing system(s) 42 via the casino communications system 70, which is generated by or in response to events on or a timer associated with the particular gaming table, or may be provided in response to a timer or other clock signal generated by the wireless communications device.

At 746, the game starts. For example, the game may start with the dealing of cards, rolling of dice, spinning of a wheel, or drawing of a number.

At 747, the occurrence of a game event or a time is determined. For example, a game event may be the dealing of a first playing card, last playing card or other playing card, the spin of a wheel, a spinning wheel coming to a stop, a roll of dice, an action by a player, dealer, other participant, or other casino personnel. The determination may be performed using sensors at the gaming table, or based on information from such sensors. Also, for example, time may be a period based on a time of day, week or year or on a period after or before the occurrence of an action or event occurring at the gaming table or elsewhere.

At 748, the wireless communications device 44 and/or some other device announces the opening of intermediary playing, for example, providing a visual and/or audio prompt to a secondary player or potential secondary player. The announcement may be provided in response to a signal provided to the wireless communications device 44 from or by the casino server computing system(s) 42 via the casino communications system 70, which is generated when the particular gaming table is ready to accept intermediary positions on game outcome, typically between the end of one game or round and the start of a next game or round.

At 750, intermediary positions on game outcome, if any, are accepted. As discussed in more detail below, in one embodiment the positions on game outcome are accepted at the wireless communications device, while in another embodiment the positions on game outcome are accepted at the casino server computing system(s) 42 that is part of the casino communications system 70.

At 752, the wireless communications device 44 and/or some other device announces the time remaining for intermediary playing, for example, providing a visual and/or audio prompt to a secondary player or potential secondary player. The announcement may be provided in response to a signal provided to the wireless communications device 44 from or by the casino server computing system(s) 42 via the casino communications system 70, which is generated by or in response to events on or a timer associated with the particular gaming table, or may be provided in response to a timer or other clock signal generated by the wireless communications device. The announcement may be repeated from time to time, updating the amount of time remaining. Alternatively or additionally, a countdown of the remaining time may be visually and/or aurally provided for all or some portion of the period during which intermediary positions on game outcome are accepted.

At 754, intermediary positions on game outcome, if any, are accepted. As discussed in more detail below, in one embodiment the positions on game outcome are accepted at the wireless communications device, while in another embodiment the positions on game outcome are accepted at the casino server computing system(s) 42 that is part of the casino communications system 70.

At 756, the wireless communications device 44 and/or some other device announces the closure of intermediary playing, for example, providing a visual and/or audio prompt to a secondary player or potential secondary player, and locks out taking further positions on game outcome at 758. The announcement and/or lockout may be provided in response to a signal provided to the wireless communications device 44 from or by the casino server computing system(s) 42 via the casino communications system 70, which is generated by or in response to events on or a timer associated with the particular gaming table, or may be provided in response to a timer or other clock signal generated by the wireless communications device.

At 760, the game stops. For example, the game may stop when hands of playing cards are resolved against each other or against a standard, when a dice comes to a stop, a wheel stops spinning or a set of numbers have been drawn. At 762, the initial and intermediary primary and/or secondary positions on game outcome are reconciled based at least in part on the outcome of the game event(s), the primary and secondary positions on game outcome taken, and secondary odds (i.e., odds for particular primary player). In some embodiments reconciliation may take place on the wireless communications device 44 advantageously reducing the computational burden on the casino server computing system(s) 42. In some embodiments reconciliation may take place on the casino server computing system(s) 42, advantageously providing enhanced security.

At 764, the casino server computer updates the scoreboard displaying results of previous games, sessions, or rounds, based at least in part on the outcome of the game. Also, the casino server computer may update the primary player odds based at least in part on the outcome of the game.

As discussed in detail below, in one embodiment positions on game outcome may be accepted if entered into the wireless communications device 44 before initial and/or intermediary positions taken on game outcome are locked out. Also as discussed in detail below, in another embodiment positions on game outcome may be accepted if received by a casino server computing system before initial and/or intermediary positions taken on game outcome are locked out. Also, while not necessary, either embodiment may advantageously employ a packet transaction concept to ensure security and reliability. These embodiments are discussed immediately below.

Figure 16:
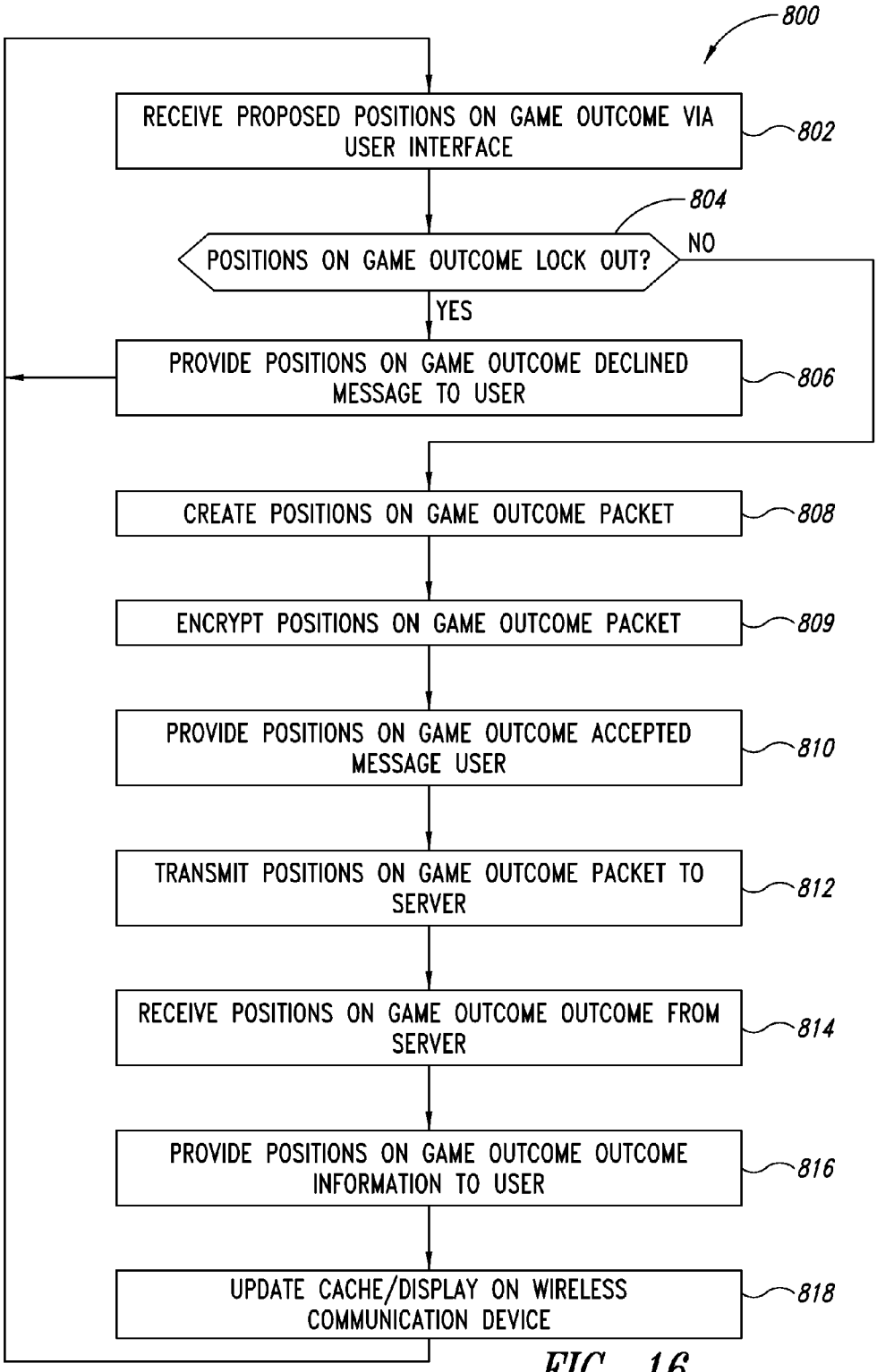
FIG. 16 is a flow diagram of a method in which positions taken by players on the outcome of the game are accepted if entered into the wireless communications device before initial and/or intermediary positions are locked out, according to one illustrated embodiment.

FIG. 16 shows a method 800 in which positions on game outcome are accepted if entered into the wireless communications device 44 before initial and/or intermediary positions taken on game outcome are locked out, according to one illustrated embodiment.

At 802, the wireless communications device 44 receives a proposed position taken on a game outcome entered via a user interface (e.g., keys, joy or thumb stick, track pad, trackball, graphical icons or menus, voice recognition). At 804, the wireless communications device 44 determines whether the proposed position taken on a game outcome is being made during a period when positions on game outcome are locked out, or if the particular player position for which an indirect position on game outcome is being proposed is no longer occupied. If the proposed position taken on a game outcome is occurring during a lockout period on positions being taken on game outcome, or if the particular player position for which an indirect position on game outcome is being proposed is no longer occupied, at 806 the wireless communications device 44 provides an appropriate message to the user via the user interface, declining the proposed position taken on a game outcome and/or suggesting taking a position on game outcome at a later time or for another player position. Control then may return to 802, or the method 800 can terminate, relying on separate threads or instances of the method 800 to handle further proposed positions on game outcome.

If the proposed position taken on a game outcome is occurring outside of a period when positions on game outcome are locked out and the particular player position for which an indirect position on a game outcome is being proposed is still occupied, at 808 the wireless communications device 44 creates a positions on game outcome transaction packet. As discussed in more detail below, creation of the positions on game outcome transaction packet transaction packet may include the generation of error detection and/or error correction information. The wireless communications device 44 may employ any suitable known or later developed error detection and/or error correction algorithms.

Optionally, at 809, the wireless communications device 44 encrypts the positions on game outcome transaction packet. The wireless communications device 44 may employ any suitable known or later developed encryption algorithm.

At 810, the wireless communications device provides a suitable position on game outcome accepted message (e.g., visual, aural, and/or tactile) to the user via the user interface. At 812, the wireless communications device 44 transmits a position on game outcome transaction packet to the casino server computing system 42. The position on game outcome transaction packet may be transmitted intact (i.e., all the information remains in a single packet), to help ensure that position on game outcome transactions are only completed if all required information is present in the packet, and to help ensure that an interruption on communications does not produce or provide an opportunity for a breach in security.

At 814, the wireless communications device 44 receives a position on game outcome result from the casino server computing system 42. In response, the wireless communications device 44 provides positions on game outcome results information to the user via the user interface at 816. At 818, the wireless communications device 44 updates any cached information and/or display on the wireless communications device 44. The method 800 may then return to 802 to handle the next proposed position on game outcome. Alternatively, a separate thread or instance of the method 800 may be invoked for each proposed position on game outcome.

Figure 17:
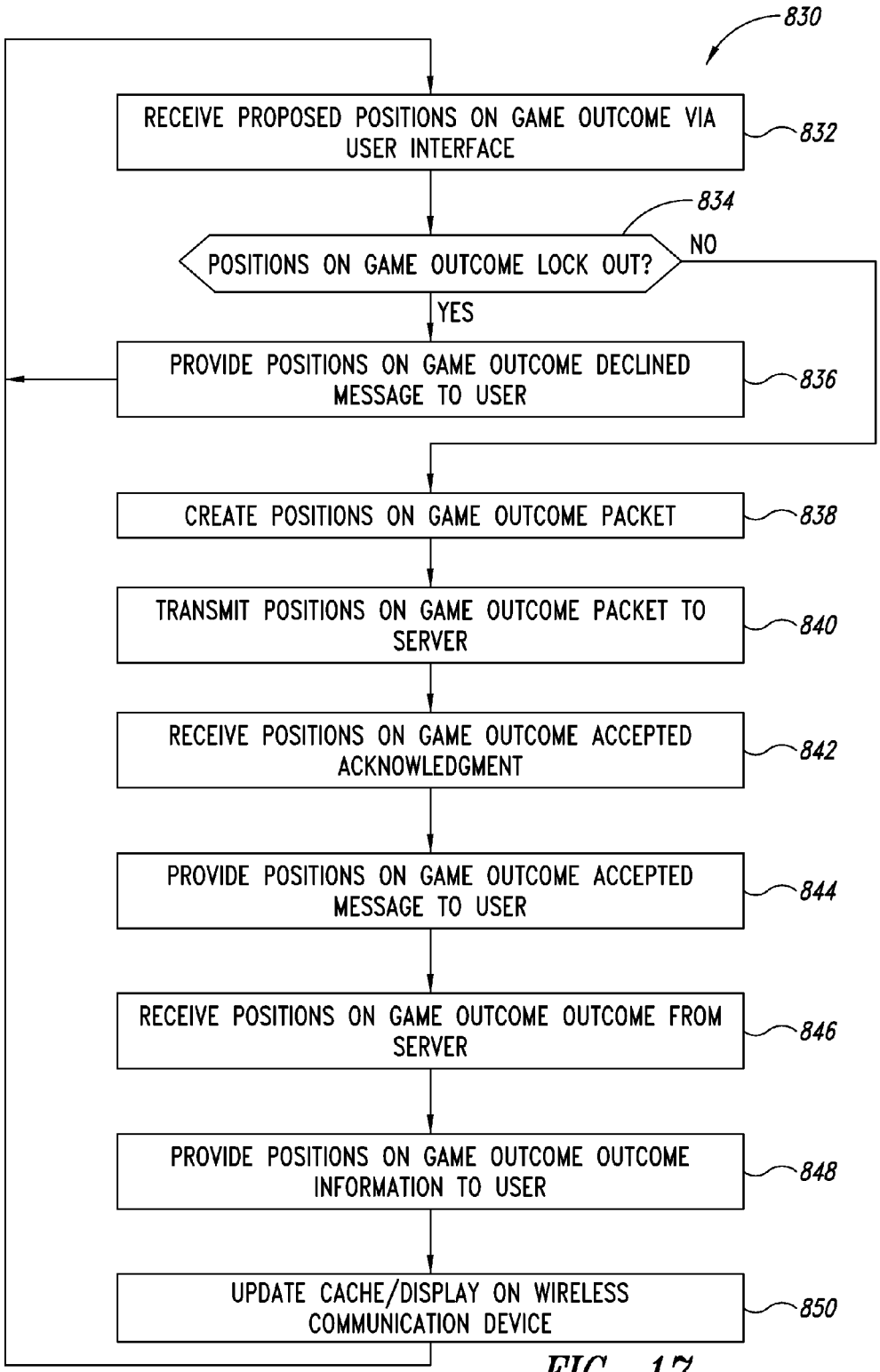
FIG. 17 is a flow diagram of a method in which positions taken by players on the outcome of the game are accepted if received by a casino server computing system before initial and/or intermediary positions are locked out, according to one illustrated embodiment.

FIG. 17 shows a method 830 in which positions on game outcome are accepted if received by a casino server computing system 42 before initial and/or intermediary positions taken on game outcome are locked out, according to one illustrated embodiment.

At 832, the wireless communications device 44 receives a proposed position on game outcome entered via a user interface (e.g., keys, joy or thumb stick, track pad, trackball, graphical icons or menus, voice recognition). At 834, the wireless communications device 44 determines whether the proposed position on game outcome is being made during a period when positions taken on game outcome are locked out, or if the particular player position on which an indirect position on game outcome is being proposed is no longer occupied. If the proposed position on game outcome is occurring during a position on game outcome lockout period, or if the particular player position on which an indirect position on game outcome is being proposed is no longer occupied, at 836 the wireless communications device 44 provides an appropriate message to the user via the user interface, declining the proposed position on game outcome and/or suggesting placing a position on game outcome at a later time or on another player position. Control then may return to 832, or the method 830 can terminate, relying on separate threads or instances of the method 830 to handle further proposed positions on game outcome.

If the proposed position on game outcome is occurring outside of a position on game outcome lockout period and the particular player position on which an indirect position on game outcome is being proposed is still occupied, at 838 the wireless communications device 44 creates a position on game outcome transaction packet. At 840, the wireless communications device 44 transmits the position on game outcome transaction packet to the casino server computing system 42.

At 842, the wireless communications device 44 receives a position on game outcome accepted acknowledgement from the casino server computing system 42. At 844, the wireless communications device provides a suitable position on game outcome accepted message (e.g., visual, aural, and/or tactile) to the user via the user interface.

At 846, the wireless communications device 44 receives a position on game outcome result from the casino server computing system 42. In response, the wireless communications device 44 provides position on game outcome result information to the user via the user interface at 848. At 850, the wireless communications device 44 updates any cached information and/or display on the wireless communications device 44. The method 830 may then return to 832 to handle the next proposed position on game outcome. Alternatively, a separate thread or instance of the method 830 may be invoked for each proposed position on game outcome.

Figure 18:
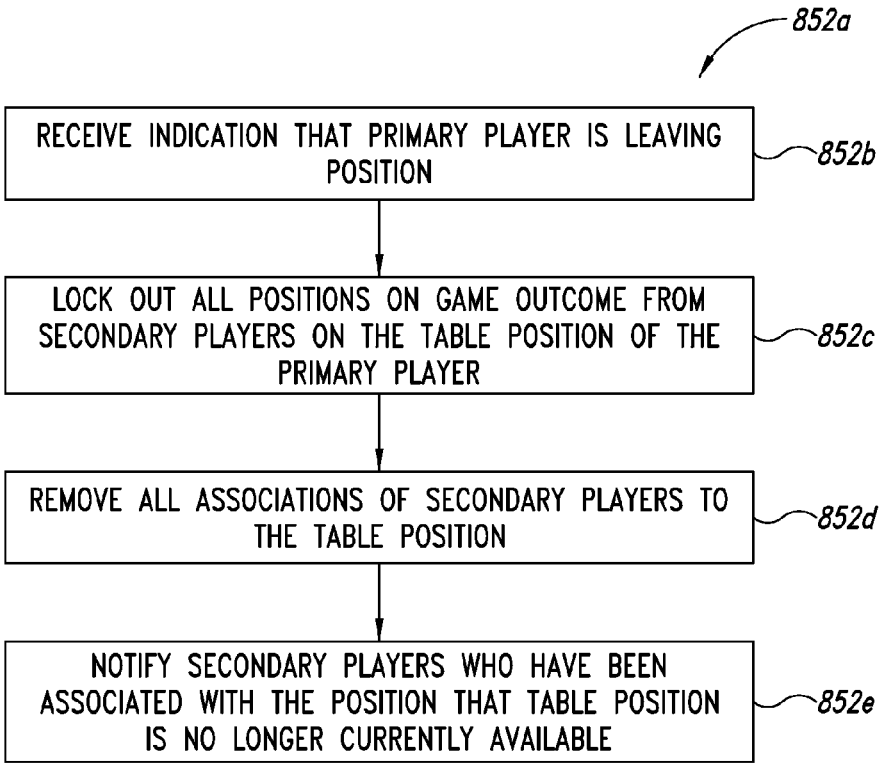
FIG. 18 is a flow diagram of a method in which secondary players are prevented from taking a position on the outcome of the game based on an empty position.

FIG. 18 shows a method 852*a* in which secondary players are prevented from playing on (i.e., taking a position on the outcome of a player playing at) an empty position.

At 852*b*, the wireless communications device 44 receives an indication that a player is leaving their current player position. For example, the indication may be received by the dealer or other casino employee selecting an icon or other item on the graphical user interface of the wireless communications device 44, which may then be sent to the casino management system 84 or casino communications system 70. In other embodiments, the casino management system 84 or casino communications system 70 may receive the indication via alternate communication channels which the dealer or casino employee has access to at the table. In further embodiments, the player leaving their current position may be automatically detected by various sensors at the table or remote monitoring systems, and then communicated to the casino management system 84 or casino communications system 70.

At 852*c*, the casino management system 84 or casino communications system 70 locks out all indirect (e.g., backline) positions taken on game outcome from secondary players on the position of the primary player which is now vacant. For example, this may be accomplished by a signal indicating such positions taken on game outcome should be locked out that is provided to the wireless communications device 44 from or by the casino server computing system(s) 42 via the casino communications system 70. The signal indicating such positions taken on game outcome should be locked out that is provided to the wireless communications device is in response to the casino management system 84 or casino communications system 70 receiving the indication that a player is leaving their current player position from the wireless communications device 44 or other device.

At 852*d*, the casino management system 84 or casino communications system 70 may also remove all associations of secondary players to the now vacant position in order to prevent additional indirect (e.g., backline) positions on game outcome being taken on the currently vacant position by other players previously associated with the currently vacant position or associated with the primary player previously occupying the currently vacant position. In some embodiments, the wireless communications device 44, may remove the associations on the wireless communications device 44 of secondary players to the now vacant position and/or send a signal instructing the casino management system 84 or casino communications system 70 to remove the associations of secondary players to the now vacant position.

At 852*e*, the casino management system 84 or casino communications system 70 may also notify secondary players previously associated with the currently vacant position or associated with the primary player previously occupying the currently vacant position that the particular position is no longer currently available. In some embodiments, the wireless communications device 44, may notify secondary players previously associated with the currently vacant position or associated with the primary player previously occupying the currently vacant position that the particular position is no longer currently available to take indirect (i.e., backline) positions on, and/or send a signal instructing the casino management system 84 or casino communications system 70 to send such notification. The notification may be sent the corresponding secondary players' wireless devices and/or other public displays or devices.

Figure 19:
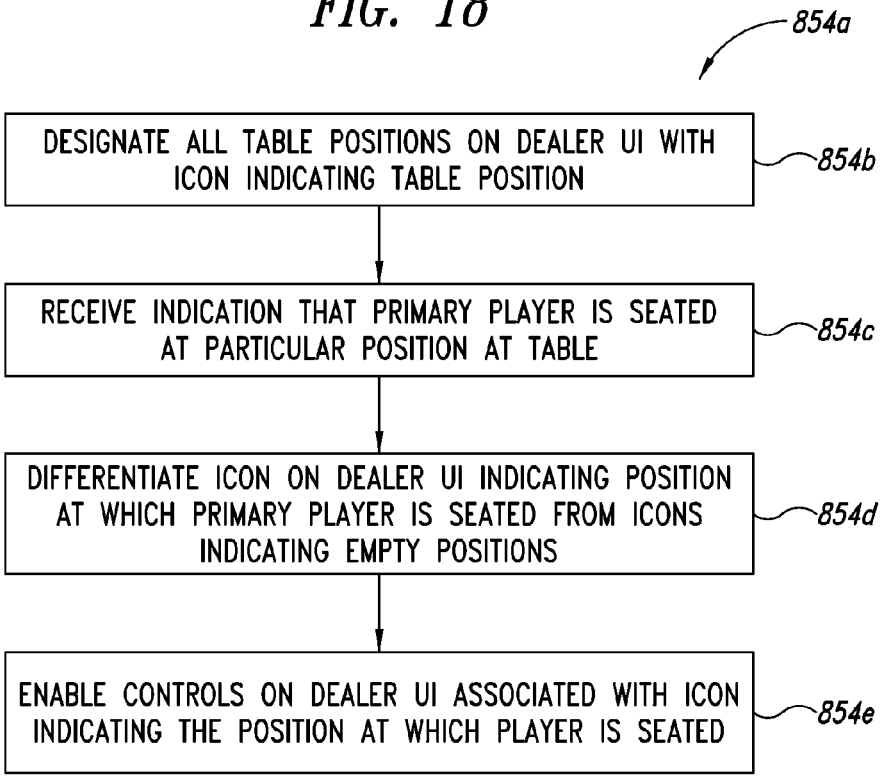
FIG. 19 is a flow diagram of a method in which a dealer user interface is automatically configured upon a primary player arriving at a player position.

FIG. 19 shows a method 854*a* in which a dealer user interface is automatically configured upon a primary player arriving at a table position.

Figure 27:
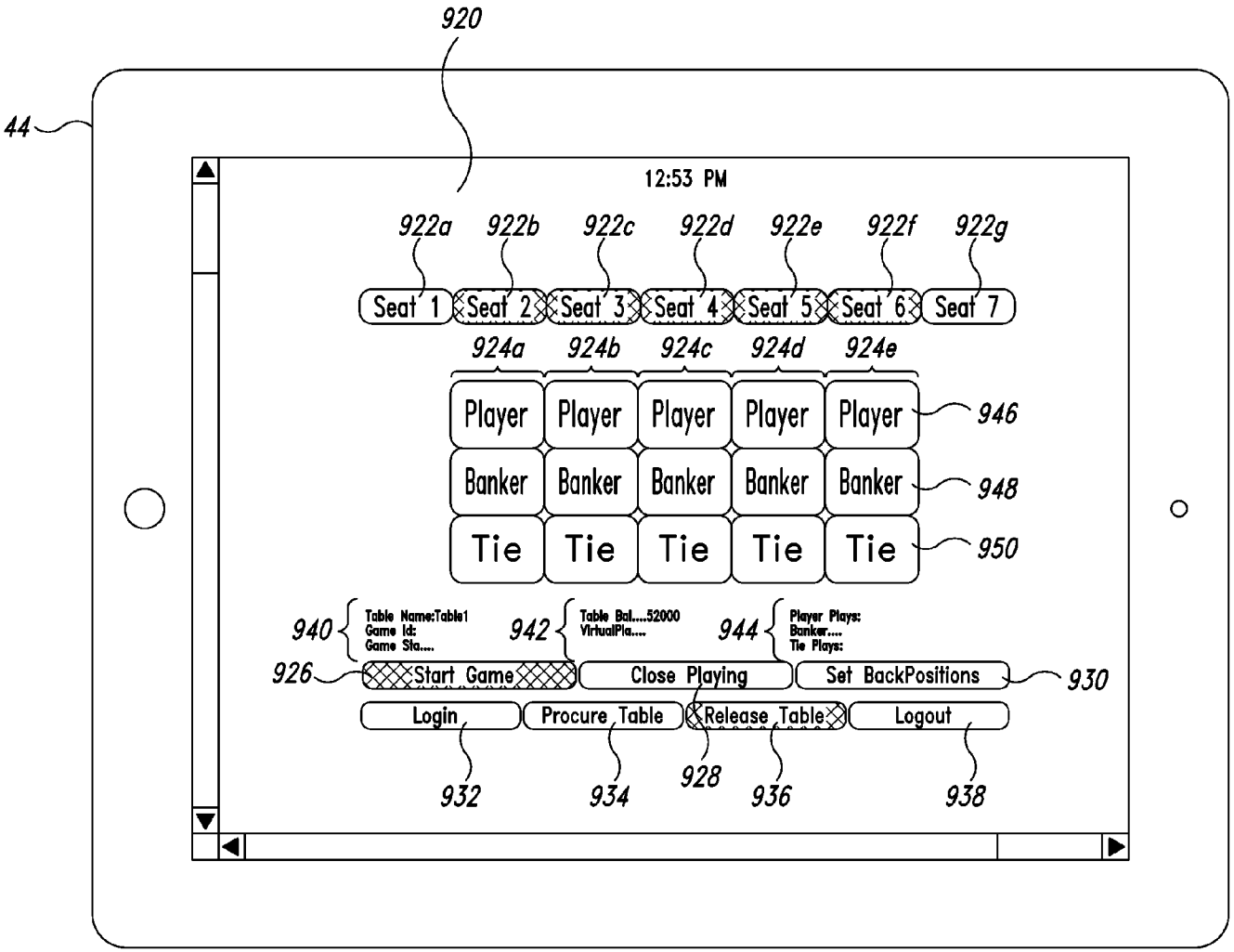
FIG. 27 is a front plan view of the wireless communications device of FIG. 1, showing a procured table screen of a graphical user interface for a dealer in a game of Baccarat, according to one illustrated embodiment.

At 854*b*, the wireless communication device 44 designates all the positions at the table on the dealer user interface of the wireless communication device 44 with an icon indicating each table position (e.g., the icons designating seats 1-7 in FIG. 27).

At 854*c*, the wireless communications device 44 receives an indication that a player is seated or otherwise occupying a particular player position at the table. For example, the indication may be received by the dealer or other casino employee selecting an icon or other item on the graphical user interface of the wireless communications device 44. In some embodiments, the dealer or other casino employee may select the particular icon displayed on the wireless communication device 44 designating the particular position at the table at which the player is now seated or is otherwise occupying.

At 854*d*, in response to receiving the indication that a player is seated or otherwise occupying a particular player position at the table, the wireless communications device 44 graphically differentiates the particular icon displayed on the wireless communication device 44 designating the particular position at the table at which the player is now seated or is otherwise occupying from icons designating the unoccupied player positions at the table. For example, the particular icon displayed on the wireless communication device 44 designating the particular position at the table at which the player is now seated or is otherwise occupying may be highlighted, have its color changed, underlined, designated with an additional label, or bolded, etc. (e.g., the highlighted icons designating seats 2-6 in FIG. 27).

At 854*e*, in response to receiving the indication that a player is seated or otherwise occupying a particular player position at the table, the wireless communications device 44 enables, activates or otherwise makes available user interface controls or other selectable icons or items on the graphical user interface of the wireless communications device 44 associated with the particular icon designating the particular position at the table at which the player is now seated or is otherwise occupying. Among others, these user interface controls may include those that allow the dealer or other casino employee to indicate on which items or hands the player occupying the position is playing and/or amounts of positions on game outcome taken by the player occupying the position. For example, in Baccarat, the user interface controls associated with the currently occupied position may include those that allow the dealer, croupier or other casino employee to indicate, using wireless communications device 44, whether the player is taking a position on the player hand, the banker hand or on a tie (e.g., as shown in FIG. 27). When a particular player position is unoccupied, the wireless communications device 44 disables, deactivates or otherwise makes unavailable user interface controls or other selectable icons or items on the graphical user interface of the wireless communications device 44 associated with the particular icon designating the unoccupied player position.

Figure 20:
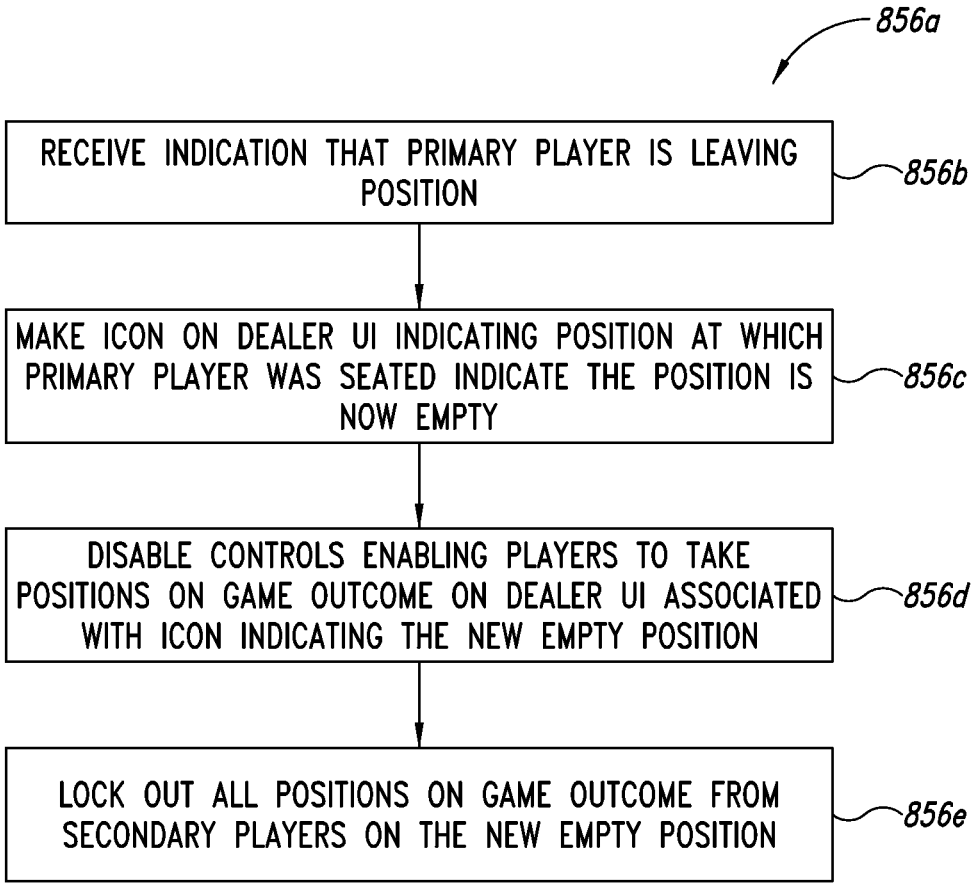
FIG. 20 is a flow diagram of a method in which a dealer user interface is automatically configured upon a primary player leaving the player position.

FIG. 20 shows a method 856*a* in which a dealer user interface is automatically configured upon a primary player leaving the table position.

At 856*b*, the wireless communications device 44 receives an indication that a player is leaving their current player position. For example, the indication may be received by the dealer or other casino employee selecting an icon or other item on the graphical user interface of the wireless communications device 44 when the player decides to leave the position, move to another table, or otherwise stop playing. In some embodiments, the dealer or other casino employee may select the particular icon displayed on the wireless communication device 44 designating the particular position at the table the player is leaving. An indication that a player is leaving their current player position may then be sent from the wireless communications device 44 to the casino management system 84 or casino communications system 70. In other embodiments, the casino management system 84 or casino communications system 70 may receive the indication via alternate communication channels which the dealer or casino employee has access to at the table. In further embodiments, the player leaving their current position may be automatically detected by various sensors at the table or remote monitoring systems, and then communicated to the casino management system 84 or casino communications system 70.

At 856*c*, in response to receiving the indication that the player is leaving their current player position, the wireless communications device 44 makes the icon displayed on the wireless communication device 44 designating the particular position at the table at which the player is leaving indicate the position is now empty or vacant. For example, the particular icon displayed on the wireless communication device 44 designating the particular position at the table which the player is leaving may be dimmed, have its color or additional label changed or removed, or otherwise changed to differentiate it from other icons indicating occupied positions.

At 856*d*, in response to receiving the indication that the player is leaving their current player position, the wireless communications device 44 disables, deactivates or otherwise makes unavailable user interface controls or other selectable icons or items on the graphical user interface of the wireless communications device 44 associated with the particular icon designating the unoccupied player position. Among others, these user interface controls may include those that allow the dealer or other casino employee to indicate on which items or hands the player occupying the position is taking a position regarding the outcome of the item or hand. For example, in Baccarat, the these user interface controls may include those that allow the dealer, croupier or other casino employee to indicate, using wireless communications device 44, whether the player is taking a position on the player hand winning, the banker hand winning or on a tie (e.g., as shown in FIG. 27).

At 856*e*, in response to receiving the indication that the player is leaving their current player position, the casino management system 84 or casino communications system 70 locks out all indirect (e.g., backline) positions on game outcome taken by secondary players on the position of the primary player which is now vacant. For example, this may be accomplished by a signal indicating such positions on game outcome should be locked out that is provided to the wireless communications device 44 from or by the casino server computing system(s) 42 via the casino communications system 70. The signal indicating such positions on game outcome should be locked out is provided to the wireless communications device 44 in response to the casino management system 84 or casino communications system 70 receiving the indication that a player is leaving their current player position from the wireless communications device 44 or other device.

Figure 21:
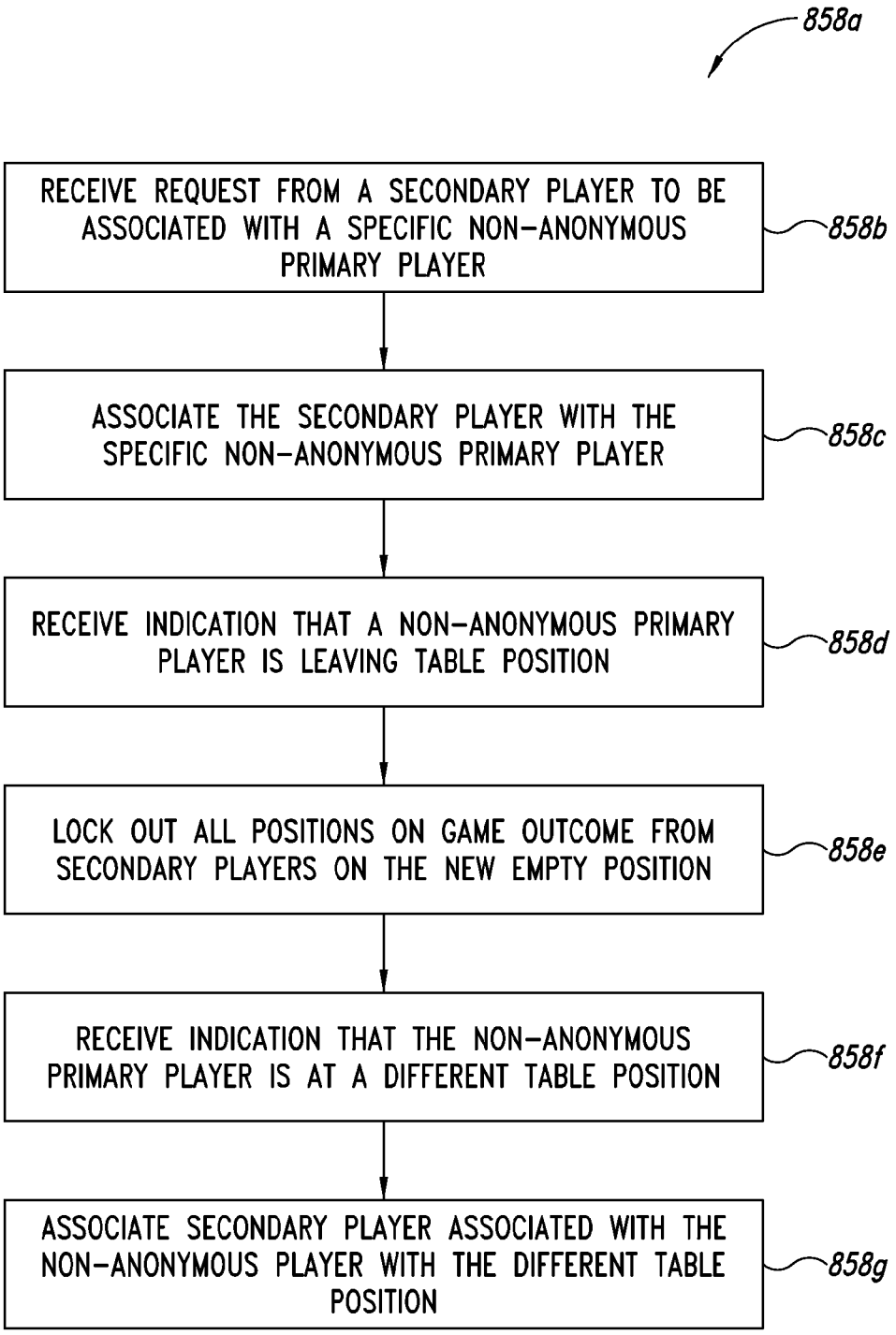
FIG. 21 is a flow diagram of a method in which a secondary player automatically follows a non-anonymous primary player to take positions on the outcome of game play of the primary player when the primary player changes player positions.

FIG. 21 shows a method 858*a* in which a secondary player automatically follows a non-anonymous primary player to take positions on the game outcome of the primary player when the primary player changes table positions.

At 858*b*, the wireless communications device 44 receives a request from a secondary player to be associated with a specific non-anonymous primary player. In some embodiments, the request may be received by the secondary player selecting an icon or other item on the graphical user interface of the wireless communications device 44 or otherwise indicating to the wireless communications device 44 through an interface of the request to be associated with a specific non-anonymous primary player. For example, the secondary player may track and select other particular non-anonymous players who have elected to make their location at a player position known to all other players or particular other players selected by the non-anonymous player. In this way, using the wireless communications device 44, the secondary player may select one or more particular non-anonymous primary players on whom they would like to take secondary or indirect (i.e., backline) positions on game outcome. In some embodiments, once the request is received by the wireless communications device 44, the request may then be sent to the casino management system 84 or casino communications system 70.

At 858*c*, in response to receiving the request from a secondary player to be associated with a specific non-anonymous primary player, the wireless communications device 44, the casino management system 84 and/or the casino communications system 70 then associates the secondary player with the particular non-anonymous primary player and also any current player positions of the particular non-anonymous primary player in order to enable the secondary player to take secondary or indirect (i.e., backline) positions on game outcome on the non-anonymous player or of the player position of the particular non-anonymous primary player. If the wireless communications device 44 associates the secondary player with the particular non-anonymous primary player, then the wireless communications device 44 may also send data indicating this association to the casino management system 84 and/or the casino communications system 70.

At 858*d*, the wireless communications device 44 of the dealer or other casino employee receives an indication that a player is leaving their current player position. For example, the indication may be received by the dealer or other casino employee selecting an icon or other item on the graphical user interface of the wireless communications device 44, which may then be sent to the casino management system 84 or casino communications system 70 from the wireless communications device 44. In other embodiments, the casino management system 84 or casino communications system 70 may receive the indication via alternate communication channels which the dealer or casino employee has access to at the table. In further embodiments, the player leaving their current position may be automatically detected by various sensors at the table or remote monitoring systems, and then communicated to the casino management system 84 or casino communications system 70.

At 858*e*, in response to receiving the indication that the primary player is leaving their current player position, casino management system 84 or casino communications system 70 locks out all indirect (e.g., backline) positions on game outcome taken by secondary players of the position of the primary player which is now vacant. For example, this may be accomplished by a signal indicating such positions on game outcome should be locked out that is provided to the wireless communications device 44 from or by the casino server computing system(s) 42 via the casino communications system 70. The signal indicating such positions on game outcome should be locked out is provided to the wireless communications device in response to the casino management system 84 or casino communications system 70 receiving the indication that a player is leaving their current player position from the wireless communications device 44 or other device. However, the association of the secondary player to the selected primary player is preserved.

At 858*f*, the wireless communications device 44 receives an indication that the primary player is now seated or otherwise occupying a different particular player position at the table or at a different table. For example, the indication may be received by the dealer or other casino employee selecting an icon or other item on the graphical user interface of the wireless communications device 44. In some embodiments, the dealer or other casino employee may select the particular icon displayed on the wireless communication device 44 designating the particular position at the table at which the player is now seated or is otherwise occupying. This indication that the primary player is now seated or otherwise occupying a different particular player position may then be sent to the casino management system 84 or casino communications system 70 from the wireless communications device 44.

At 858*g*, in response to receiving an indication that the primary player is now seated or otherwise occupying a different particular player position at the table or at a different table, the wireless communications device 44, casino management system 84 or casino communications system 70 then associates the secondary player associated with the particular non-anonymous primary player with the new position which the non-anonymous primary player is occupying. This association with the new position which the non-anonymous primary player is occupying enables the secondary player to place secondary or indirect (i.e., backline) positions on game outcome of the same previously requested non-anonymous player at their new player position. In some embodiments, in response to the casino management system 84 or casino communications system 70 receiving an indication that the primary player is now seated or otherwise occupying a different particular player position, the secondary player may receive a notification the casino management system 84 or casino communications system 70 sent to their wireless device 44 that the non-anonymous primary player is now at a different player position, and the secondary player may be given the option to continue taking indirect (i.e., backline) positions on game outcome of the same previously requested non-anonymous player at their new player position.

Figure 22:
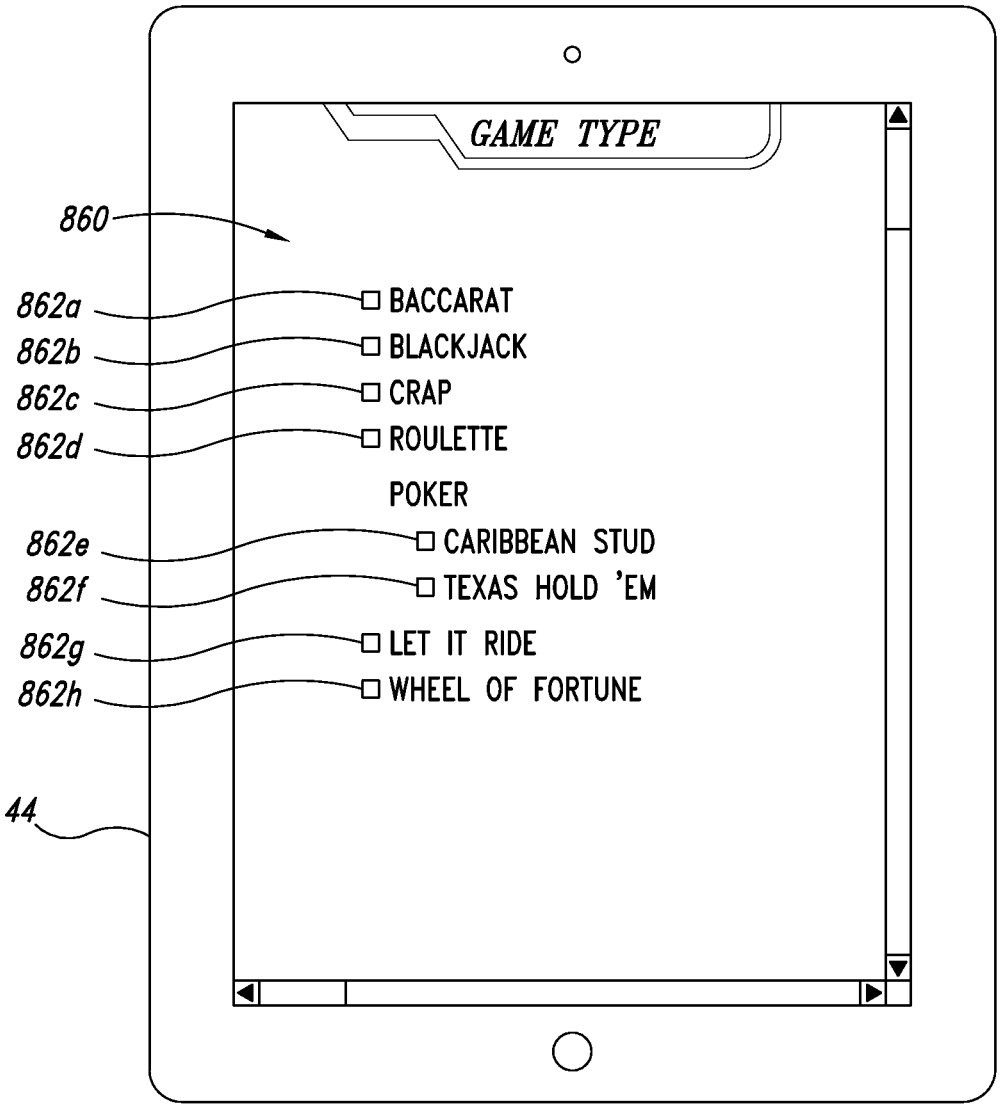
FIG. 22 is a front plan view of the wireless communications device of FIG. 1, showing a portion of a game type selection screen of a graphical user interface, according to one illustrated embodiment.

FIG. 22 shows a game type selection screen 860 of a graphical user interface as displayed by a wireless communications device 44, according to one illustrated embodiment. The game type selection screen 860 allows a user to select a type of game for taking positions on game outcome.

The game type selection screen 860 includes a set of user-selectable game type identification icons 862*a*-862*h* which identify different types of games offered by the casino. The user may select one of the game type identification icons 862*a*-862*h* to navigate to the next screen.

Figure 23:
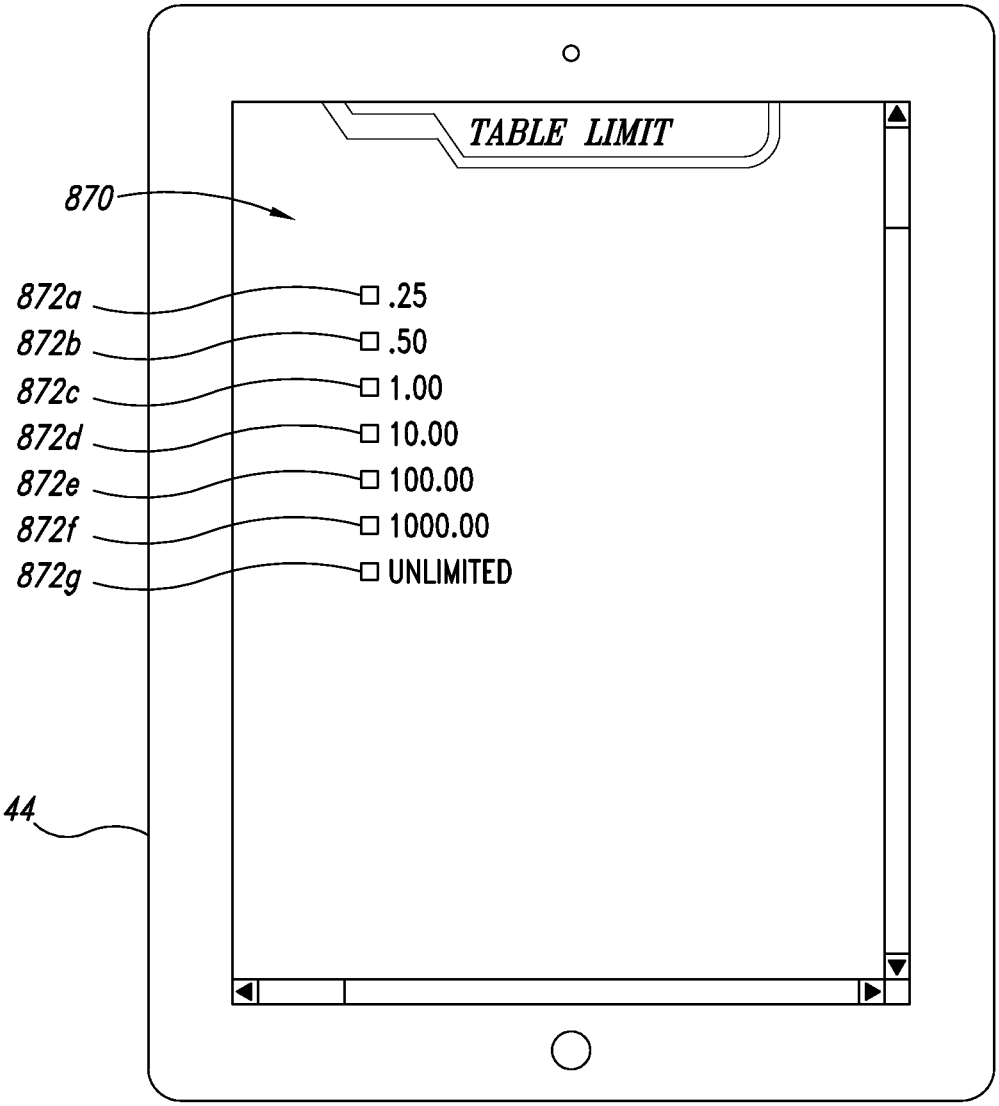
FIG. 23 is a front plan view of the wireless communications device of FIG. 1, showing a portion of a table limit screen of a graphical user interface, according to one illustrated embodiment.

FIG. 23 shows a table limit screen 870 of a graphical user interface as displayed by a wireless communications device 44, according to one illustrated embodiment. The table limit screen may be displayed in response to the selection of one of the game type identification icons 862*a*-862*h* (FIG. 22) if the selected game has associated table limits. The table limit screen 870 allows a user to select from gaming tables or machines having limits with which the player is comfortable.

The table limit screen 870 includes a number of user-selectable table limit icons 872*a*-872*g*. The user may select one of the table limit icons 872*a*-872*g* to view available tables with the appropriate table limits.

Figure 24:
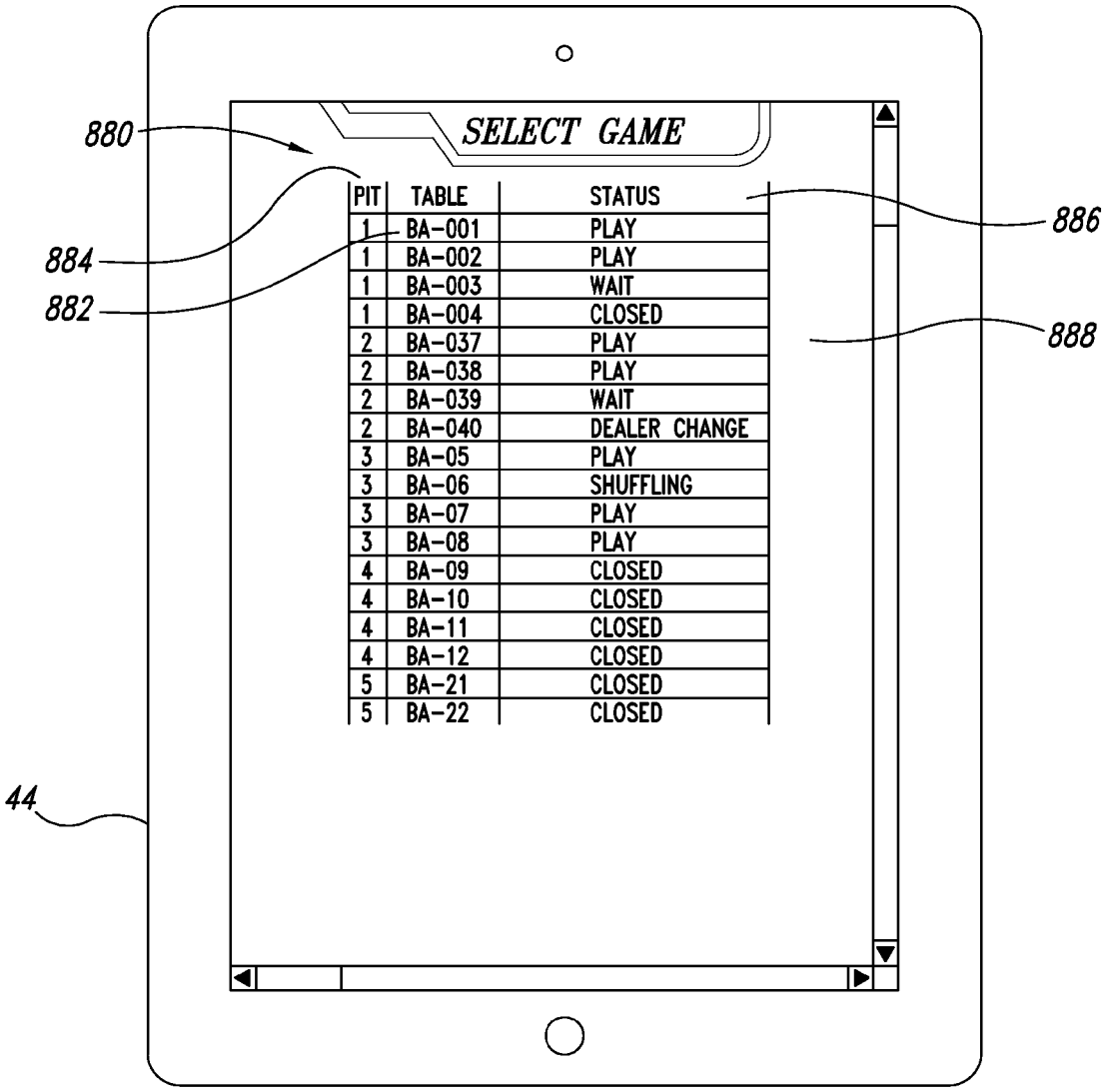
FIG. 24 is a front plan view of the wireless communications device of FIG. 1, showing a portion of a select game screen of a graphical user interface, according to one illustrated embodiment.

FIG. 24 shows a select game screen 880 of a graphical user interface as displayed by a wireless communications device 44, according to one illustrated embodiment. The select game screen 880 may be displayed in response to selection of one of the table limit icons 872*a*-872*g* (FIG. 23). The select game screen 880 allows a user to select from one or more gaming tables or gaming machines.

The select game screen 880 includes a number of user-selectable game identifier icons 882 (only one called out in Figure), which identify specific gaming tables or gaming machines from which the user may select. The select game screen 880 may additionally provide a pit identifier 884 that identifies a pit in which the gaming table or machine is located, as well as a status identifier 886 that identifies a current status of the respective games. For example, the select table screen 880 may indicate that positions on game outcome are currently being accepted (e.g., PLAY), that positions on game outcome are currently not being accepted (e.g., WAIT), that the gaming table or machine is closed (e.g., CLOSED), that the dealer is being changed (e.g., DEALER CHANGE) and hence the wait may be long, that playing cards are being shuffled (e.g., SHUFFLING) and hence the wait may be long, and/or other status. The select table screen 880 may include a scroll bar 888, for reviewing long lists of gaming tables and/or machines.

Figure 25:
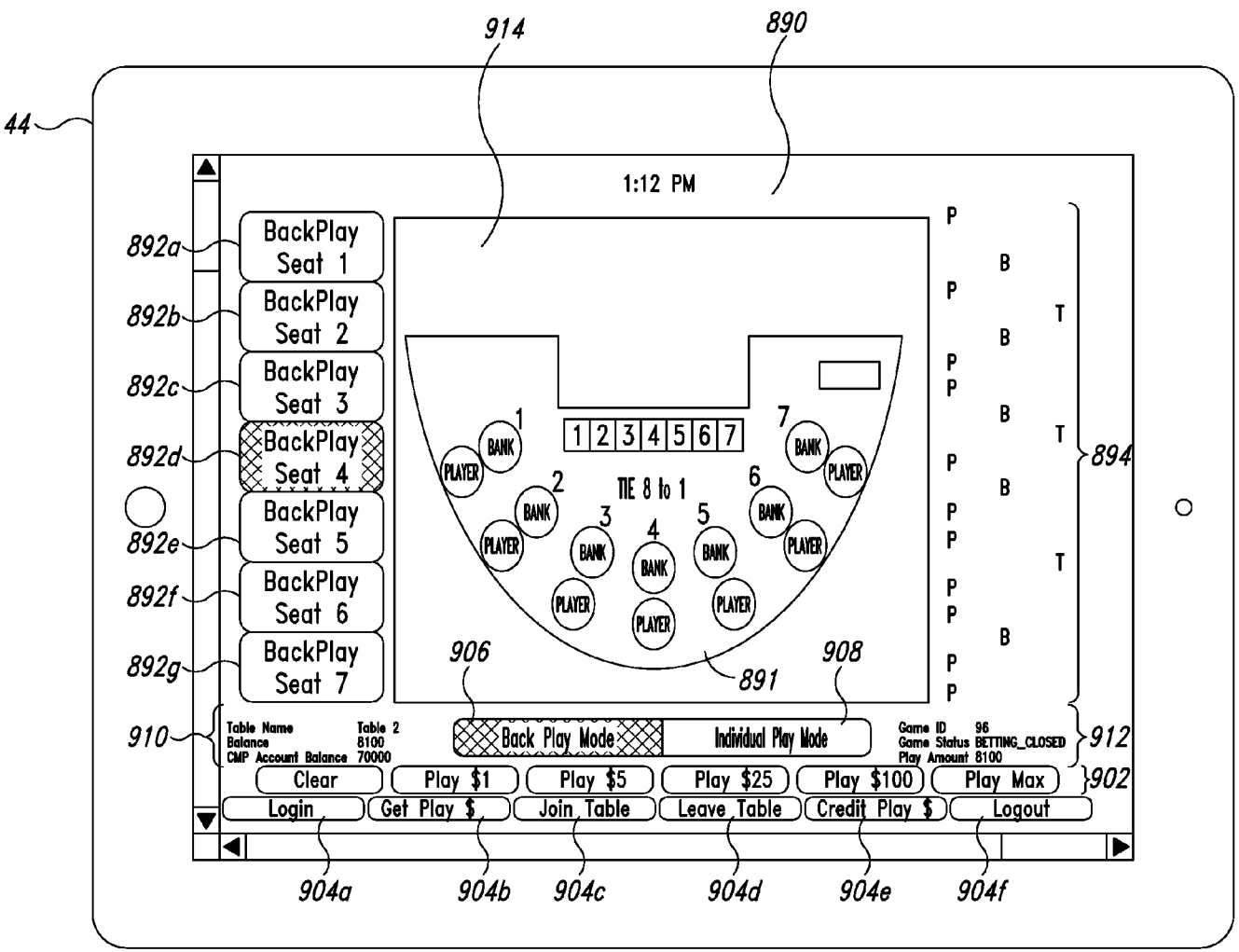
FIG. 25 is a front plan view of the wireless communications device of FIG. 1, showing a backline playing screen of a graphical user interface for a game of Baccarat, according to one illustrated embodiment.

FIG. 25 shows a backline playing screen 890 of a graphical user interface for a game of Baccarat at a particular table as displayed by a wireless communications device 44.

The backline playing screen 890 may be optional, limited to environments where and/or times when backline playing is offered, and may appear at various levels or upon various menu item selections of the graphical user interface of the wireless communications device 44. For example, the backline playing screen 890 may appear after a player has logged on and selects a particular table which they would like to join at the select game screen 880 shown in FIG. 24, or may alternatively be displayed prior to a user logging in to advertise or provide a preview of particular playing opportunities at a particular Baccarat table. The backline playing screen 890 allows a user to review the results of previous Baccarat games or rounds, player and/or table statistics, and to select player positions occupied by primary players on which to take secondary or indirect (i.e., backline) positions on game outcome after logging in.

The backline playing screen 890 includes user-selectable icons 892*a*-892*g* each associated with a player position at the Baccarat table 891 occupied by a respective primary player on which secondary or indirect (i.e., backline) positions on game outcome may be taken. In some embodiments, icons indicating player positions at the Baccarat table may be displayed, but not currently selectable for secondary playing if the corresponding player position is vacant, unoccupied, or otherwise unavailable for secondary playing. In yet other embodiments, the icon indicating the vacant, unoccupied or otherwise unavailable player position for secondary playing may be selectable, but once selected, a notification may be presented on the playing screen 890 indicating the player position is vacant or otherwise unavailable for secondary playing. The player may select the particular icon 892*a*-892*g* associated with a player position at the Baccarat table 891 for which the player wants to take a position on game outcome. Once selected, the icon may change color, become highlighted, or otherwise indicate that the player is taking a position on the player position associated with the selected icon. For example, icon 892*d* is highlighted, which indicates it is currently selected by the player.

The backline playing screen 890 also provides a scoreboard 894 displaying the results or outcomes of previous Baccarat games or rounds for the table 891 and/or for particular player positions or particular non-anonymous players at the table 891. For example, the scoreboard 894 may provide additional information such as a streak indication indicative of a current streak the primary player is running and/or a last ten games indication indicative of the number of wins out of the last 10 games or rounds played by the primary player or player position at the table 891.

The backline playing screen 890 provides a row of selectable play icons 902 which the secondary player may select to conveniently take positions on game outcome in pre-determined multiples. Also provided is a selectable "Login" icon 904*a* to enable a user to log in to the gaming system in a manner shown and described with reference to FIG. 6, a selectable "Get Playing $" icon 904*b* to electronically withdraw funds from a casino or other account with which to play, a "Join Table" icon 904*c* to select the currently displayed table 891 for secondary playing, a selectable "Leave Table" icon to enable the player to indicate that the player wants to stop secondary playing at the table 891 and perhaps view or move to another table, a "Credit Playing $" icon 904*e* selectable by the player to electronically deposit or "cash in" their funds or credits to the casino or other account, and a selectable "Logout" for the player to log out of the gaming system.

The backline playing screen 890 also includes a "Back Play Mode" icon 906 and a "Individual Play Mode" icon 908 selectable by the user to conveniently switch between displaying the backline playing screen 890 and the individual (i.e., direct) playing screen 918 (shown in FIG. 26) for the table 891, which enables the user to remotely take direct positions on game outcome of the Baccarat game.

The backline playing screen 890 also may display various other data in section 910 and section 912 regarding the game currently being played at the table 891 and/or regarding the player using the wireless device that is logged into the gaming system. For example, this data may include the table name, the table balance, the comp balance of the player, game identification data, the game's playing status (e.g., open or closed), and current amount associated with the position the player is taking on the outcome of the game.

The backline playing screen 890 also provides a game view section 914. The game view section 890 displays a view of the game being played at the selected gaming table 891. For example, the game view section 890 may display a live video feed, digital video stream, or other video images of the game, simulated images created based on information gathered about the game, and/or still photographs.

The backline playing screen 890 of a graphical user interface for a game of Baccarat as shown in FIG. 25 may also be applied to other table games (e.g., Blackjack), as each player position may be selected in the same or similar manner and positions on game outcome taken in a similar manner by the secondary player using the same or similar selectable controls on the backline playing screen 890.

Figure 26:
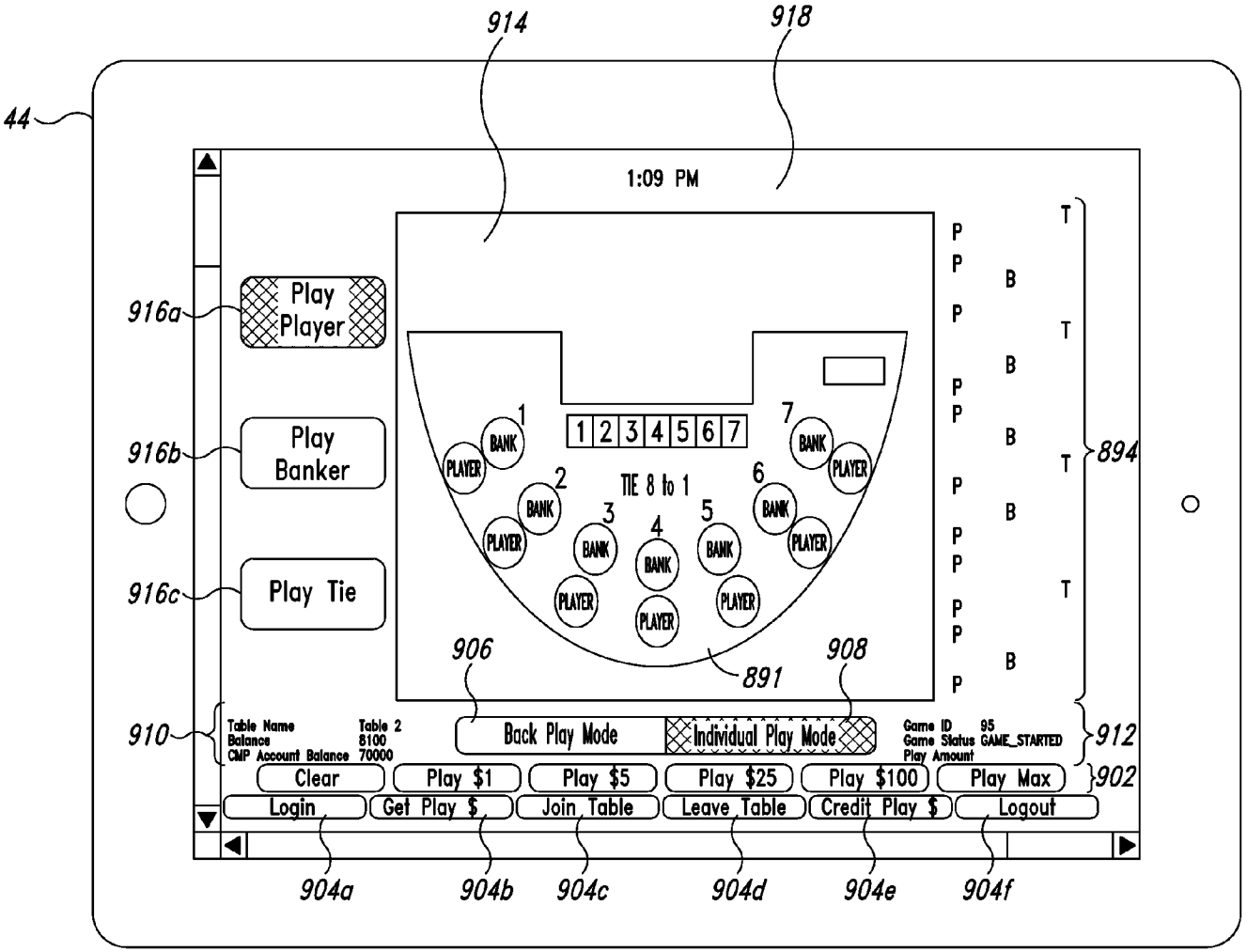
FIG. 26 is a front plan view of the wireless communications device of FIG. 1, showing a direct playing screen of a graphical user interface for a game of Baccarat, according to one illustrated embodiment.

FIG. 26 shows a direct (i.e., individual) playing screen 918 of a graphical user interface for a game of Baccarat at a particular table as displayed by a wireless communications device 44.

The direct playing screen 918 is somewhat similar to the backline (i.e., indirect) playing screen 890 of FIG. 25 except that instead of the user-selectable icons 892*a*-892*g* of the backline playing screen 890 that are each associated with a player position at the Baccarat table occupied by a respective primary player, included are user selectable icons 916*a*-916*c* to remotely take positions on game outcome directly on the Baccarat game.

In particular a "Play Player" selectable icon 916*a* enables the player to remotely take positions on the "player hand" winning by the selecting the "Play Player" selectable icon 916*a*, a "Play Banker" selectable icon 916*b* enables the player to remotely take positions on the "banker hand" winning by the selecting the "Play Banker" selectable icon 916*b*, and a "Play Tie" selectable icon 916*c* enables the player to remotely take positions on there being a tie between the "player hand" and the "banker hand" by the selecting the "Play Tie" selectable icon 916*c*. Also, the particular icon selected of the selectable icons 916*a*-916*c* may be highlighted, bolded or otherwise differentiated from the other non-selected icons to enable the player to easily know on which hand the player had taken a position regarding game outcome. In particular, the "Play Player" selectable icon 916*a* is highlighted indicating that the player selected the "Play Player" selectable icon 916*a* to remotely take a position on the "player hand" winning.

Note that the "Individual Play Mode" icon 908 is highlighted and the "Back Play Mode" icon 906 is not because the player has switched from the backline playing screen 890 shown in FIG. 25 to the direct playing screen 918. However, other ways of differentiating the "Individual Play Mode" icon 908 and the "Back Play Mode" icon 906 to indicate which corresponding screen is currently displayed may also be used. The user may again select the "Back Play Mode" icon 906 to switch back to the backline playing screen 890.

FIG. 27 shows a procured table screen 920 of a graphical user interface for a game of Baccarat at a particular table as displayed by a wireless communications device 44.

The procured table screen 920 may appear on the wireless communications device 44 of a dealer or other casino employee once the dealer procures a table at which they will be dealing. For example, the procured table screen 920 may appear in response to the dealer or other casino employee selecting the particular table from the tracking screen 160 of the graphical user interface of the wireless communications device 44 as described above with reference to FIGS. 7A and 7B. Among other functionalities, the procured table screen 920 allows the dealer or other casino employee to conveniently indicate, using the wireless communications device 44, which player positions are occupied by primary players. This information may then be sent from the wireless communications device 44 to the casino management system 84, casino communications system 70 or other wireless communications devices to enable indirect (i.e., backline) playing by secondary players using their wireless communications devices on the player positions occupied by the primary players.

The procured table screen 920 includes user-selectable icons 922*a*-922*g*, each associated with a player position at the Baccarat table. If a primary player is occupying a particular position, the dealer or other casino employee may select the icon corresponding to that particular position. In response to this selection, the icon will automatically become highlighted, change color or otherwise become differentiated from other icons corresponding to vacant player positions (e.g., following the method of FIG. 19). For example, user-selectable icons 922*b*-922*f*, corresponding to player positions at seats 2-6, respectively have been selected to indicate that a primary player is occupying each of the player positions at the gaming table corresponding to user-selectable icons 922*b*-922*f*. Accordingly, the user-selectable icons 922*b*-922*f* are highlighted, while the user-selectable icons 922*a* and 922*g*, corresponding to vacant player positions at seats 1 and 7, respectively, are not.

Also, in response to this selection of a user selectable icon corresponding to a player position, an additional column of selectable icons appears below the corresponding selected icon corresponding to the occupied player position (e.g., following the method of FIG. 19). For example, procured table screen 920 includes four columns of user selectable icons 924*a*-924*e*, each column under a corresponding selected icon 922*b*-922*f*, respectively. Each column of user selectable icons 924*a*-924*e* includes 3 user selectable icons that the dealer or other casino employee may select to indicate to the wireless device 44 on which hand the corresponding primary player has taken a position regarding game outcome. For example, as shown in the column of user selectable icons 924*e*, there is a "Player" selectable icon 946, a "Banker" selectable icon 948 and a "Tie" selectable icon 950 that the dealer or other casino employee may select to indicate that the primary player corresponding to seat 6 (designated by icon 922*f*) has taken a position on the on the player hand winning, on the banker hand winning, or on there being a tie between the player hand and the banker hand.

The procured table screen 920 also includes a "Start Game" selectable icon 926 to enable the dealer to indicate the game has begun and to start to allow playing by selection of the "Start Game" selectable icon 926. For example, this may correspond to or trigger acts 604 and 606, and 704 and 706 of the methods shown in FIGS. 12 and 14, respectively, in which initial playing is announced and accepted. In some embodiments, both direct (local and remote) and indirect (i.e., backline) playing will be allowed once the "Start Game" selectable icon 926 is selected. In other embodiments, the dealer or other casino employee may select the "Set BackBets" selectable icon to initiate acceptance of indirect (i.e., backline) playing. The procured table screen 920 includes a "Close Playing" selectable icon 928 to enable the dealer to indicate playing is closed by selection of the "Close Playing" selectable icon 928. For example, this may correspond to or trigger acts 612 and 614, and 712 and 714 of the methods shown in FIGS. 12 and 14, respectively, in which closure of initial playing is announced and taking further positions on game outcome are locked out. The indications corresponding to the selected icons may be sent electronically from the wireless communications device 44 to the casino management system 84, casino communications system 70 or other wireless communications devices to enable or prevent corresponding participation in the game by secondary or other remote players using their wireless communications devices.

Also provided is a selectable "Login" icon 932 to enable a user to log in to the gaming system in a manner shown and described with reference to FIG. 6, a selectable "Logout" icon 932, a selectable "Procure Table" icon 934 to enable the dealer to select and procure a different table, and a Release Table icon 936 to allow the dealer to release the table they have procured so that the table may be closed or become available for another dealer to procure the table.

Note that particular icons may become non-selectable or differentiated from other icons depending on the current, mode, level, state or stage of game play. For example, only the highlighted "Start Game" icon 926 and the highlighted "Release Table" icon 936 are selectable as shown on the procured table screen 920, which corresponds to a stage at which the dealer has logged on, procured the table and indicated which player positions are occupied, but has yet to start the game and accept taking positions on game outcome. Thus, the "Login" icon 932, the "Logout" icon 932, the "Procure Table" icon 934, the "Close Playing" icon 928 and the "Set BackBets" icon 930" are currently non-selectable as indicated by them not being highlighted. The "Logout" icon 938 is currently non-selectable because in the example shown, the dealer must release the table before the dealer can log out.

The procured table screen 920 also includes various table and game information displayed in sections 940, 942 and 944. As shown on the procured table screen 920, information display section 940 is configured to display the table name, game identifier, and game state. Information display section 942 is configured to display the table balance and virtual player balance and/or number of virtual players (i.e., remote players). Information display section 944 is configured to display the number of players playing on (i.e., taking a position on) the player hand, the number of players playing on the bank hand, and the number of primary players playing on a tie between the bank hand and player hand. Alternatively, the information display section 942 may be configured to also or instead display the number of remote players and/or the total number of primary and remote players. In some embodiments secondary players taking indirect positions on game outcome (i.e., backline positions on game outcome) may place backline positions on the game outcome of other remote players placing direct positions on the game outcome.

Figure 28:
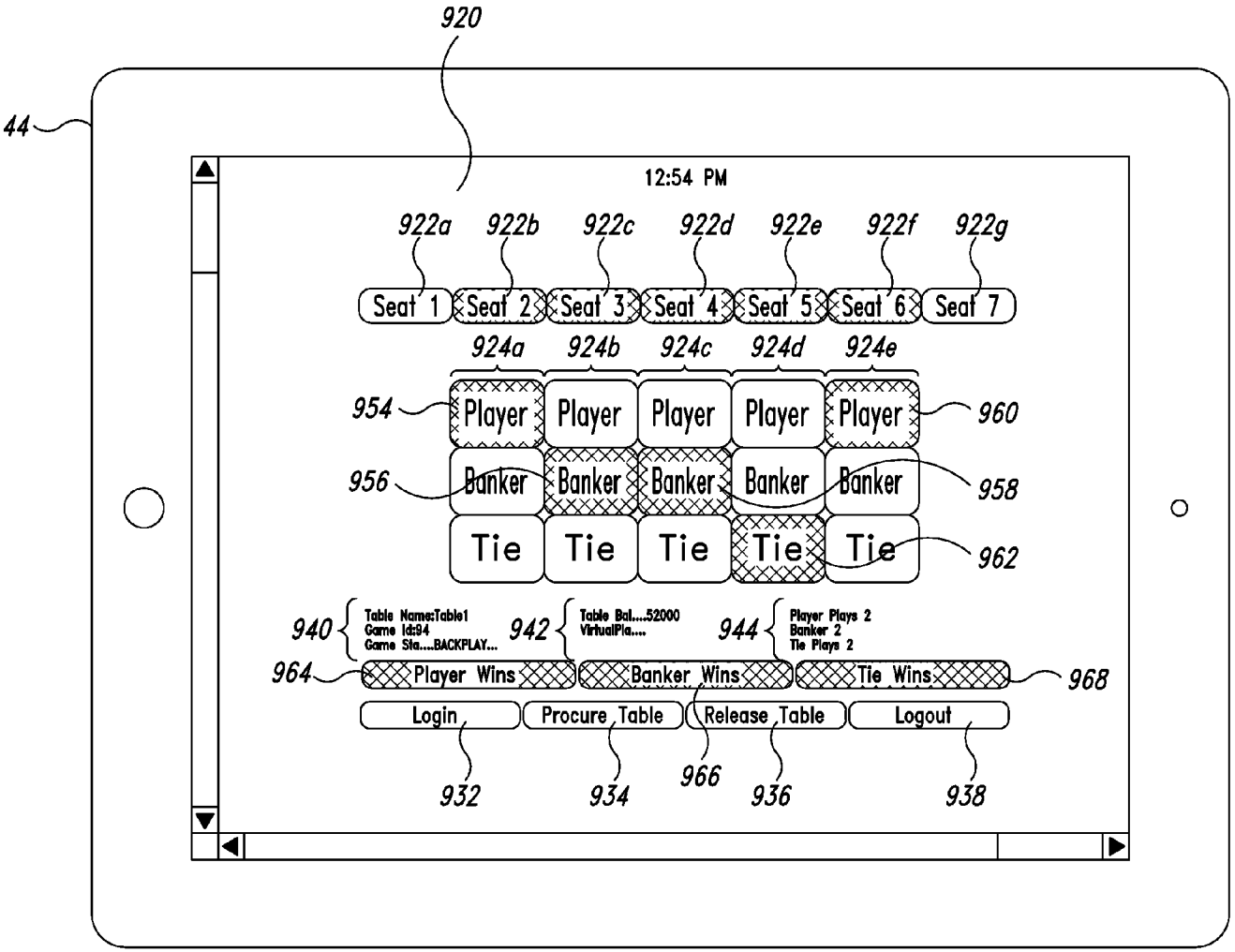
FIG. 28 is a front plan view of the wireless communications device of FIG. 1, showing a table dealing screen of a graphical user interface for a dealer in a game of Baccarat, according to one illustrated embodiment.

FIG. 28 shows table dealing screen 952 of a graphical user interface for a game of Baccarat at a particular table as displayed by a wireless communications device 44. The table dealing screen 952 may appear on the wireless communications device 44, for example, in response to the dealer or other casino employee selecting the "Start Game" icon 926 of the procured table screen 920 shown in FIG. 27, has accepted positions on game outcome, and has then selected the "Close Playing" icon 928 of the procured table screen 920 shown in FIG. 27. In this state, the dealer has finished accepting positions on game outcome and has indicated which primary player has taken a position on which hand by selecting the corresponding icon within four columns of user selectable icons 924*a*-924*e*, under respective icons 922*b*-922*f* designating the four primary players currently occupying player positions at the table.

For example, when the dealer selected the "Player" icon 954, this icon was highlighted, bolded or otherwise differentiated from other non-selected icons within the four columns of user selectable icons 924*a*-924*e* to indicate that the primary player in the player position "Seat 2" has taken a position that the player hand will win. Also, the "Banker" icon 956 has been selected by the dealer or other casino employee to indicate that the primary player in the player position "Seat 3" has taken a position that the banker hand will win; the "Banker" icon 958 has been selected to indicate that the primary player in the player position "Seat 4" has also taken a position that the banker hand will win; the "Tie" icon 962 has been selected to indicate that the primary player in the player position "Seat 5" has taken a position that there will be a tie between banker hand and player hand; and the "Player" icon 960 has been selected to indicate that the primary player in the player position "Seat 6" has taken a position that the player hand will win.

Once the playing has been closed and the dealing is finished as described above and with respect to FIGS. 12 and 14, the dealer or other casino employee may select either the "Player Wins" selectable icon 964, the "Banker Wins" selectable icon 966 or the "Tie Wins" selectable icon to indicate the result of the game. This may correspond to or trigger the acts 620 of the method shown in FIG. 12 and act 720 of the method shown in FIG. 14, to reconcile positions on game outcome.

Data representing the indications made by selection of the icons or other interface items described above regarding FIGS. 6 to 11 and FIGS. 22 to 28 may also be sent from the wireless communications device 44 to the casino management system 84, casino communications system 70 or other wireless communications devices to enable control of the game play of secondary and other remote players using their corresponding wireless devices.

Position on Game Outcome Transaction Packets

Figure 29:
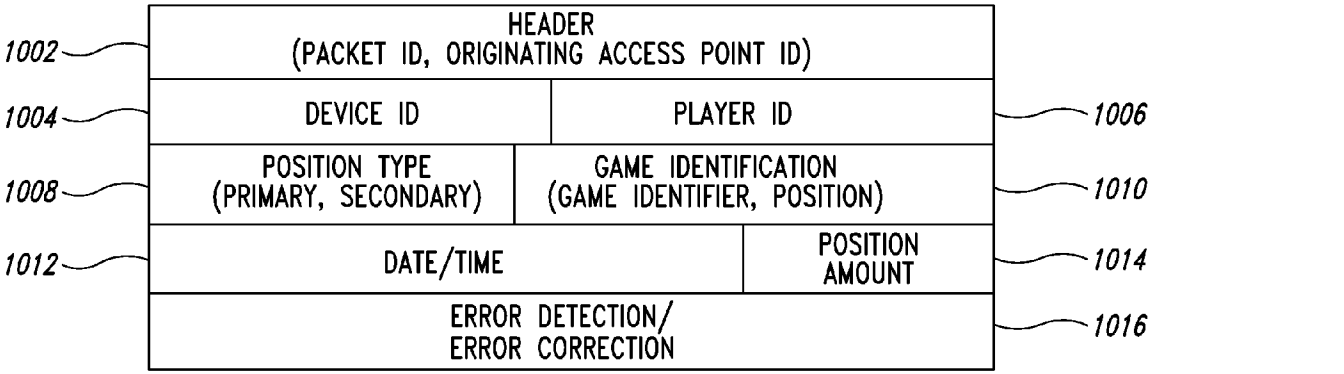
FIG. 29 is a schematic diagram of a data structure suitable to implement the position transaction packet structure, according to one illustrated embodiment.

FIG. 29 shows a data structure 1000 suitable to implement a position on game outcome transaction packet structure according to one illustrated embodiment. The data structure may temporarily or permanently reside in a memory of the wireless communications device 44, a memory of the casino server computing system 42, memory of wireless or wired access points (e.g., pit podium personal computers 36) or other medium such as the wired or wireless communications links of the network 34. In some embodiments, the data structure 1000 will be created by the wireless communications devices 44, in other embodiments the data structure 1000 is created by the wireless or wired access points.

The data structure 1000 includes a header field 1002 which in addition to typical header information associated with communications such as packet length, may include a packet identifier that uniquely identifies the position on game outcome transaction packet, and may also include an origin identifier that uniquely identifies the originating access point for the position on game outcome transaction packet (e.g., unique identifier of a wireless access point). The data structure 1000 may include a device identifier field 1004 that stores a device identifier that uniquely identifies the wireless communications device 44 originating the position on game outcome. The data structure 1000 may optionally include a player identifier field 1006, which stores a player identifier, if known, that uniquely identifies the player taking the position on game outcome. The player identifier may be based on a prior assignment of the wireless communications device 44 to a specific player. Alternatively, the player identifier may be based on one or more inputs by the player. Such inputs may, for example, include a user name and password, biometric information, and/or swipe of a credit card, debit card, drivers license or other identification card. Such information would allow sharing of wireless communications devices 44 among two or more users, and eliminate the need to track assignment of such wireless communications devices 44. Alternatively, such information can permit the comparison of the wireless communications device identifier against the player identifier to a detect misappropriation of the wireless communications device 44, for example, using a database that stores relationships or assignments between the wireless communications device identifiers and the player identifiers.

The data structure 1000 may optionally include a position type field 1008, which stores a position type value that identifies a type of position on game outcome being taken, for example, a primary position on game outcome or a secondary position on game outcome. The data structure 1000 includes a game identification field 1010. The game identification field 1010 includes information that identifies the game for which the position on game outcome is being taken. The game identification field 1010 may, for example, include a game identifier that uniquely identifies a gaming table or machine, and/or a position identifier that uniquely identifies a position at the gaming table or machine.

The data structure 1000 includes a date and time field 1012 that stores a value indicative of a date and time that the position on game outcome is being taken. Such a value may advantageously be used to associate the position on game outcome with a specific round or hand of a game being played at a particular gaming table or machine identified by the game identifier and/or position identifier. Such a value may additionally, or alternatively, advantageously be used to determine whether the position on game outcome was taken before a position on game outcome lockout period. This approach may address issues that may be raised where communications are slow or not instantaneous, to ensure that players who take positions on game outcome during the allotted playing times are given appropriate credit, and positions on game outcome are not unfairly denied due to delays in communications. In some embodiments, the date and time field 1012 may be considered part of the game identification field 1010 or subsumed therein.

The data structure 1000 includes a field 1014 for an amount associated with a position taken on game outcome that identifies the amount associated with the position taken on game outcome.

The data structure 1000 may include an error detection/error correction field 1016. The error detection/error correction field 1016 includes error detection and/or error correction values that allows the determination of whether an error occurred during transmission of the position on game outcome transaction packet, and in some embodiments allows the correction of some or all of those errors. Error correction may, for, example, employ Reed/Solomon error correction techniques or other known error detection or error correction techniques.

Figure 30:
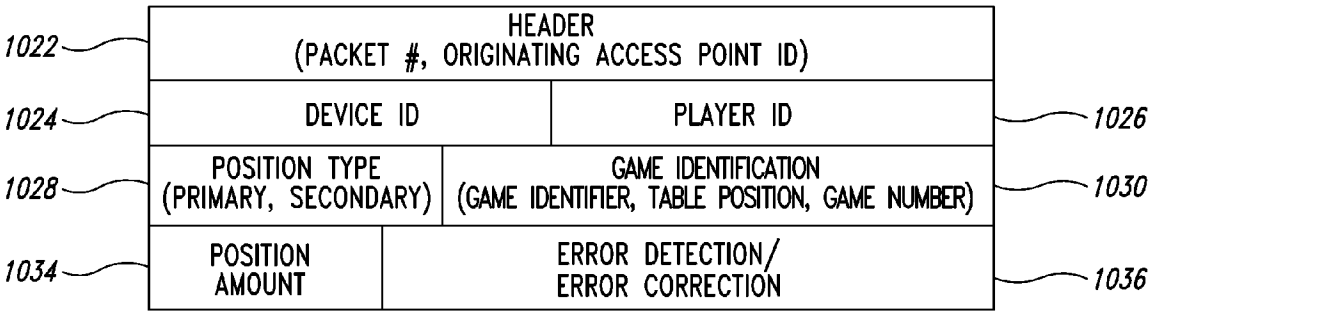
FIG. 30 is a schematic diagram of a data structure suitable to implement the position transaction packet structure, according to another illustrated embodiment.

FIG. 30 shows a data structure 1020 suitable to implement the position on game outcome transaction packet structure according to another illustrated embodiment. The data structure may temporarily or permanently reside in a memory of the wireless communications device 44, a memory of the casino server computing system 42, memory of wireless or wired access points (e.g., pit podium personal computers 36) or other medium such as the wired or wireless communications links of the network 34. In some embodiments, the data structure 1020 will be created by the wireless communications devices 44, in other embodiments the data structure 1020 is created by the wireless or wired access points.

The data structure 1020 includes a header field 1022 which in addition to typical header information associated with communications such as packet length, may include a packet identifier that unique identifies the position on game outcome transaction packet, and may also include an origin identifier that uniquely identifies the originating access point for the position on game outcome transaction packet (e.g., unique identifier of a wireless access point). The data structure 1020 may include a device identifier field 1024 that stores a device identifier that uniquely identifies the wireless communications device 44 originating the position on game outcome. The data structure 1020 may optionally include a player identifier field 1026, which stores a player identifier, if known, that uniquely identifies the player taking the position on game outcome. The player identifier may be based on a prior assignment of the wireless communications device 44 to a specific player. Alternatively, the player identifier may be based on one or more inputs by the player. Such inputs may, for example, include a user name and password, biometric information, and/or swipe of a credit card, debit card, drivers license or other identification card. Such information would allow sharing of wireless communications devices 44 among two or more users, and eliminate the need to track assignment of such wireless communications devices 44. Alternatively, such information can permit the comparison of the wireless communications device identifier against the player identifier to detect misappropriation of the wireless communications device 44, for example, using a database that stores relationships, assignments or associations between the wireless communications device identifiers and the player identifiers (including player identifiers of players which have not been issued or are not associated with a wireless device).

The data structure 1020 may optionally include a position type field 1028, which stores a position type value that identifies a type of position on game outcome being placed, for example, a primary position on game outcome or a secondary position on game outcome. The data structure 1020 includes a game identification field 1030. The game identification field 1030 includes information that identifies the game for which the position on game outcome is being taken. The game identification field 1030 may, for example, include a game identifier that uniquely identifies a gaming table or machine, and/or a position identifier that uniquely identifies a position at the gaming table or machine, and a game number that uniquely identifiers a round or hand of the game being played at the gaming table or machine. Thus, for example, the game number may be incremented for each round of a baccarat game that is dealt during a gaming session (e.g., time while table is in use; dealer sessions, etc). The game number may advantageously be used to associate the position taken on game outcome with a specific round or hand of a game being played at a particular gaming table or machine identified by the game identifier and/or position identifier. By comparing the time of receipt of the position on game outcome transaction packet with a start time for a round or hand identified by the game number, it may be determined whether the position on game outcome was taken before a position on game outcome lockout period. This approach may provide enhanced security since date and time information is controlled by the casino server computing system 42 rather than the wireless communications device 44 or one or the access points.

The data structure 1020 includes a field 1034 for an amount associated with the position taken on game outcome, that identifies the amount associated with the position taken on the game outcome.

The data structure 1020 may include an error detection/error correction field 1036. The error detection/error correction field 1036 includes error detection and/or error correction values that allows the determination of whether an error occurred during transmission of the position on game outcome transaction packet, and in some embodiments allows the correction of some or all of those errors. Error correction may, for, example, employ Reed/Solomon error correction techniques or other known error detection or error correction techniques.

Figure 31:
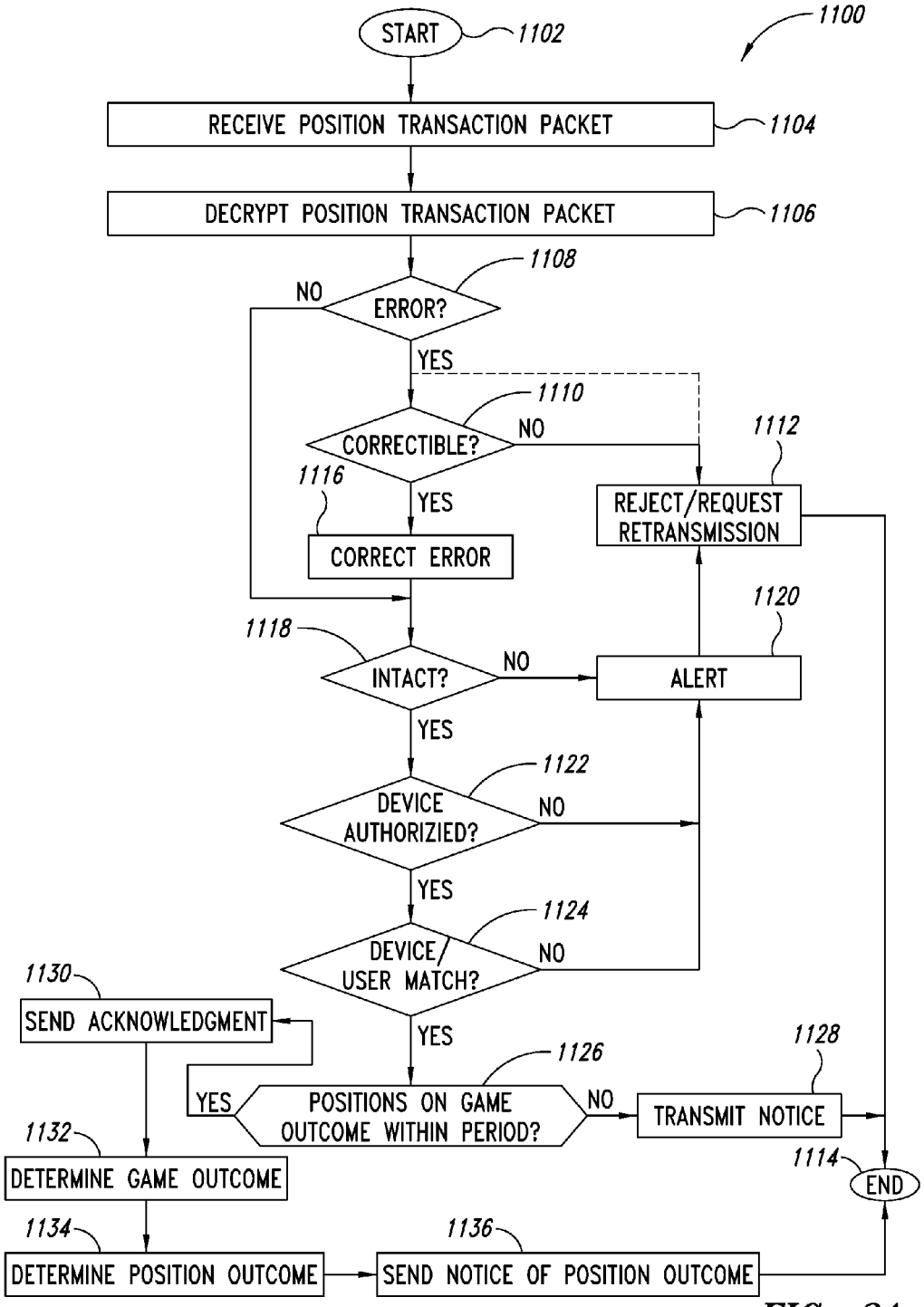
FIG. 31 is a flow diagram of a method of operating the casino server computing system, according to one illustrated embodiment.

FIG. 31 shows a method 1100 suitable for execution on a casino server computing system 42, according to one illustrated embodiment.

The method 1100 starts at 1102, for example, on supplying power to the casino server computing system 42, or in response to being called by another routine. The method 1100 may run sequentially, and/or may be executed as separate threads or processes in parallel.

At 1104, the casino server computing system 42 receives a position on game outcome transaction packet. The position on game outcome transaction packet may be received via a network, over a wired or wireless communications channel.

Optionally, at 1106 the casino server computing system 42 decrypts the position on game outcome transaction packet. The casino server computing system 42 may employ any suitable known or later developed encryption/decryption scheme or algorithm.

Optionally, at 1108 the casino server computing system 42 determines whether there is an error in the position on game outcome transaction packet. For example, an error may occur during the creation of the position on game outcome transaction packet and/or during the transmission of the position on game outcome transaction packet. The casino server computing system 42 may employ any suitable known or later developed error detection (e.g., parity) scheme or algorithm.

If an error is detected, control may pass to 1110 where the casino server computing system 42 determines if the error is correctable. Some embodiments may advantageously employ error correction to reduce the number of times information is retransmitted. If the error is not correctable, control passes to 1112 where the casino server computing system 42 rejects the position on game outcome transaction packet and/or requests retransmission of the position on game outcome transaction packet, and the method 1100 terminates at 1114. If the error is correctable, the casino server computing system 42 corrects the error at 1116. The casino server computing system 42 may employ any suitable known or later developed error correction scheme or algorithm.

Some embodiments may omit error correction to advantageously reduce the overhead associated with such. In such embodiments, upon detection of an error at 1108 control may pass directly to 1112.

At 1118, the casino server computing system 42 determines whether the position on game outcome transaction packet was received intact. This may help ensure that the information contained in the position on game outcome transaction packet is authenticated and that a power failure or interruption in communications does not present an opportunity for a breach of security. If the position on game outcome transaction packet was not received intact, the casino server computing system 42 may issue an alert or cause an alert to be issued at 1120. The position on game outcome transaction packet may then be rejected at 1112, and the method 1100 terminates at 1114.

If the position on game outcome transaction packet was received intact, control passes to 1122 where the casino server computing system 42 determines whether the wireless communications device 44 sending the position on game outcome transaction packet is an authorized device. The casino server computing system 42 may verify that the wireless communications device 44 is authorized using a lookup table or other database. The database may reflect the status of wireless communications devices provided by the casino or registered with the casino. If the wireless communications device 44 is not authorized, an alert is issued at 1120, the position on game outcome packet is rejected at 1112, and the method 1100 terminates at 1114. If the wireless communications device 44 is not authorized, control passes to 1124.

At 1124, the casino server computing system 42 determines whether the user submitting the position on game outcome is authorized to use the particular wireless communications device 44 that is generating or originating the position on game outcome transaction packet. The casino server computing system 42 may verify that the wireless communications device 44 is authorized using a lookup table or other database. The database may reflect the relationship between wireless communications devices and users. If the user is not authorized to use the particular wireless communications device 44, an alert is issued at 1120, the position on game outcome packet is rejected at 1112, and the method 1100 terminates at 1114. If the user is authorized to use the particular wireless communications device 44, control passes to 1126.

At 1126, casino server computing system 42 determines whether the position on game outcome was taken within a period during which positions on game outcome on the game were or are being accepted. This may be in addition to or as a substitute for the check or verification performed by the wireless communications device 44. The casino server computing system 42 may use the time that the position on game outcome was entered into or sent by the wireless communications device 44 as the time the position on game outcome is taken. Alternatively, the casino server computing system 42 may use the time that the position on game outcome transaction packet was received at a wireless remote access point of the network as the time the position on game outcome is taken. Alternatively, the casino server computing system 42 may use the time that the position on game outcome transaction packet was received by the casino server computing system 42 as the time the position on game outcome is taken.

The casino server computing system 42 may employ a "real-time" approach, only accepting positions on game outcome received at the casino server computing system 42 while the respective playing period is actually open. Additionally or alternatively, the casino server computing system 42 may accept positions on game outcome which are received at the casino server computing system 42 after the respective playing period is closed, if the casino server computing system 42 determines that the position on game outcome was taken while the respective playing period was open. This advantageously addresses possible issues related to delays in communications over the network. To achieve such, the casino server computing system 42 may temporarily keep a database or other record of time periods during which playing is allowed for different games, hands or rounds.

If the position on game outcome is not taken during an open playing period, the casino server computing system 42 transmits a notice at 1128 to the respective wireless communications device 44, and the method 1100 terminates at 1114. Otherwise, the casino server computing system 42 optionally sends an acknowledgement to the respective wireless communications device 44 at 1130.

At 1132, the casino server computing system 42 determines the game outcome. The casino server computing system 42 may rely on information received by one or more sensors and/or computing systems associated with the particular gaming table or machine. At 1134, the casino server computing system 42 determines the outcome of the position on game outcome, based at least in part on the outcome of the game, the amount associated with the position on game outcome in the position on game outcome transaction packet and any odds associated with the game or position taken on game outcome. At 1136, the casino server computing system 42 transmits a notice of the position on game outcome result to the respective wireless communications device 44, and the method 1100 terminates at 1114.

All of the above U.S. patents, U.S. patent application publications, U.S. patent applications, foreign patents, foreign patent applications and non-patent publications referred to in this specification and/or listed in the Application Data Sheet, including but not limited to U.S. Provisional Patent Application Ser. No. 60/791,397 filed Apr. 12, 2006; U.S. Pat. No. 6,460,848, issued Oct. 8, 2002, and entitled "METHOD AND APPARATUS FOR MONITORING CASINOS AND GAMING"; U.S. Pat. No. 6,652,379, issued Nov. 25, 2003, and entitled "METHOD, APPARATUS AND ARTICLE FOR VERIFYING CARD GAMES, SUCH AS BLACKJACK"; and U.S. Pat. No. 6,685,568, issued Feb. 3, 2004, and entitled "METHOD, APPARATUS AND ARTICLE FOR EVALUATING CARD GAMES, SUCH AS BLACKJACK"; and U.S. Patent Publication Nos. 2002/0187821, published Dec. 12, 2002, and entitled "METHOD, APPARATUS AND ARTICLE FOR RANDOM SEQUENCE GENERATION AND PLAYING CARD DISTRIBUTION"; 2003/0176209, published Sep. 18, 2003, and entitled "METHOD, APPARATUS AND ARTICLE EMPLOYING MULTIPLE MACHINE-READABLE INDICIA ON PLAYING CARDS"; and 2007/0243927, published Oct. 18, 2007, entitled "WIRELESS GAMING ENVIRONMENT" are incorporated herein by reference, in their entirety.

Although specific embodiments and examples are described herein for illustrative purposes, various equivalent modifications can be made without departing from the spirit and scope of the invention, as will be recognized by those skilled in the relevant art. The teachings provided herein can be applied to other systems for casino communications, not necessarily the handheld PDA based system generally described above. For example, the teachings can employ wireless communications devices such as cellular telephones, and cellular systems. Additionally, the teachings can employ networks other than dedicated Extranets, for example, the teachings may employ a network such as the Worldwide Web portion on the Internet, to interconnect some or all of the various described components. The various embodiments described above can be combined to provide further embodiments. The illustrated methods can omit some acts, can add other acts, and can execute the acts in a different order than that illustrated to achieve the advantages of the invention.

While explained in terms of a gaming environment, such techniques and embodiments described herein are suitable for gaming environments where no gambling occurs. Gaming environments where no gambling occurs is well known in the United States and other countries. For example, a company may host a "casino night" for its employees or a charity may host a "casino night" to raise money for a good cause. Entrance is typically free for employees, while charities may accept a donation for entrance. Each attendee is issued with a set of chips. Attendees take positions on game outcome using the chips, winning and losing chips through the evening. Importantly, the chips are not redeemable for cash. In some instances, the person collecting the most chips at the end of the night will be awarded a prize. However, the actual value of the prize is unrelated to the purported denominations of the chips (e.g., the same prize is awarded whether the top player has $100 worth of chips or $1,000,000 worth of chips). Casino nights are a fun contest to see who can collect the most chips, with no monetary award and no risk of loss by the attendees. Such events are considered as morale improving for the employees, and are successfully used by many charities. Whether for a fundraiser or entertainment event, the participants do not play with real money. Because of such, "casino nights" and the companies that run "casino nights" are not regulated by various gaming authorities. Importantly, since these events do not involve actual gambling, they do not require licenses of the various state gaming commissions.

These and other changes can be made to the invention in light of the above detailed description. In general, in the following claims, the terms used should not be construed to limit the invention to specific embodiments disclosed in the specification, but should be construed to include all computers, networks, databases, and wireless communications devices that operate in accordance with the claims. Accordingly, the invention is not limited by the disclosure, but instead its scope is to be determined entirely by the following claims.

The invention claimed is:

1. A method of operation in a table gaming automation system, the method comprising:

receiving at a wireless communications device at least one input indicative of whether each of a plurality of primary player positions at a multi-player gaming table are occupied by a respective primary player; and in response to the received input:

generating a display on at least a portion of a user interface on the wireless communications device, the user interface selectively presenting, for at least one occupied primary player position at the multi-player gaming table, a plurality of user-selectable primary game outcome prediction icons and a plurality of user-selectable backline outcome prediction icons;

wherein each of the plurality of user-selectable primary game outcome prediction icons represents one of a plurality of possible game outcomes selectable by the respective primary player prior to the conclusion of a current instance of a game executed at the multi-player gaming table in which the respective primary player participates;

wherein each of the plurality of user-selectable backline outcome prediction icons represents one of a plurality of possible backline game outcomes selectable by a player on a respective primary player prior to the conclusion of the current instance of the game executed at the multi-player gaming table in which the respective primary player participates; and preventing a selection of any backline outcome prediction icon for each unoccupied primary player position at the multi-player gaming table.

2. The method of claim 1 wherein a selection of one of the plurality of user-selectable primary game outcome prediction icons logically associates at least one of the respective primary player or the respective primary player position with a the selected possible game outcome in at least one non-transitory computer-readable medium for the current instance of the game executed at the multi-player gaming table in which the respective primary player participates.

3. The method of claim 1 wherein each of the plurality of user-selectable primary game outcome prediction icons for a respective primary player position has a respective legend indicative of one of a plurality of possible game outcomes selectable by the primary player at the respective primary player position prior to the conclusion of a current instance of a game executed at the multi-player gaming table in which the respective primary player participates.

4. The method of claim 1 wherein preventing entry of any backline game outcome prediction icon for each unoccupied primary player position at the multi-player gaming table includes omitting the generation on the user interface of the plurality of user-selectable backline outcome prediction icons for each of the unoccupied primary player positions.

5. The method of claim 1 wherein preventing entry of any backline game outcome prediction icon for each unoccupied primary player position at the multi-player gaming table includes generating on the user interface a plurality of non-selectable backline outcome prediction icons for each of the unoccupied primary player positions.

6. The method of claim 1 wherein the receiving at a wireless communications device at least one input indicative of whether each of a plurality of primary player positions at the multi-player gaming table are occupied includes detecting one or more gaming administrator supplied inputs, each input including a selection of at least one user-selectable icon of a plurality of user-selectable icons respectively representing an occupancy status of each primary player position at the gaming table.

7. The method of claim 1 wherein the receiving at a wireless communications device at least one input indicative of whether each of a plurality of primary player positions at the multi-player gaming table are occupied includes detecting at least one input provided by at least one sensor, the at least one input indicative of a physical presence of at least one of a primary player or a game piece used in the play of the game at the occupied primary player positions.

8. The method of claim 7, further comprising:

in response to the detecting, via the at least one sensor, the physical presence of at least one of a primary player or a game piece at the primary player positions, detecting selection via the user interface of one of the plurality of at least one of: a user-selectable primary game outcome prediction icon or a user-selectable backline outcome prediction icon; and responsive to the detecting selection of at least one of: the user-selectable primary game outcome position type icon or the respective selected user-selectable backline outcome prediction icon, changing an appearance of at least one of: the respective selected user-selectable primary game outcome prediction icon or the respective selected user-selectable backline outcome prediction icon to visually indicate a selected status or condition.

9. The method of claim 8 wherein the changing the appearance includes highlighting or removing highlighting of at least one of: the respective selected user-selectable primary game outcome prediction icon or the respective selected user-selectable backline outcome prediction icon.

10. The method of claim 8, further comprising:

in response to the detecting selection of at least one of: the user-selectable primary game outcome position type icon or the respective selected user-selectable backline outcome prediction icon, transmitting data indicative of at least one of: the respective selected primary game outcome prediction icon or the respective selected backline outcome prediction icon to a back end system.

11. The method of claim 10 further comprising sending by the back end system an update to a secondary player operated wireless communication device.

12. A non-transitory computer readable storage medium, having computer computer-executable instructions stored thereon that when executed by a computer processor cause the computer processor to provide a gaming table automation system by:

receiving at least one input via a wireless communications device, the at least one input indicative of whether each of a plurality of primary player positions at a multi-player gaming table are occupied by a respective primary player; and in response to the received input:

selectively generating a display on at least a portion of a user interface on the wireless communications device, the user interface to display, for at least one occupied primary player position at the multi-player gaming table a plurality of user-selectable primary game outcome prediction icons and a plurality of user-selectable backline outcome prediction icons;

wherein each of the plurality of user-selectable primary game outcome prediction icons represents one of a plurality of game outcomes selectable by the respective primary player prior to the conclusion of a current instance of a game executed at the multi-player gaming table in which the respective primary player participates;

wherein each of the plurality of user-selectable backline outcome prediction icons represents one of a plurality of possible backline game outcomes selectable by a player on a respective primary player prior to the conclusion of the current instance of the game executed at the multi-player gaming table in which the respective primary player participates; and preventing a selection of any backline outcome prediction icons for each primary player position at the gaming table for which an input indicative of occupancy by a primary player has not been received.

13. The non-transitory computer readable storage medium of claim 12 wherein a selection of one of the plurality of user-selectable primary game outcome prediction icons displayed on the user interface cause the computer-executable instructions, when executed by the computer processor, to further cause the computer processor to logically associate at least one of the respective primary player or the respective primary player position with a particular game outcome for at least one instance of the game executed at the multi-player gaming table in which the respective primary player participates.

14. The non-transitory computer readable storage medium of claim 12 wherein each of the plurality of user-selectable primary game outcome prediction icons displayed on the user interface for a respective primary player position has a respective legend indicative of one of the plurality of possible game outcomes selectable by the primary player at the respective primary player position prior to the conclusion of a current instance of a game executed at the multi-player gaming table in which the respective primary player participates.

15. A wireless communication device operable to provide a gaming table automation system, the wireless communication device comprising:

a processor;

a processor-readable nontransitory memory that stores instructions executable by the processor to cause the processor to:

receive at least one input indicative of whether each of a plurality of primary player positions at a gaming table are occupied by a respective primary player; and in response to the received input:

selectively generate on a display communicably coupled to the processor a plurality of user-selectable primary game outcome prediction icons and a plurality of user-selectable backline outcome prediction icons;

wherein each of the plurality of user-selectable primary game outcome prediction icons represents one of a plurality of possible game outcomes selectable by the respective primary player prior to the conclusion of a current instance of a game executed at the multi-player gaming table in which the respective primary player participates;

wherein each of the plurality of user-selectable backline outcome prediction icons represents one of a plurality of possible backline game outcomes selectable by a player on a respective primary player prior to the conclusion of a current instance of a game executed at the multi-player gaming table in which the respective primary player participates; and prevent selection of any backline outcome prediction icons for each primary player position at the multi-player gaming table for which an input indicative of occupancy by a primary player has not been received by the processor.

16. The wireless communication device of claim 15, wherein the executable instructions further cause the processor to:

determine if a primary player position on which a secondary player placed a backline outcome prediction in an immediately prior instance of a game executed on the multi-player gaming table is unoccupied for the current instance of a game executed on the multi-player gaming table; and notify the secondary player via the user interface.

17. The wireless communication device of claim 15, wherein the executable instructions further cause the processor to:

determine if a primary player position on which a secondary player placed a backline outcome prediction in an immediately prior instance of a game executed on the multi-player gaming table is unoccupied for the current instance of a game executed on the multi-player gaming table; and responsive to determining that the respective primary player position is unoccupied, reset the backline outcome prediction provided by the secondary player on the respective primary player position.

* * * * *